US009824872B2

(12) United States Patent
Trimpin

(10) Patent No.: US 9,824,872 B2
(45) Date of Patent: Nov. 21, 2017

(54) SYSTEMS AND METHODS FOR HIGH THROUGHPUT SOLVENT ASSISTED IONIZATION INLET FOR MASS SPECTROMETRY

(71) Applicant: Sarah Trimpin, Detroit, MI (US)

(72) Inventor: Sarah Trimpin, Detroit, MI (US)

(73) Assignee: Wayne State University, Detroit, MI (US)

( * ) Notice: Subject to any disclaimer, the term of this patent is extended or adjusted under 35 U.S.C. 154(b) by 0 days.

(21) Appl. No.: 15/181,300

(22) Filed: Jun. 13, 2016

(65) Prior Publication Data

US 2016/0284528 A1 Sep. 29, 2016

Related U.S. Application Data

(63) Continuation of application No. 14/073,731, filed on Nov. 6, 2013, now abandoned, which is a continuation-in-part of application No. 13/819,487, filed as application No. PCT/US2011/050150 on Sep. 1, 2011, now Pat. No. 9,552,973.

(60) Provisional application No. 61/723,217, filed on Nov. 6, 2012, provisional application No. 61/379,475, filed on Sep. 2, 2010, provisional application No. 61/391,248, filed on Oct. 8, 2010, provisional (Continued)

(51) Int. Cl.

| | |
|---|---|
| ***H01J 49/00*** | (2006.01) |
| ***H01J 49/04*** | (2006.01) |
| ***H01J 49/24*** | (2006.01) |
| ***H01J 49/10*** | (2006.01) |

(52) U.S. Cl.

CPC ..... *H01J 49/0468* (2013.01); *H01J 49/10* (2013.01); *H01J 49/24* (2013.01)

(58) Field of Classification Search

None

See application file for complete search history.

(56) References Cited

U.S. PATENT DOCUMENTS

| | | | |
|---|---|---|---|
| 5,130,538 | A | 7/1992 | Fenn et al. |
| 5,382,793 | A | 1/1995 | Weinberger et al. |
| 5,581,080 | A | 12/1996 | Fenn et al. |

(Continued)

FOREIGN PATENT DOCUMENTS

| | | |
|---|---|---|
| JP | H06331616 | 12/1994 |
| JP | 3379989 | 2/2003 |

(Continued)

OTHER PUBLICATIONS

Zhigilei, "Dynamics of the plume formation and parameters of the ejected clusters in short-pulse laser ablation," Appl. Phys. A, vol. 76, 2003, pp. 339-350.

(Continued)

*Primary Examiner* — Andrew Smyth

(74) *Attorney, Agent, or Firm* — Lee & Hayes PLLC; C. Rachal Winger

(57) ABSTRACT

A multiplex system and method for achieving high throughput analysis of samples using solvent assisted ionization inlet includes an ionizing system with a heated inlet channel and a pressure differential across the inlet channel, pipet tips serially aligned with the inlet to a mass spectrometer, and a system of mapping data generated by mass spectrometry.

46 Claims, 70 Drawing Sheets

Related U.S. Application Data application No. 61/446,187, filed on Feb. 24, 2011, provisional application No. 61/493,400, filed on Jun. 3, 2011.

(56) References Cited

U.S. PATENT DOCUMENTS

| | | | | |
|---|---|---|---|---|
| 5,672,868 | A * | 9/1997 | Mordehai | H01J 49/063 250/281 |
| 5,686,726 | A | 11/1997 | Fenn et al. | |
| 5,808,300 | A * | 9/1998 | Caprioli | H01J 49/0004 250/281 |
| 6,118,120 | A | 9/2000 | Fenn et al. | |
| 6,248,998 | B1 | 6/2001 | Okumoto et al. | |
| 6,410,915 | B1 | 6/2002 | Bateman et al. | |
| 6,586,731 | B1 | 7/2003 | Jolliffe | |
| 6,683,300 | B2 * | 1/2004 | Doroshenko | H01J 49/04 250/282 |
| 7,034,292 | B1 | 4/2006 | Whitehouse et al. | |
| 7,075,640 | B2 | 7/2006 | Baer et al. | |
| 7,285,422 | B1 * | 10/2007 | Little | B01J 19/0046 436/173 |
| 8,853,621 | B2 | 10/2014 | Trimpin | |
| 9,177,773 | B2 | 11/2015 | Trimpin | |
| 2003/0213907 | A1 * | 11/2003 | Rutzke | H01J 49/04 250/288 |
| 2004/0051038 | A1 | 3/2004 | Taniguchi | |
| 2004/0094702 | A1 | 5/2004 | Clemmer | |
| 2004/0159784 | A1 * | 8/2004 | Doroshenko | H01J 49/403 250/288 |
| 2005/0173628 | A1 | 8/2005 | Ahern et al. | |
| 2005/0224710 | A1 | 10/2005 | Matsuo et al. | |
| 2006/0022129 | A1 * | 2/2006 | Shchepinov | G01N 33/6848 250/282 |
| 2006/0124551 | A1 * | 6/2006 | Gjerde | B01J 20/285 210/656 |
| 2006/0269980 | A1 | 11/2006 | Gibbs | |
| 2007/0048187 | A1 | 3/2007 | Sheehan | |
| 2007/0059776 | A1 | 3/2007 | Boschetti et al. | |
| 2007/0066769 | A1 | 3/2007 | Venkataraman | |
| 2008/0008874 | A1 * | 1/2008 | Little | B01J 19/0046 428/332 |
| 2008/0111066 | A1 | 5/2008 | Zhang et al. | |
| 2008/0272294 | A1 * | 11/2008 | Kovtoun | H01J 49/0463 250/288 |
| 2008/0305555 | A1 | 12/2008 | Bouvier et al. | |
| 2009/0008549 | A1 | 1/2009 | Kim | |
| 2009/0140140 | A1 | 6/2009 | Raznikov | |
| 2009/0194687 | A1 | 8/2009 | Jolliffe et al. | |
| 2010/0090101 | A1 | 4/2010 | Schultz et al. | |
| 2010/0176288 | A1 * | 7/2010 | Barnes | H01J 49/164 250/282 |
| 2010/0273666 | A1 | 10/2010 | Bernatchez et al. | |
| 2010/0276582 | A1 | 11/2010 | Chen et al. | |
| 2011/0210242 | A1 | 9/2011 | Bateman | |
| 2012/0085903 | A1 | 4/2012 | Trimpin | |
| 2013/0306856 | A1 | 11/2013 | Trimpin et al. | |

FOREIGN PATENT DOCUMENTS

| | | | | |
|---|---|---|---|---|
| JP | 2004294453 | | 10/2004 | |
| JP | 2006518914 | | 8/2006 | |
| WO | WO2009063776 | | 5/2009 | |
| WO | WO 2009063776 | A1 * | 5/2009 | G01N 27/62 |
| WO | WO2012031082 | A2 | 3/2012 | |
| WO | WO2012058248 | | 5/2012 | |

OTHER PUBLICATIONS

Zhigilei, et al., "Microscopic mechanisms of laser ablation of organic solids in the thermal and stress confinement Irradiation regimes," Journal of Applied Physics, vol. 88, 2000, pp. 1281-1298.
Zhigilei, et al., "On the threshold behavior in laser ablation of organic solids," Chem. Phys. Letters, vol. 276, 1997, pp. 269-273.
Zydel, et al., "Laserspray ionization using an atmospheric solids analysis probe for sample introduction," Journal of American Soceity for Mass Spectrometry, vol. 21, 2010, pp. 1889-1892.
Agilent Rapid Fire brochure, Jun. 1, 2011.
Alves, et al., "Gas-Phase Ionization/Desolvation Processes and Their Effect on Protein Charge State Distribution Under Matrix Assisted Laser Desorption/Ioniztion Conditions," European Journal of Mass Spectrometry, Vo. 12, 2006, pp. 369-383.
Annan, et al., "Phosphopeptide Analysis by Matrix-Assisted Laser Desorption Time-of-Flight Mass Spectrometry," Analytical Chemistry, vol. 68, 1996, pp. 3413-3421.
Batoy, et al., "Developments in MALDI Mass Spectrometry: The Quest for the Perfect Matrix," Applied Spectroscopy Reviews, vol. 43, 2008, pp. 485-550.
Beavis, et al., "Alpha-Cyano-4-Hydroxycinnamic Acid as a Matrix for Matrix-Assisted Laser Desorpion Mass Spectrometry," Organic Mass Spectrometry, vol. 27, 1992, pp. 156-158.
Beavis, et al., "Matrix-Assisted Laser-Desorption Mass Spectrometry Using 355 nm Radiation," Rapid Communication in Mass Spectrometry, vol. 3, 1989, pp. 436-439.
Brown, et al., "Further Studies of In-Source Fragmentation of Peptides in Matrix-Assisted Laser Desorption-Ionization," International Journal of Mass Spectormetry, vol. 169-170, pp. 1-18.
Bush, et al., "Collision Cross Sections of Proteins and Their Complexes: A Calibration Framework and Database for Gas-Phase Structural Biology," Analytical Chemistry, vol. 82, 2010, pp. 9557-9565.
Cadene, et al., "A Robust, Detergent-Friendly Method for Mass Spectrometric Analysis of Integral Membrane Proteins," Analytical Chemistry, vol. 72, 2000, pp. 5655-5658.
Chang et al. "Matrix-Assisted Laser Desorption/Ionization (MALDI) Mechanism Revisited," Analytical Chim. Acta, vol. 582, 2007, pp. 1-9.
Chaurand, et al., "Peptide and Protein Identification by Matrix-Assisted Laser Desorption Ionization (MALDI) and MALDI-Post-Source Decay Time-of-Flight Mass Spectrometry," Journal of American Society for Mass Spectrometry, vol. 10, 1999, pp. 91-103.
Cohen, et al., "Analysis of Quaternary Protein Ensembles by Matrix Assisted Laser Desorption/Ionization Mass Spectrometry," Journal of American Society for Mass Spectrometry, vol. 8, 1997, pp. 1046-1052.
Colgrave, et al., "Nanoelectrospray Ion Mobility Spectrometry and Ion Trap Mass Spectrometry Studies of the Non-Covalent Complexes of Amino Acids and Peptides with Polyethers," International Journal of Mass Spectrometry, vol. 229, 2003, pp. 209-216.
Demirev, et al., "Top-Down Proteomics for Rapid Identification of Intact Microorganisms," S. Analytical Chemistry, vol. 17, 2007, pp. 7455-7461.
Djidja, et al., "Detergent Addition to Tryptic Digests and Ion Mobility Separation Prior to MS/MS Improves Peptide Yield and Protein Identification for in Situ Proteomic Investigation of Frozen and Formalin-Fixed Paraffin-Embedded Adenocarcinoma Tissue Sections," Proteomics, vol. 9, 2009, pp. 2750-2763.
Dole, et al., "Molecular Beams of Macroions," Journal of Chem. Phys., vol. 49, 1968, pp. 2240-2249.
Fenn, et al., "Characterizing Ion Mobility-Mass Spectrometry Conformation Space for the Analysis of Complex Biological Samples," Anal. Bioanal. Chem., vol. 394, 2009, pp. 235-244.
Fenn, et al., "Electrospray Ionization for Mass Spectrometry of Large Biomolecules", Science, Oct. 1989, vol. 246, No. 4926, pp. 64-71.
FlashQuant brochure, 2007.
Fournier, et al., "Delayed Extraction Experiments Using a Repulsing Potential Before Ion Extraction: Evidence of Non-Covalent Clusters as Ion Precursor in UV Matrix-Assisted Laser Desorption/Ionization. Part II—Dynamic Effects with Alpha-Cyano-4-Hydroxycinnamic Acid Matrix", International Journal of Mass Spectronomy, vol. 213, 2002, pp. 203-215.
Fournier, et al., "Delayed Extraction Experiments Using a Repulsing Potential Before Ion Extraction: Evidence of Non-Covalent Clusters as Ion Precursor in UV Matrix-Assisted Laser Desorption/

(56) References Cited

OTHER PUBLICATIONS

Ionization. Part II—Dynamic Effects with Alpha-Cyano-4-Hydroxycinnamic Acid Matrix", Journal of Mass Spectrometry, vol. 40, 2005, pp. 50-59.
Garrett, et al., "Analysis of Intact Tissue by Intermediate-Pressure MALDI on a Linear Ion Trap Mass Spectrometer," Analytical Chemistry, vol. 78, 2006, pp. 2465-2469.
Handschuh, et al., "Laser-Induced Molecular Desorption and Particle Ejection from Organic Films," Appl. Surf. Sci., vol. 137, 1999.
Hoaglund, et al., "Three-Dimensional Ion Mobility/TOFMS Analysis of Electrosprayed Biomolecules," Analytical Chemistry, vol. 70, 1998, pp. 2236-2242.
Hortin, "The MALDI-TOF Mass Spectrometric View of the Plasma Proteome and Peptidome," Clinical Chemistry, vol. 32, 2006, pp. 1223-1237.
Inutan, et al., "Commercial Intermediate Pressure MALDI Ion Mobility Spectrometry Mass Spectrometer Capable of Producing Highly Charged Laserspray Ionization Ions," Analytical Chemistry, vol. 83, 2011, pp. 678-684.
Inutan, et al., "Laserspray Ionization (LSI) Ion Mobility Spectrometry (IMS) Mass Spectrometry," Journal of American Society for Mass Spectrometry, vol. 21, 2010, pp. 1260-1264.
Inutan, et al., "Laserspray Ionization, a New Method for Protein Analysis Directly from Tissue at Atmospheric Pressure with Ultrahigh Mass Resolution and Electron Transfer Dissociation," Mol. Cell. Proteomics, vol. 10, 2011, pp. 1-8.
Inutan, et al., "Laserspray Ionization-Ion Mobility Spectrometry-Mass Spectrometry: Baseline Separation of Isomeric Amyloids without the Use of Solvents Desorbed and Ionized Directly from a Surface," Journal of Proteom Research, vol. 9, 2010, pp. 6077-6081.
Iribarne, et al., "On the Evaporation of Small Ions from Charged Droplets," J. Chem. Phys., vol. 64, 1976, pp. 2287-2294.
Jackson, et al., "Direct Tissue Analysis of Phospholipids in Rat Brain Using MALDITOFMS and MALDI-Ion Mobility TOFMS," Journal of Amercian Society for Mass Spectrometry, vol. 16, 2005, pp. 133-138.
Jackson, et al., "MALDI-Ion Mobility-TOFMS Imaging of Lipids in Rat Brain Tissue," Journal of Mass Spectrometry, vol. 42, 2007, pp. 1093-1098.
Jaskolla, et al., "Compelling Evidence for Lucky Survivor and Gas Phase Protonation: The Unified MALDI Analyte Protonation Cechanism," Journal of American Society for Mass Spectrometry, vol. 22, 2011, pp. 976-988.
Jones, et al., "Determination of Disulfide Bonds in Highly Bridged Disulfide-Linked Peptides by Matrix-Assisted Laser Desorption/Ionization Mass Spectrometry With Postsource Decay", Analytical Chemistry, vol. 70, 1998, pp. 136-143.
Karas, et al., "Ion Formation in MALDI: The Cluster Ionization Mechanism," Chem Rev., vol. 103, 2003, pp. 427-439.
Karas, et al., "Ionization in Matrix-Assisted Laser Desorption/Ionization: Singly Charged Molecular Ions are the Lucky Survivors", Journal of Mass Spectrometry, vol. 35, 2000, pp. 1-12.
Karas, et al., "Laser Desorption Ionization of Proteins with Molecular Masses Exceeding 10,000 Daltons", Analytical chemistry, vol. 60, 1988, pp. 2299-2301.
Karas, et al., "Matrix Dependence of Metastable Fragmentation of Glycoproteins in MALDI TOF Mass Spectrometry", Analytical Chemistry, vol. 67, 1995, pp. 675-679.
Karas, et al., "Matrix-Assisted Ultraviolet Laser Desorption of Non-Volatile Compounds," International Journal of Mass Spectrometry: Ion Proc., vol. 78, 1987, pp. 53-68.
Katta, et al., "Applications of In-Source Fragmentation of Protein Ions for Direct Sequence Analysis by Delayed Extraction MALDI-TOF Mass Spectrometry," Analytical Chemistry, Vo. 70, pp. 1998, pp. 4410-4416.
Kaufmann, et al., "Post-Source Decay and Delayed Extraction in Matrix-Assisted Laser Desorption/Ionization-Reflectron Time-of-Flight Mass Spectrometry. Are there trade-offs?," Rapid Communications in Mass Spectrometry, vol. 10, 1996, pp. 1199-1208.
Kim, et al., "Experimental and Theoretical Investigation into the Correlation Between Mass and Ion Mobility for Choline and Other Ammonium Cations in N2," Analytical Chemistry, vol. 80, 2008, pp. 1928-1936.
Knochenmuss, "Ion Formation Mechanisms in UV-MALDI", Analyst, vol. 131, 2006, pp. 966-986.
Knochenmuss, et al., "MALDI Ionization: The Role of In-Plume Processes", Chem. Rev., vol. 103, 2003, pp. 441-452.
Knochenmuss, et al., "Molecular Dynamics Model of Ultraviolet Matrix-Assisted Laser Desorption/Ionization Including Ionization Processes", J. Phys. Chem. B., vol. 109, 2005, pp. 22947-22957.
Krause, et al., "Studies on the Selection of New Matrices for Ultraviolet Matrix-Assisted Laser Desorption/Ionization Time-of-Flight Mass Spectrometry", Rapid Communications in Mass Spectrometry, vol. 10, 1996, pp. 1927-1933.
Krutchinsky, et al., "On the Nature of the Chemical Noise in MALDI Mass Spectra", Journal of Americal Society for Mass Spectrometry, vol. 13, 2002, pp. 129-134.
Laiko, et al., "Atmospheric Pressure Matrix-Assisted Laser Desorption/Ionization Mass Spectrometry", Analytical Chemistry, vol. 72, 2000, pp. 652-657.
Landgraf, et al., "Imaging of Lipids in Spinal Cord Using Intermediate Pressure Matrix-Assisted Laser Desportion-Linear Ion Trap/Orbitrap MS", Analytical Chemistry, vol. 81, 2009, pp. 8488-8495.
LDTD Ion Source brochure, publication date unknown.
Leary, et al., "Methodology for Measuring Conformation of Solvent-Disrupted Protein Subunits Using T-WAVE Ion Mobility MS: and Investigation into Eukaryotic Initiation Cactors", Journal of American Society of Mass Spectrometry, vol. 20, 2009, pp. 169-1706.
Lee, et al., "Determination of Cross Sections by Overtone Mobility Spectrometry: Evidence for Loss of Unstable Structures at Higher Overtones", J. Phys. Chem. B., vol. 114, 2010, pp. 12406-12415.
McCombie, et al., "Small-Molecule MALDI Using the Matrix Suppression Effect to Reduce or Eliminate Matrix Backgroud Interferences", Analytical Chemistry, vol. 76, 2004, pp. 4990-4997.
McEwen, et al., "An Alternative Ionization Paradigm for Atmospheric Pressure Mass Spectrometry: Flying Elephants from Trogan Horses", International Journal of Mass Spectrometry, vol. 300, 2011, pp. 167-172.
McEwen, et al., "Laserspray Ionization on a Commercial Atmospheric Pressure-MALDI Mass Spectrometer Ion Source: Selecting Singly or Multiply Charged Ions," Analytical Chemistry, vol. 82, 2010, pp. 4998-5001.
McEwen, et al., "New Paradigm in Ionization: Multiply Charged Ion Formation from a Solid Matrix without a Laser or Voltage", Analytical Chemistry, vol. 82, 2010, pp. 9164-9168.
McLean, et al., "Profiling and Imaging of Tissues by Imaging Ion Mobility-Mass Spectrometry", Journal of Mass Spectrometry, vol. 42, 2007, pp. 1099-1105.
Nguyen, et al., "Gas-Phase Ions of Solute Species from Charged Droplets of Solutions", Proc. Nat. Acad. Science, vol. 104, No. 4, 2007, pp. 1111-1117.
Niu, et al., "Direct Comparison of Infrared and Ultraviolet wavelength matrix-Assisted Laser Desorption/Ionization Mass Spectrometry of Proteins", Journal of American Society for Mass Spectrometry, vol. 9, 1998, pp. 1-7.
Nordhoff, et al., "Matrix-Assisted Laser Desorption/Ionization Mass Spectrometry of Nucleic Acids with Wavelengths in the Ultraviolet and Infrared", Rapid Communications in Mass Spectrometry, vol. 6, 1992, pp. 771-776.
Final Office Action Dated Jan. 28, 2015 in U.S. Appl. No. 14/073,731.
Final Office Action Dated Feb. 16, 2016 in U.S. Appl. No. 13/819,487.
Office Action mailed Feb. 19, 2015 in U.S. Appl. No. 13/819,487.
Office Action mailed Jul. 2, 2014 in U.S. Appl. No. 14/073,731.
Office Action Dated Aug. 21, 2015 in U.S. Appl. No. 13/819,487.
Office Action Dated Aug. 27, 2015 in U.S. Appl. No. 14/073,731.
Richards, et al., "High-Throughput Analysis of Peptides and Proteins by Laserspray Ionization Mass Spectrometry", Rapid Communications in Mass Spectrometry, vol. 25, 2011, pp. 247-250.

(56) References Cited

OTHER PUBLICATIONS

Richards, et al., "Imaging Mass Spectrometry in Transmission Geometry", Rapid Communications in Mass Spectrometry, vol. 25, 2011, pp. 815-820.
Ridenour, et al., "Structural Characterization of Phospholipids and Peptides Directly from Tissue Sections by MALDI Travelling-Wave Ion Mobility-Mass Spectrometry", Analytical Chemistry, vol. 82, 2010, pp. 1881-1889.
Scarff, et al., "Travelling Wave Ion Mobility Mass Spectrometry Studies of Protein Structure: Biological Significance and Comparison with X-Ray Crystallography and Nuclear Magnetic Resonance Spectroscopy Measurements", Rapid communications in Mass Spectrometry, vol. 22, 2008, pp. 3297-3304.
Schneider, et al., "AP and Vacuum MALDI on a QqLIT Instrument", Journal of American Society for Mass Spectrometry, vol. 16, 2005, pp. 176-182.
Scheurenberg, et al., "Matrix-Assisted Laser Desportion/Ionization in Transmission Geometry: Instrumental Implementation and Mechanistic Implications," Rapid Communications in Mass Spectrometry, vol. 10, 1996, pp. 1873-1880.
Senko, et al., "Collisional Activation of Large Multiply Charged Ions Using Fourier Transform Mass Spectrometry", Analytical Chemistry, vol. 66, 1994, pp. 2801-2808.
Shvartsburg, et al., "Pendular Proteins in Gases and New Avenues for Characterization of Macromolecules by Ion Mobility Spectrometry," Proc. Nat. Mad. Science, vol. 106, 2009, pp. 6495-6500.
Smith, et al., "Monitoring Copopulated Conformational States During Protein Folding Events Using Electrospray Ionization-Ion Mobility Spectrometry-Mass Spectrometry", Journal of American Society for Mass Spectrometry, vol. 18, 2007, pp. 2180-2190.
Search Report and Written Opinion dated Feb. 14, 2012 in PCT Application No. PCT/US2011/057769.
Search Report and Written Opinion dated Mar. 3, 2012 for PCT Application No. PCT/US2011/050150.
Tanaka, et al., "Protein and Polymer Analyses up to M/Z 100 000 by Laser Ionization Time-of-Flight Mass Spectrometry", Rapid Communications in Mass SPectrometry, vol. 2, 1988, pp. 151-153.
Tao, et al., "A Collision Cross-Section Database of Singly-Charged Peptide Ions," Journal of American Society for Mass Spectrometry, vol. 18, 2007, pp. 1232-1238.
Trimpin, "A perspective on MALDI alternatives-total solvent-free analysis and electron transfer dissociation of highly charged ions by laserspray ionization," Journal of Mass Spectrometry, vol. 45, 2010, pp. 471-485.
Trimpin, et al., "Analysis of insoluble proteins," Biotechniques, vol. 46, 2009, pp. 409-419.
Trimpin, et al., "Field-free transmission geometry atmospheric pressure matrix-assisted laser desorption/ionization for rapid analysis of unadulterated tissue samples," Rapid Communications in Mass Spectrometry, vol. 23, 2009, pp. 3023-3027.
Trimpin, "High-throughput analysis of peptides and proteins by laserspray ionization mass spectrometry," Rapid Communications in Mass Spectrometry, vol. 25, 2011, pp. 247-250.
Trimpin, et al., "Identification of endogenous phosphorylation sites of bovine medium and low molecular weight neurofilament proteins by tandem mass spectrometry," Biochemsitry, vol. 43, 2004, pp. 2091-2105.
Trimpin, "Imaging mass spectrometry in transmission geometry," Rapid Communications in Mass Spectrometry, vol. 25, 2011, pp. 815-820.
Trimpin, et al., "Investigations of theoretical principles for MALDI-MS derived from solvent-free sample preparation: Part I. Preorganization," International Journal of Mass Spectrometry, vol. 253, 2006, pp. 13-21.
Trimpin, et al., "Ion mobility spectrometry/mass spectrometry snapshots for assessing the molecular compositions of complex polymeric systems," Analytical Chemistry, vol. 80, 2008, pp. 9073-9083.
Trimpin, et al., "Laserspray ionization, a new atmospheric pressure MALDI method for producing highly charged gas-phase ions of peptides and proteins directly from solid solutions," Mol. Cell. Proteomics, vol. 9, 2010, pp. 362-367.
Trimpin, et al., "Matrix-assisted laser desorption/ionization mass spectrometry metod for selectively producing either singly or multiply charged molecular ions," Analytical Chemistry, vol. 82, 2010, pp. 11-15.
Trimpin, et al., "Resolving oligomers from fully grown polymers with IMS-MS," Analytical Chemistry, vol. 79, 2007, pp. 7965-7974.
Vestal, "Modern MALDI Time-of-Flight Mass Spectrometry", Journal of Mass Spectrometry, vol. 44, 2009, pp. 303-317.
Vinh, et al., "Sequencing Branched Peptides with CID/PSD MALDI-TOF in the Low-Picomole Range: Application to the Structural Study of the Posttranslational Polyglycylation of Tubulin," Analytical Chemistry, vol. 69, 1997, pp. 3979-3985.
Von Helden, et al., "Inclusion of a MALDI ion source in the ion chromatography technique: conformational information on polymer and biomolecular ions," International Journal of Mass Spectrometry, Ion Processes, vol. 146-147, 1995, pp. 349-364.
Wang, et al., "A New Approach to High Sensitivity Liquid Chromatography-Mass Spectrometry of Peptides Using Nanoflow Solvent Assisted Inlet Ionization," Journal of American Society for Mass Spectrometry, vol. 23, 2012, pp. 442-445.
Wang, et al., "Producing Highly Charged Ions Without Solvent Using Laserspray Ionization: A Total Solvent-Free Analysis Approach at Atmospheric Pressure," Analytical Chemistry, vol. 83, 2011, pp. 4076-4084.
Weidner, et al., "Mass Spectrometry of Synthetic Polymers", Analytical Chemistry, vol. 82, 2010, pp. 4811-4829.
Wenzel, et al., "2.5-Dihydroxyacetophenone: a Matrix for Highly Sensitive Matrix Assisted Laser Desorption/ionization Time-of-Flight Mass Spectrometric Analysis of Proteins Using Manual and Automated Preparation Techniques", Rapid Communications in Mass Spectrometry, vol. 20, 2006, pp. 785-789.
Williams, et al., "Use of Ion Mobility Mass Spectrometry and a Collision Crossection Algorithm to Study an Organometallic Ruthenium Anticancer Complex and its Adducts with a DNA Oligonucleotide", Rapid Communications in Mass Spectrometry, vol. 23, 2009, pp. 3563-3569.
Woods, et al., "Lipid/peptide/nucleotide separation with MALDI-ion mobility-TOF MS," Analytical Chemistry, vol. 76, 2004, pp. 2187-2195.
Wortmann, et al., "Investigation of the First Shot Phenomenon in MALDI Mass Spectrometry of Protein Complexes", Analyst, vol. 132, 2007, pp. 199-207.

* cited by examiner

A1
clozapine:clozapine-d8 = 0:1
A2
clozapine:clozapine-d8 = 0.4:1
A3
clozapine:clozapine-d8 = 1:1
A4
clozapine:clozapine-d8 = 2:1

5 pmol/uL Lys, no ammonium acetate 5 pmol/uL Lys with ammonium acetate

SYSTEMS AND METHODS FOR HIGH THROUGHPUT SOLVENT ASSISTED IONIZATION INLET FOR MASS SPECTROMETRY

CROSS-REFERENCE TO RELATED APPLICATIONS

This application is a continuation of U.S. application Ser. No. 14/073,731, filed on Nov. 6, 2013, which claims the benefit under 35 USC §119(e) to U.S. Patent Application 61/723,217 filed Nov. 6, 2012; and U.S. application Ser. No. 14/073,731 is a continuation-in-part of U.S. patent application Ser. No. 13/819,487, filed May 8, 2013, which is a US national stage application of international patent application PCT/US2011/050150, filed Sep. 1, 2011 which claims priority to U.S. patent application 61/493,400, filed Jun. 3, 2011, U.S. patent application 61/446,187, filed Feb. 24, 2011, U.S. patent application 61/391,248, filed Oct. 8, 2010, and U.S. patent application 61/379,475, filed Sep. 2, 2010, the entirety of each of which is incorporated by reference herein.

STATEMENT OF GOVERNMENT SUPPORT

This work was supported in part by National Science Foundation Career Grant number 0955975.

FIELD OF THE DISCLOSURE

The disclosed systems and methods relate to spectrometry. More specifically, the disclosed systems and methods relate to ionizing molecules for mass spectrometry ("MS") and ion mobility spectrometry ("IMS"). New high throughput systems and methods for, solvent assisted ionization inlet ("SAII"), formerly referred to as solvent assisted inlet ionization ("SAII"), for mass spectrometry are also disclosed. The systems and methods allow rapid multiplexed SAII and mapping of results for rapid qualitative and quantitative analysis of samples.

BACKGROUND OF THE DISCLOSURE

Mass spectrometry is an analytical technique used to determine the molecular weight (or mass) of a sample or molecule ("analyte") and is used in a wide variety of applications including trace gas analysis, pharmocokinetics, and protein characterization, to name a few. Mass spectrometry techniques typically include the ionizing of chemical compounds to generate charged molecules ("ions") in order to separate them by the mass-to-charge (m/z) ratios. Accurate mass measurements and fragmentation technology determine for example elemental composition, sequence information, and quantitative ("amounts") information. Ion mobility spectrometry measures the drift times of ions which is influenced by the size, (shape) and charge of the ions.

Various methods have been developed to ionize samples consisting of one or many molecules that are volatile and nonvolatile. For example, electrospray ionization ("ESI") produces charged droplets of the solvent/analyte from a liquid stream passing through a capillary onto which a high electric field is applied relative to a counter electrode. The charged droplets are desolvated (evaporation of the solvent, but not the charge) until the Raleigh limit is reached in which the charge repulsion of like charges exceeds the surface tension of the liquid. Under these conditions so called "Taylor cones" are formed in which smaller droplets are expelled from the parent droplet and carry a higher ratio of charge to mass than the parent droplet. These prodigy droplets can undergo this same process until eventually ions are expelled from the droplet due to the high-repulsive field (ion evaporation mechanism) or the analyte ions remain after all the solvent evaporates.

Another ionization process called sonic spray ionization ("SSI") has also been developed. In SSI, a high velocity of a nebulizing gas is used to produce charged droplets instead of an electric field as used in ESI.

However, these conventional methods of ionizing a solution with an analyte require an electric field or a high velocity gas, which increase the complexity and cost of the spectrometry system and lowers the throughput. The above methods also involve producing ions at or near atmospheric pressure and transferring them through a channel to a lower pressure for mass analysis, which is an inefficient process. The ions are multiply charged which extends the mass range of high performance mass spectrometers, improves IMS separations, and enhances intentional fragmentation such as collision induced dissociation ("CID") and electron transfer dissociation ("ETD"), as examples, for structural characterization.

An example of an ionization method is matrix-assisted laser desorption/ionization ("MALDI"). In MALDI, a laser ablates analyte that is incorporated into a matrix (small molecule that absorbs radiation from the laser) which produces mostly singly-charged ions that are mass analyzed. More recently, an ionization method initially called laser-spray ionization ("LSI"), currently laserspray ionization inlet ("LSII") was discovered that produces ions of very similar charge states as ESI, but by laser ablation of a solid matrix/analyte mixture initiated from atmospheric pressure. This method is similar to MALDI in that a laser and a matrix are used, but does not require stringent absorption of the matrix at the laser wavelength. Ionization is initiated in the channel rather than by photoionization by the laser and produces multiply charged ions similar to those observed with ESI but from the solid state and surfaces. Other means can be used to ablate the matrix with analyte to enter into the channel, but a laser provides a high spatial resolution means of measurements. The laser-free version is referred to as matrix assisted ionization inlet (MAID. Common to MALDI and LSII is that location(s) of certain molecules can be imaged by their m/z from surfaces such as drugs from mouse brain tissue, as an example. When using a solid matrix, ionization is initiated in a heated channel depending on the small molecule matrix used. Using solutions, ionization is initiated in the channel upon heating the channel.

SUMMARY

An ionizing system includes a channel having an inlet disposed in a first pressure region and an outlet disposed in a second pressure region, a pressure of the first pressure region being greater than a pressure of the second pressure region. A heater is coupled to the channel and configured to heat the channel. A device is configured to introduce an analyte into the channel where the analyte is ionized.

An ionizing method includes creating a pressure differential across a channel having a first end disposed in a first pressure and a second disposed in a second pressure, heating the channel, receiving an analyte in the channel, and ionizing the analyte in the channel. The first pressure is greater than the second pressure.

A multiplex system for achieving high throughput analysis using solvent assisted ionization inlet includes an ionizing system for solvent assisted ionization inlet, an automated system for moving a sample in front of the inlet, such as a x,y-stage or a x,y,z-stage, and a software program that maps samples according to a selection criteria. The multiplex system can also include delivery tips, such as pipet tips, serially aligned in front of the inlet of a mass spectrometer. Alternatively, the multiplex system can include a tube to the inlet of the ionizing system that is serially aligned with samples in a well format.

A method of achieving high throughput analysis using solvent assisted ionization inlet includes creating a pressure differential across the inlet channel of a mass spectrometer, heating or cooling the inlet channel of the mass spectrometer, serially aligning the samples in front of an inlet of a mass spectrometer acquiring mass spectral data regarding each sample, mapping the data according to a selection criteria, and obtaining additional information about a sample mapped positively according to the selection criteria. The samples may be aligned in front of the inlet of the mass spectrometer using an automated system. The samples may enter the inlet either by allowing the pressure differential at the inlet to the channel expel the solution into the channel or physically expelling the solution into the channel.

BRIEF DESCRIPTION OF THE DRAWINGS

The patent or application file contains at least one drawing executed in color. Copies of this patent or patent application publication with color drawings will be provided by the Office upon request and payment of the necessary fee.

These and other features and advantages of the present systems and methods will be more fully disclosed by the following detailed description of the preferred embodiments, which are to be considered together with the accompanying drawings wherein like numbers refer to like parts and further wherein.

DETAILED DESCRIPTION

Figure 1:
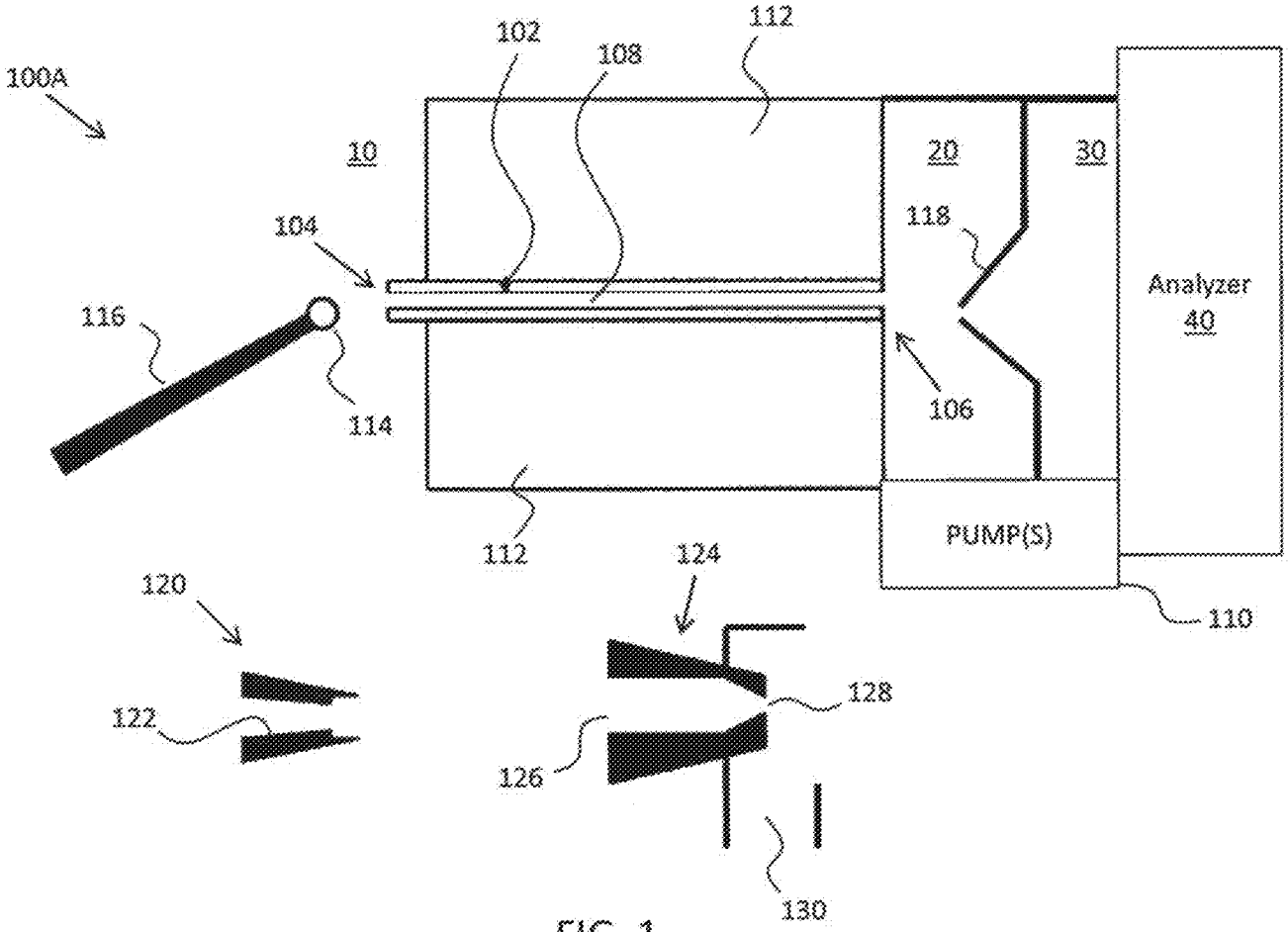
FIG. 1 is a diagram of one example of an improved ionizing system.

This description of preferred embodiments is intended to be read in connection with the accompanying drawings, which are to be considered part of the entire written description. The drawing figures are not necessarily to scale and certain features of the invention may be shown exaggerated in scale or in somewhat schematic form in the interest of clarity and conciseness. In the description, relative terms such as "horizontal," "vertical," "up," "down," "top," and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral," and the like are to be interpreted relative to one another or relative to an axis of elongation, or an axis or center of rotation, as appropriate. Terms concerning attachments, coupling, and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Unless otherwise stated, all percentages, parts, ratios, or the like are by weight. When an amount, concentration, or other value or parameter is given as either a range, preferred range, or a list of upper preferable values and lower preferable values, this is understood as specifically disclosing all ranges formed from any pair of any upper range limit or preferred value and any lower range limit or preferred value regardless of whether those ranges are explicitly disclosed.

FIG. 1 illustrates one example of an improved system 100A for matrix assisted ionization inlet for ionizing (generating positively and negatively charged ions) a matrix/analyte sample or analyte sample. The matrix may be a liquid or solid compound and the analyte may be a pure compound or a complex mixture of compounds. As shown in FIG. 1, the system 100A includes a transfer capillary 102 having an inlet 104 and an outlet 106 that communicatively couple a first pressure region 10 with a second pressure region 20 through opening 108. Transfer tube 102 may be a transfer tube of a commercially available liquid chromatography/mass spectrometry ("LC/MS"), mass spectrometer, or ion mobility spectrometer instrument and/or fabricated from various materials including, but not limited to, metals, ceramics, glass, and other conductive and non-conductive materials. Such instruments include mass spectrometers having high-mass resolving power and high-accuracy mass measurement such as Fourier Transform Ion Cyclotron Resonance ("FTICR"), Orbitrap, time-of-flight ("TOF"), and quadrupole TOF ("Q-TOF") mass analyzers. Some of these instruments are available with ion mobility separation and electron transfer dissociation, which benefit from multiple charging that improves the ability to characterize the sample.

In one embodiment, the first pressure region 10 has a higher pressure than the second pressure region 20, which may be an intermediate pressure region pumped by a rotary pump 110 and is disposed adjacent to a vacuum region 30 of an analyzer 40. Examples of analyzer 40 include, but are not limited to, quadrupole, orbitrap, time-of-flight, ion trap, and magnetic sector mass analyzers, and a ion mobility analyzer, to list a few possibilities. As will be understood by one skilled in the art, vacuum region 30 may also be pumped by one or more pump(s) 110. The gas in the first, second, and vacuum regions 10, 20, and 30 may be air, although other gases may be used to increase the sensitivity of the system. Examples of such gases include, but are not limited to, nitrogen, argon, and helium, to name a few possibilities. The gas in region 10 may be at or near atmospheric pressure with higher ion abundance correlating to a larger pressure differential between regions 10 and 20. A heating device 112 is coupled to the outer surface of the transfer capillary 102 for heating the capillary or transfer tube 102. The heating device 112 may be a resistive or electric, radiative, convective, or through other means of heating the transfer tube 102.

A matrix/analyte sample 114, which is illustrated as being disposed on a substrate 116, may be applied to the inlet 104 of transfer tube 102 or directly into capillary opening or channel 108. In some embodiments, the matrix and analyte include a sample produced by combining both in a solvent system and removing the solvent to achieve a dry matrix/analyte sample for analysis. The matrix may be in a higher concentration than that of the analyte. For example, the ratios of matrix to analyte may be between approximately 50:1 and 1,000,000,000,000:1, although one skilled in the art will understand that other matrix to analyte ratios are possible. Additionally, one skilled in the art will understand that other means in which the analyte and matrix are combined may also be implemented. For example, the matrix and analyte may be ground together using a mortar and pestle or by using vibrating beads.

In some embodiments, the matrix may be omitted such that sample 114 only includes an analyte, which is disposed on substrate 116. The matrix can be a liquid solvent such as water or a solid such as 2,5-dihydroxybenzoic acid ("2,5-DHB"). A skimmer 118 may be disposed adjacent to the exit 106 of the transfer tube 102 and between intermediate pressure region 20 and the vacuum region 30. In one embodiment, the opening of skimmer 118 is disposed such that an axis defined by transfer tube 102 does not intersect the opening of skimmer 118, i.e., the opening of skimmer 118 is "off-axis" with the exit end 106 of transfer tube 102. In some embodiments, ion, quadrupole, hexapole, or other lens element(s) may be used to guide ions from exit 106 of transfer tube 102 to the vacuum region 30 of analyzer 40. In some embodiments, skimmer 118 or lens elements may be at an angle between 70 degrees and 110 degrees, and more particularly at 90 degrees, with respect to a longitudinal axis defined by transfer tube 102.

In some embodiments, a device 120 having a conical or tapered interior region 122 is removably coupled to the inlet 104 of transfer tube 102 to present a larger entrance for matrix/analyte particles and to reduce contamination of the transfer tube 102. Device 120 may be removable so that it may be replaced or cleaned without removal of the transfer tube 102. In this way, the sensitivity is increased and the system is useful for longer periods of time before the transfer capillary 102 must be removed and cleaned. Device 120 may include an insulating material, such as ceramic or glass, and contain electrodes to remove charged matrix particles or droplets before they enter transfer tub 102 when using laser ablation of a matrix/analyte mixture. Interior region 122 of device 120 may be disposed at an angle with respect to an axis defined by channel 108 of transfer tube 102. Using device 120, transfer tube 102 remains clean for longer periods without reduction in sensitivity of the ionizing system.

In other embodiments, a jet separator device 124 having a wider initial opening 126 and a cone shaped or otherwise tapered exit 128 for directing particles toward the capillary opening 108 of transfer tube 102 is aligned with, but spaced apart from, inlet 104 of transfer tube 102. For example, device 124 may be spaced apart from inlet 104 by approximately 1 mm, although one skilled in the art will understand that device 124 may be spaced closer to, or farther away from, inlet 104. The region 130 between the exit of device 124 and the inlet 104 of transfer tube 102 may be pumped by a rotary pump 110.

Figure 2:
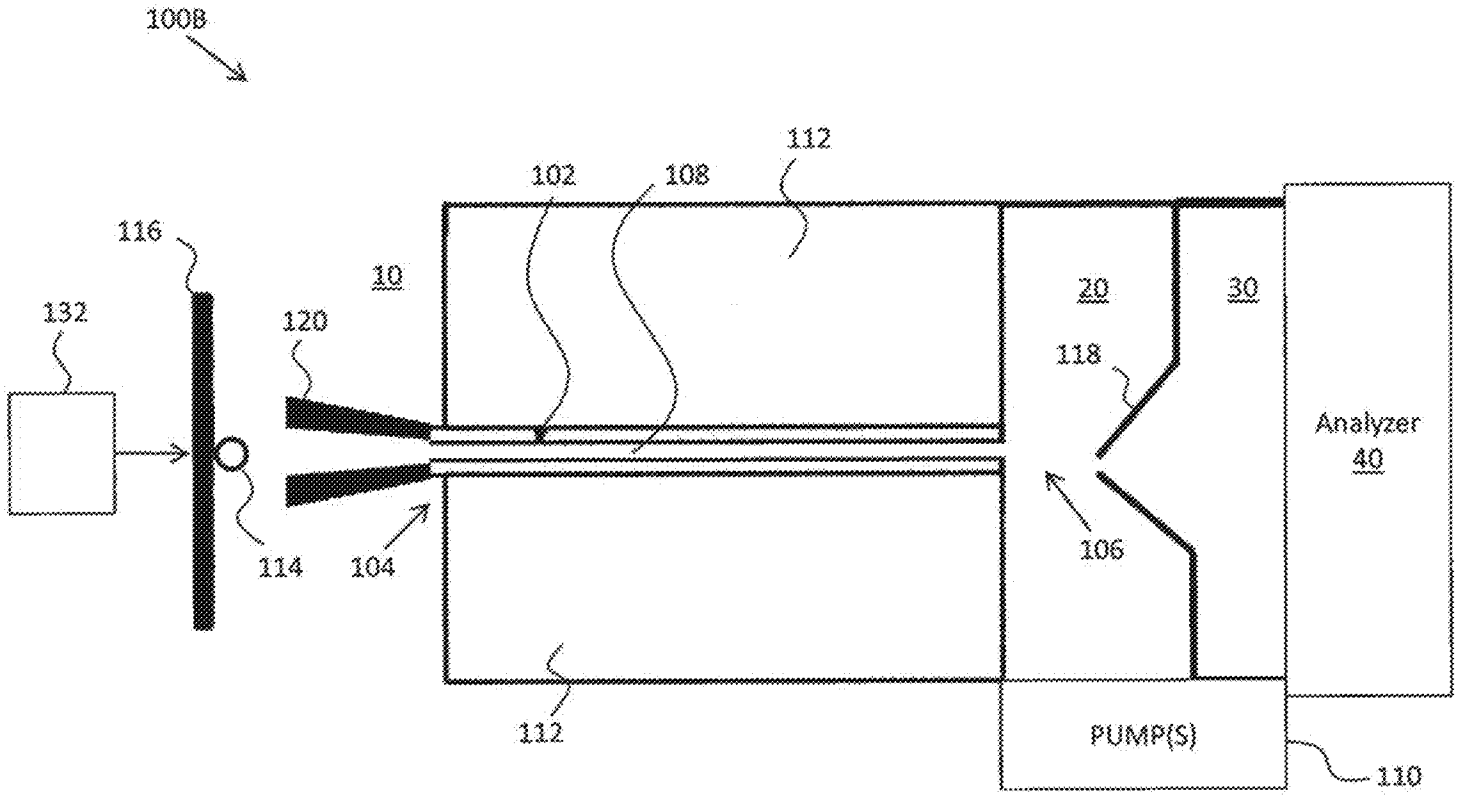
FIG. 2 is a diagram illustrating another example of an improved ionizing system.

A variety of impact methods may also be utilized to produce matrix/analyte or analyte particles that can be transferred to the transfer tube 102 for ionization (generating positively and negatively charged ions) FIG. 2 illustrates one example of a system 100B for ionizing a matrix/analyte sample or analyte 114 that utilizes an impact to introduce the matrix/analyte sample or analyte 114 into a heated capillary or transfer tube 102. As shown in FIG. 2, transfer tube 102 is surrounded by heaters 112 for ionization which occurs in the capillary channel or conduit 108. Removable cone device 120 may be disposed at the entrance 104 to the transfer tube 102. The matrix/analyte sample or analyte sample 114 is disposed on a plate or substrate 116, which is contacted by an object 132. The acoustic or shock wave from the impact of the object 132 on the substrate 116 dislodges a portion of sample 114 and propels it into the cone device 120 or towards inlet 104, which by gas dynamics (i.e., the pressure differential between the inlet 104 and outlet 106 of transfer tube 102) directs the matrix/analyte or analyte particles into the transfer tube 102 where ionization occurs.

In some embodiments, a laser (not shown) can be used to produce acoustic or shock waves that dislodge matrix/analyte 114 into fine particles as in the technique called laser induced acoustic desorption ("LIAD"). Lasers, such as, for example, ultraviolet lasers, may also be used to ablate the matrix/analyte or analyte sample 114 directly and introduce the ablated material into the transfer tube 102 as is utilized in laserspray ionization ("LSI") as will be understood by one skilled in the art. Because the laser is used to ablate the matrix/analyte sample 114, other wavelength lasers may be used including, but not limited to, visible and infrared lasers. The use of lasers allows a focused area of the matrix/analyte or analyte 114 to be ablated and is thus useful for high sensitivity and imaging studies, and in particular tissue imaging.

Figure 3:
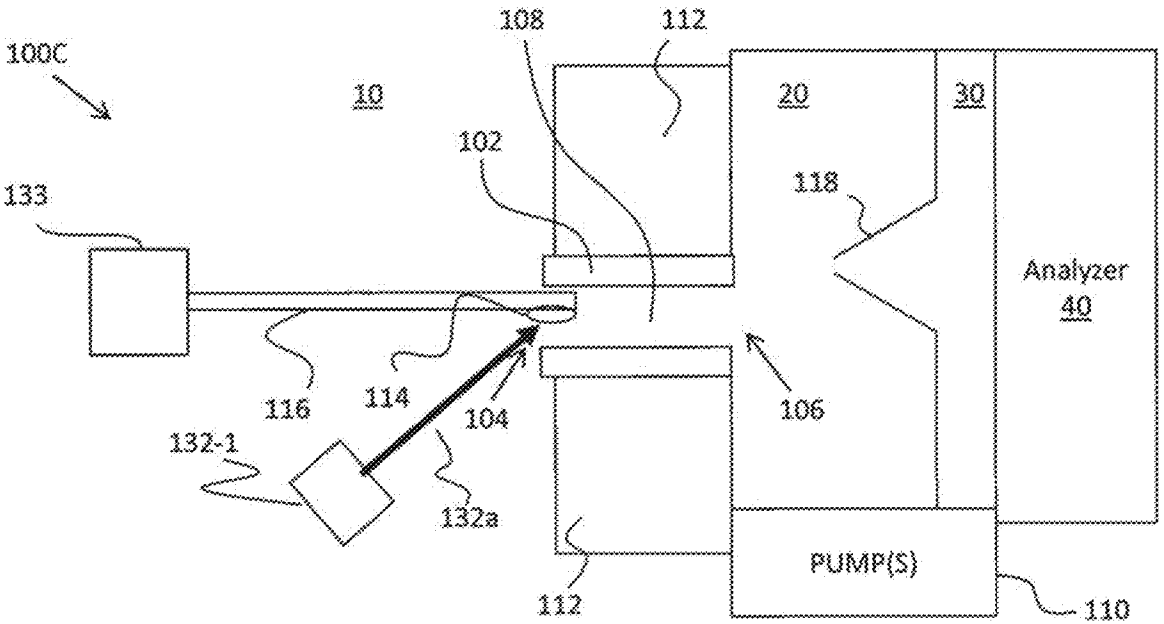
FIG. 3 illustrates another example of an improved ionizing system.

In the embodiment of the system 100 illustrated in FIG. 3, sample 114 is disposed on substrate 116 located near or within inlet 104 of channel 108. Inlet 104 may have a larger width or diameter than a width or diameter of inlet 104 illustrated in FIGS. 1-2 such that substrate 116 may be received within transfer tube 102. Sample 114 may be dislodged from substrate 116 using a laser beam 132*a* emitted from device 132, which may be a laser source as will be understood by one skilled in the art. In some embodiments, a device 133, such as a piezoelectric device, is in fluid contact with substrate 116 and is used to dislodge sample 114 from substrate 116. The use of devices 132 or 133 in the arrangement illustrated in FIG. 3 reduces sample loss via diffusion before the inlet 104 of tube 102, which enables smaller sample sizes to be analyzed with improved sensitivity.

Figure 4:
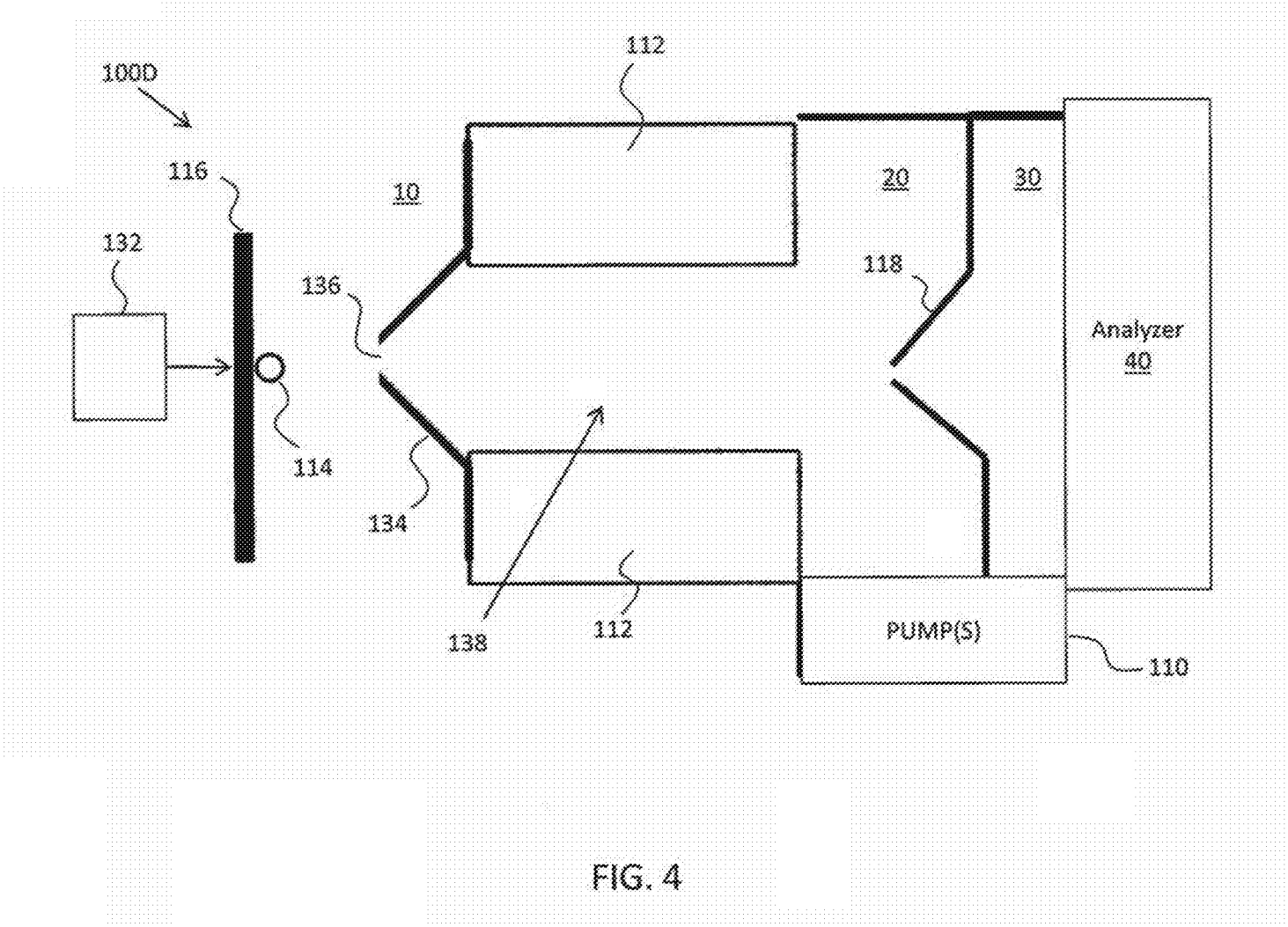
FIG. 4 illustrates another example of an improved ionizing system.

In some embodiments, such as the embodiment of system 100D illustrated in FIG. 4, transfer tube 102 may be eliminated and a skimmer 134 having an aperture 136 may be positioned in first pressure region 10 and coupled to heaters 112 such that skimmer 134 may be heated by heaters 134. Thus, in some embodiments, one or more heaters 112 define a capillary or conduit 138 between a first pressure region 10 and an intermediate pressure region 20. The impact device 132 may be a laser or other object for providing a force to produce an acoustic or shock wave to urge sample 114 from plate or substrate 116, through a space 138 defined by heaters 112, and ultimately toward vacuum region 30 in the form of ions or ionized matrix/analyte droplets or particles.

Figure 5:
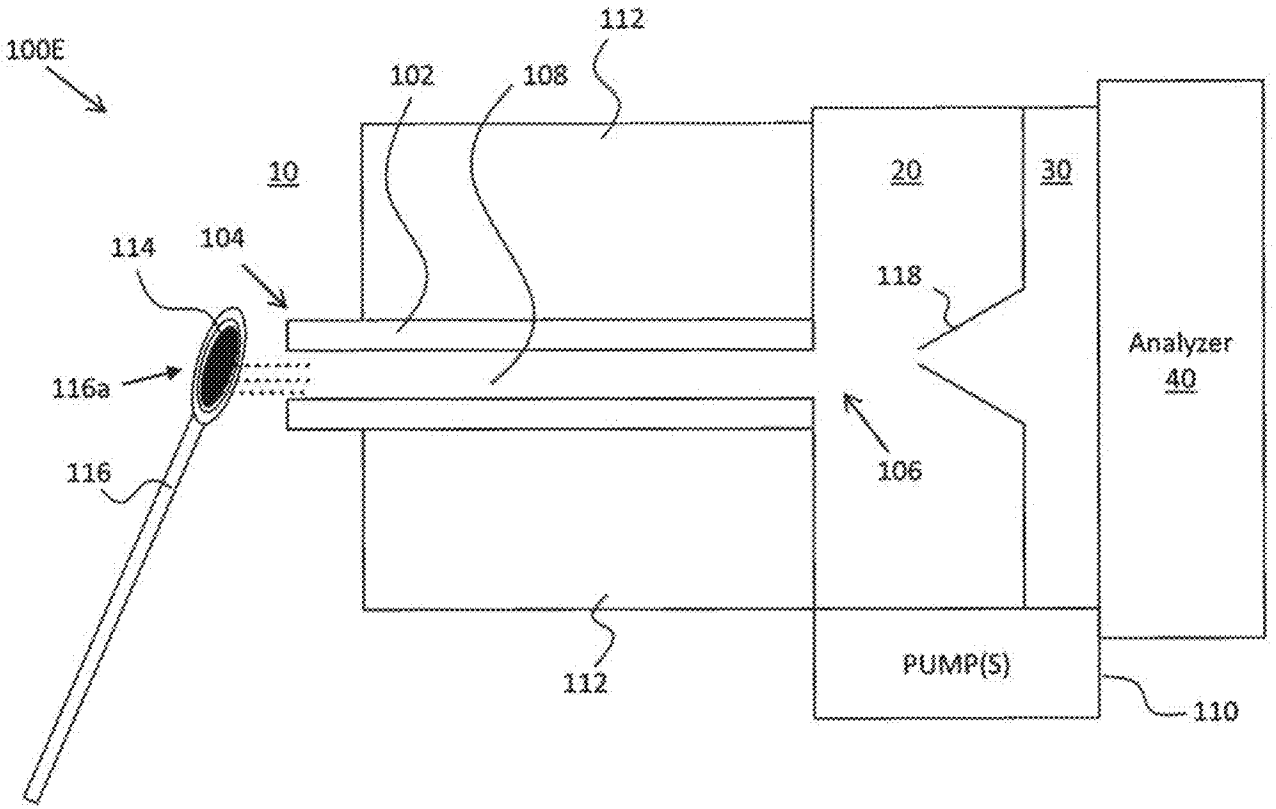
FIG. 5 illustrates another example of an improved ionizing system.

FIG. 5 illustrates an embodiment of a system 100E for solvent assisted ionization inlet ("SAII"). As shown in FIG. 5, an analyte/solvent 114 may be applied to inlet 104 of transfer capillary 102 in discreet increments by applying the analyte/solvent 114 to a substrate 116 and holding an area 116*a* of the substrate 116 on which the analyte/solvent 114 is disposed close to inlet 104. The pressure differential across transfer capillary 102 is sufficient to cause the analyte/solvent 114 to enter transfer capillary 102 in the dynamic flow of gas from the higher pressure region 10 to the lower pressure region 20. In the embodiment illustrated in FIG. 5, substrate 116 is in the form of a needle and analyte/solvent 114 is disposed within the eye 116*a* of needle 116. Other means of holding liquid solution, such as a syringe, can be used to introduce the sample to inlet 103 of transfer tube 102. Solutions containing an analyte, as in liquid chromatography ("LC") mobile phase, may be introduced using fused silica or other capillary tube as substrate 116. One skilled in the art will understand that substrate 116 may have other shapes and be fabricated from a wide array of materials including, but not limited to, glass, metal, and polymer, to name of a few possible materials. In some embodiments, transfer capillary 102 may be heated between approximately 100° C. and 500° C. with the analyte/sample 114 being introduced in increments of approximately 50 nL or more.

Analyte/solvent may include, but is not limited to, water, water/organic solvent mixtures, and pure organic solvents. Additives may be added to the analyte/solvent 114. Examples of such additives include, but are not limited to, weak acids (such as acetic or formic), bases (such as ammonium hydroxide), salts (such as ammonium acetate), and/or modifiers (such as glycerol or nitrobenzyl alcohol), to name a few possible additives. The amount of an additive in the analyte may be varied as will be understood by one skilled in the art. In some embodiments, an amount of an additive may be between 0 and 50 percent weight. In some embodiments, an additive may be between 0 and 5 percent weight such as approximately 0.1 percent weight.

Figure 6:
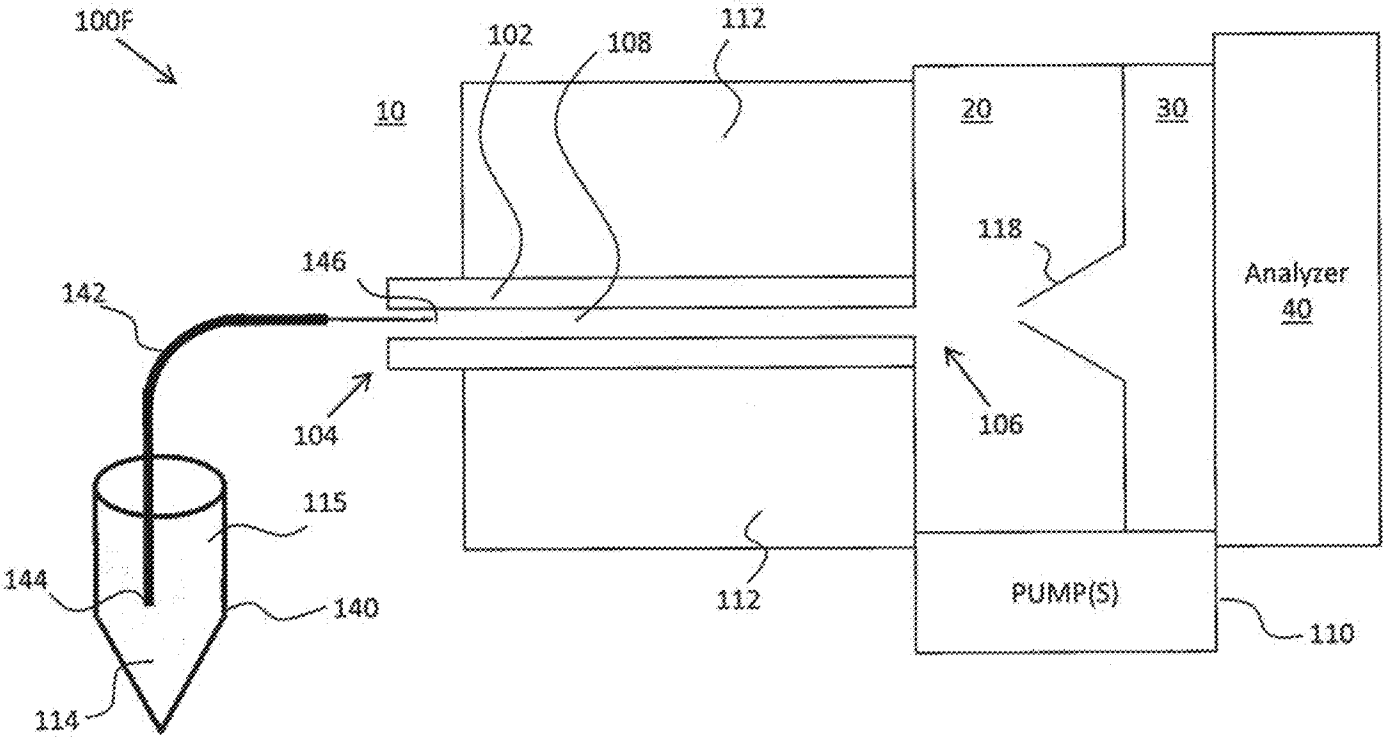
FIG. 6 illustrates another example of an improved ionization system.

FIG. 6 illustrates another embodiment of a system 100F for introducing an analyte 114 into a transfer capillary 102 through a channel such as a fused silica capillary. In the embodiment illustrated in FIG. 6, analyte/solvent 114 is continuously introduced into inlet 104 of transfer capillary 102 using a liquid chromatograph or other liquid introduction method including capillary electrophoresis, microdialysis, a liquid junction, and microfluidics or from a container 140 in which the pressure differential between the surface 115 of the analyte/solvent 114 and the exit 146 of tubing 142 causes the analyte/solvent 114 to flow into transfer tube 102 as will be understood by those skilled in the art. As shown in FIG. 6, analyte/solvent 114 is disposed within a container 140 having a column or capillary 142 extending therefrom. For example, capillary 142 may have a first end 144 disposed within analyte/solvent 114 in container 140 and a second end 146 disposed adjacent to or within inlet 104 of transfer capillary 102. Capillary 142 may be fabricated from metal, silica, or any material that is substantially resistant to temperatures of up to approximately 450° C. The analyte/solvent 114 travels through column 142 where it is introduced into transfer capillary 102.

In some embodiments, an outer diameter of column 142 is smaller than an inner diameter of inlet 104 such that column 142 may be received within transfer capillary 102 without completely restricting the flow of gas between high pressure region 10 and low pressure region 30. The depth at which column 142 is inserted into inlet 104 of transfer capillary 102 may be varied to achieve the desired results as in a tuning procedure as will be understood by those skilled in the art. For example, column 142 may be received within transfer capillary 102 by less than a few millimeters up to and beyond several centimeters. In some embodiments, column 142 contacts transfer capillary 102, although one skilled in the art will understand that column 142 may be disposed adjacent to, i.e., outside of, transfer capillary 102 in a non-contact or non-abutting relationship. In some embodiments, transfer capillary 102 may be heated between approximately 100° C. and 500° C. by heaters 112 with the analyte/sample 114 being introduced at a flow rate of approximately 100 nL or more.

Introducing analyte 114 into a transfer capillary 102 using SAII in accordance with one of the embodiments illustrated in FIGS. 5 and 6 advantageously reduces the amount of ion losses from field effects at the rim of the capillary opening 104 as well as reduces losses attributed to the dispersion of the analyte 114 being introduced into capillary 102 as occurs in ESI and SSI. The SAII technique is sensitive, allowing sub-picomolar solutions of peptides such as bradykinin to be detected, because ion losses are minimized. Additionally, the SAII technique of introducing an analyte into a transfer capillary does not require an expensive ion source, a high voltage, or lasers. Such a configuration is advantageous for field portable ion mobility and mass spectrometer instruments.

Figure 7:
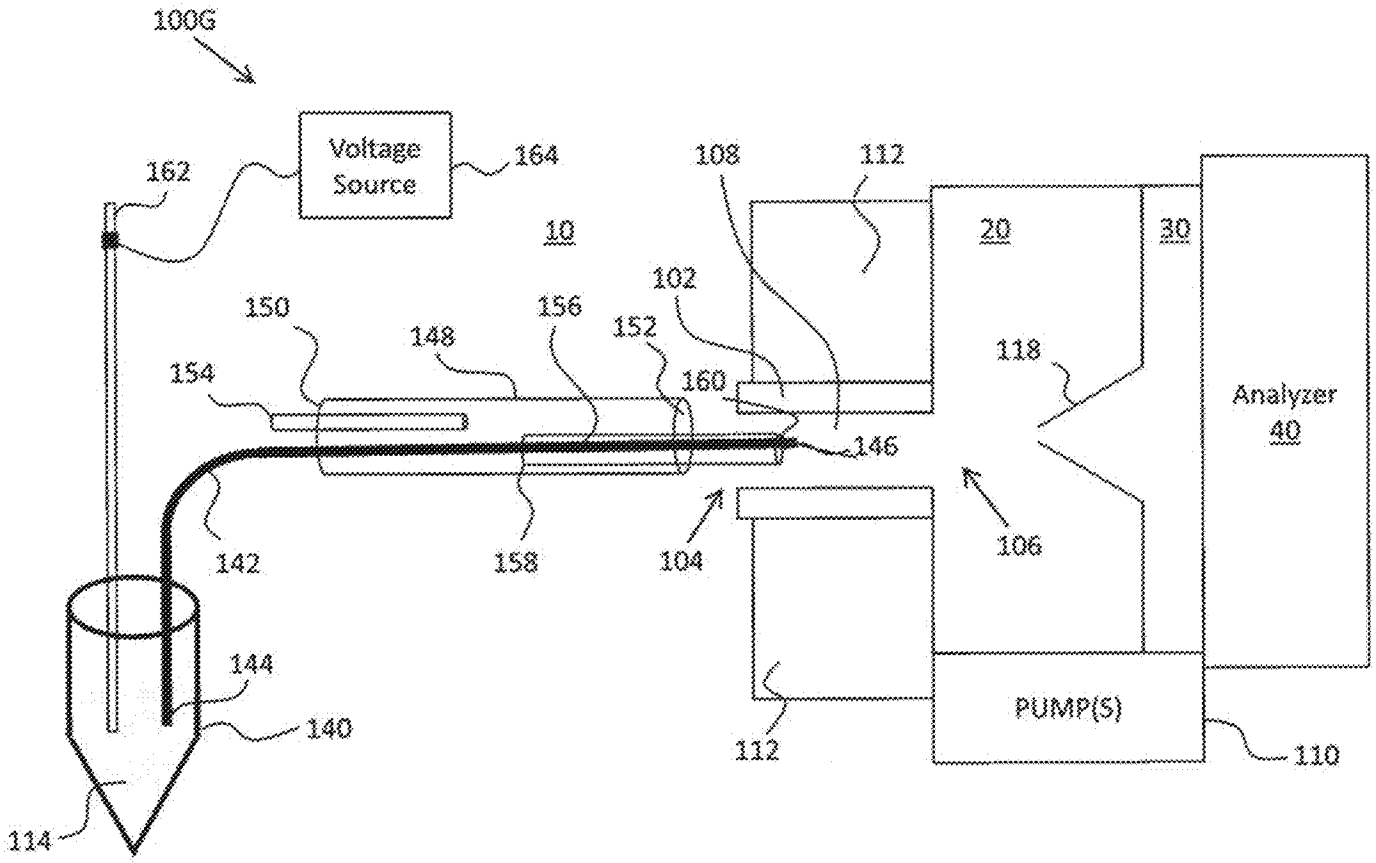
FIG. 7 illustrates another example of an improved ionization system.

FIG. 7 illustrates an embodiment of a system 100G in which a voltage is applied to analyte/solvent 114 to increase the number of ions produced. Although an electrode 162 and voltage source 164 are illustrated, these components may be omitted as described below. As shown in FIG. 7, analyte/solvent 114 is disposed in a container 140, which may be a liquid chromatograph as will be understood by one skilled in the art. A column or capillary 142 has a first end 144 disposed within the analyte/solvent 114 within container 140 and a second end 146 disposed within channel 108 of transfer tube 102. Mixing tube 148 has a pair of opposed sealed ends 150, 152. End 150 of mixing tube 148 receives capillary 142 and a nebulizing tube 154 therein.

Nebulizing tube 154 may be configured to inject a nebulized gas from a nebulizing source (not shown) into mixing tube 148. End 152 of mixing tube 148 receives an transfer tube 156 therethrough. Transfer tube 156 has a first end 158 disposed within mixing tube 148 such that end 158 is disposed adjacent to end 146 of capillary 142 and the nebulizing gas from tube 154 enters end 158. Transfer tube 156 may fit over or be concentric with capillary 142. The second end 160 of transfer tube 156 may be disposed within or a few millimeters from end 146 of transfer capillary 102 as shown in FIG. 7. One skilled in the art will understand that other means of nebulizing solvent streams are available.

An electrode 162 is disposed within analyte/solvent 114 and is coupled to a voltage source 164. Voltage source 164 may be configured to provide a voltage to analyte/solvent 114 between approximately 500 volts and 5,000 volts. In some embodiments, voltage source 164 may be configured to provide a voltage between approximately 700 volts and 3,000 volts. One skilled in the art will understand that voltage source 164 may be able to provide other voltages to analyte/solvent 114.

Electrically enhancing the ionization of liquid droplets within the inlet 104 of transfer tube 102 as shown in FIG. 7 reduces and/or eliminates dispersion and so call "rim" losses associated with the ESI in which the electrospray occurs before the entrance to the inlet transfer tube 106. The combination of field-enhanced ionization SAII in this configuration provides efficient ionization.

Nebulizing gas in the absence of a voltage can be used to direct solvent droplets into the inlet capillary for SAII, and with a high flow of nebulizing gas, ionization occurs through a low solvent flow sonic spray mechanism in combination with SAII. The solvent can be introduced into transfer tube 102 along with a nebulizing gas as shown in FIG. 7. Methods of forming ions within the transfer capillary 102 are advantageous as they eliminate losses associated with the entrance orifice and dispersion losses outside the entrance orifice of transfer tube 102. Ionization within the transfer capillary 102 occurs under sub-atmospheric pressure conditions thereby enhancing ion transfer efficiency into the analyzer 40. Under these conditions, so-called "ion funnels," as will be understood by one skilled in the art, may be used as an efficient means of transferring ions from exit 106 to analyzer 40.

SAII may be used with LC with flow rates greater than about 100 nanoliters per minute ("nanoflow") up to approximately one milliliter per minute. Low solvent flow SAII, as in nanoflow, is possible and does not require a voltage or special exit tips as required in nanoflow ESI; however, a voltage and specialized exit tips may be used to enhance ionization or produce a stable ion current.

Nanoflow SAII may be used with or without a nebulizing gas 154 as illustrated in FIG. 7. A nebulizing gas may to aid transfer of the liquid flowing from the exit 146 of capillary tube 142 into the heated MS inlet 104. The use of concentric tubes 142 and 156 (FIG. 7) in which the inner tube 142 carries the liquid solution or LC mobile phase and the outer tube 156 a flow of gas, usually nitrogen or air, for liquid nebulization allows a wider range of mobile phase flow rates and reduces problems associated with mobile phase evaporating within the capillary tube 146. Evaporation of the mobile phase is reduced because of the cooling effect of the nebulizing gas on the inner tube 142 thereby allowing the capillary tube exit 146 to be placed either outside with the nebulized mobile phase droplets directed at the inlet 104 or inside the heated MS inlet orifice 104. Because ionization of volatile compounds in the room air will occur when liquid is being ionized within the inlet 108, there are low-mass contaminant ions from compounds in the air that can be reduced or eliminated by the use of a clean nebulizing or curtain gas 154 which reduces room air entering the inlet.

Increasing the back pressure, which increases the flow of nebulizing gas 154 that passes through transfer tube 156 and nebulization of mobile phase 114 at end 146 of capillary tube 142, produces ions by a sonic spray ionization ("SSI") with solvent flow rates of approximately 100 nanoliters per minute ("nanoSSI") and above. Thus, flow solvent flow rates of 100 nanoliters per minute to 10 microliters per minute produce ions by nanoSSI. End 146 of capillary 142 during nanoSSI may be on the atmospheric pressure side of inlet 104 or inserted through inlet 104 into channel 108. In either case, ionization of droplets entering the heated transfer tube 102 will be ionized by SAII. NanoSSI is an alternative method for high sensitivity nano- and micro-flow liquid chromatography and advantageously does not require the use of a voltage.

Because in LC, samples containing high levels of non-volatile hydrophilic compounds such as salts are frequently analyzed, it has been a common practice to divert the mobile phase during the early part of a reverse phase chromatography separation (void volume) so that these materials dissolved in the mobile phase do not enter and contaminate the ion source. However, diverting mobile phase is difficult in nanoflow ESI LC because increased dead volume caused by the diverter valve results in peak broadening. The SAII method, especially nanoSAII, is sufficiently robust that diversion of the early elution volume containing salts is as simple as moving the exit end of the LC capillary tube away from the entrance using a x,y or x,y,z stage during the time the void volume is eluting. At a user selected time, the exit end of the capillary can be placed back where ionization occurs using the x,y- or x,y,z-stage.

Another method to divert the flow from the LC away from the inlet 104 during elution of salts in the void volume that is applicable to nanoSAII is to use a solenoid to push the fused silica capillary tubing 146 away from inlet 104. Under these conditions, exit end 146 of capillary 142 is positioned outside of inlet 104. Using these methods, nanoSAII results in minimal contamination of the inlet and vacuum optics of the mass analyzer and can be run for extended periods without loss of sensitivity.

Figure 8:
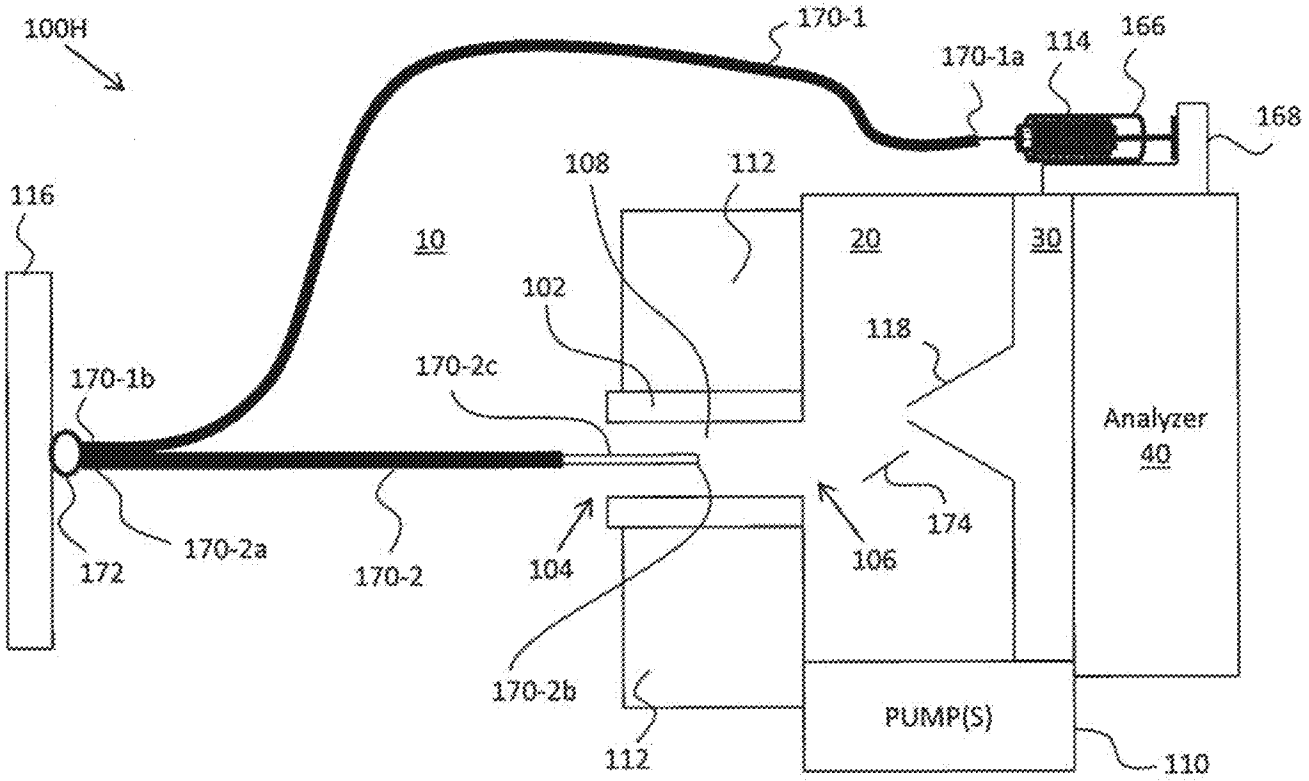
FIG. 8 illustrates another example of an improved ionization system.

FIG. 8 illustrates another embodiment of a system 100H for introducing an analyte 114 into transfer tube 102 using SAII. As shown in FIG. 8, a syringe 166 and syringe pump 168 are used to inject solvent 114 into a first tube 170-1, which may be a fused silica tubing having a polyamide coating. Examples of the solvent include, but are not limited to, water, water organic solvent mixtures, or pure organic solvents such as acetonitrile or methanol. In some embodiments, other pumping devices, such as a liquid chromatograph pump, may be substituted for the assembly of the syringe 166 and syringe pump 168.

A pressure differential is formed between a first end 170-2*a* of the second tube 170-2 and a second end 170-2*b*, which is disposed adjacent to or within channel 108 of transfer tube 102. Syringe pump 168 is configured such that solvent 114 flows into tube 170-1 at the same rate at which solvent 114 flows through capillary 170-2 due to the pressure differential between ends 170-2*a* and 170-2*b*. Solvent 114 flows through tube 170-1 and forms a liquid junction droplet 172 between ends 170-1*b* and 170-2*a*. A portion 170-2*c* of second tube 170-2 may have the polyimide coating removed to prevent ionization of gasses vaporizing from the polyimide when disposed in the heated inlet tube 102. The analyte on substrate 116 dissolves in liquid junction 172 and is received in tube 170-2 such that the entire surface of substrate 116 may be analyzed as an image by restoring the surface across the liquid junction.

Analyte can be introduced into the liquid junction droplet 172 and ionized when the solvent/analyte 114 enters the heated transfer tube 102. Besides direct introduction of analyte from a surface 116 as shown in FIG. 8, analyte can be introduced to liquid junction 172 for analysis by mass spectrometry or ion mobility spectrometry by such means as laser ablation as illustrated in FIG. 9.

Figure 9:
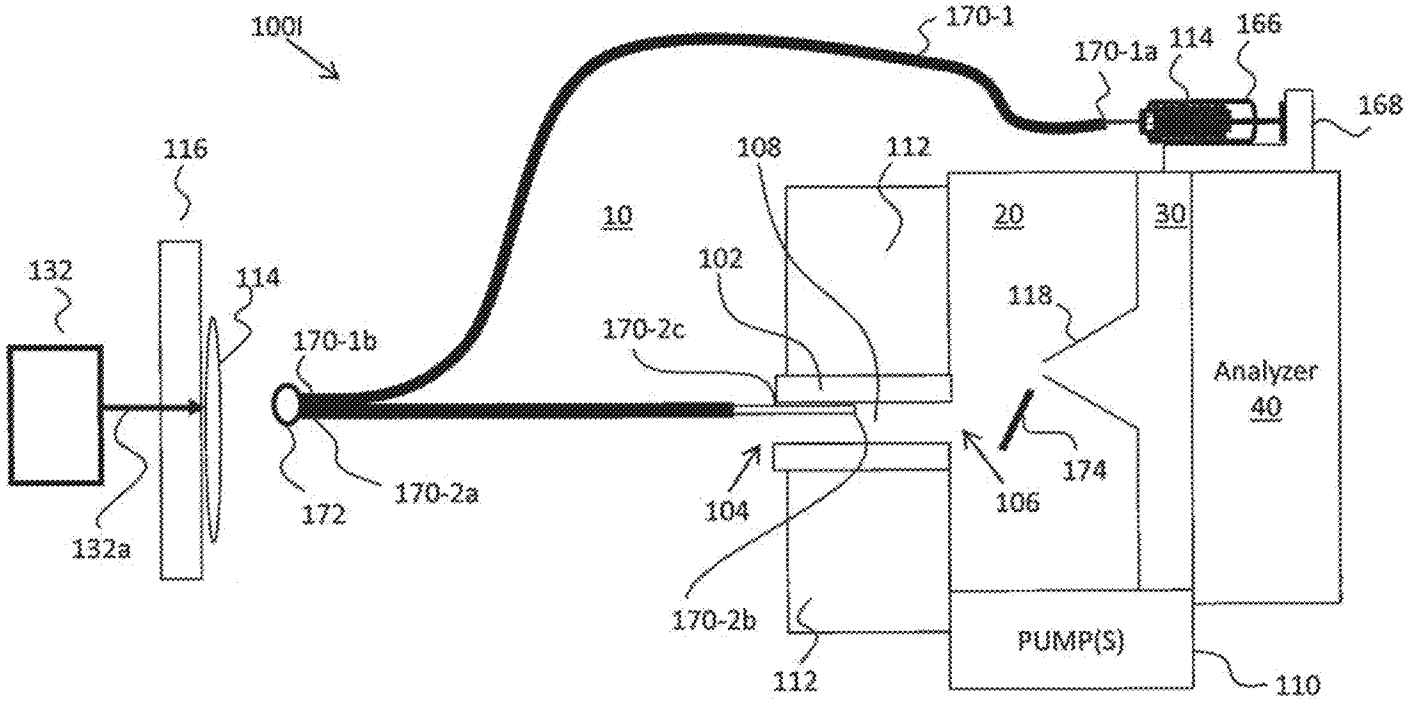
FIG. 9 illustrates another example of an improved ionization system.

As shown in FIG. 9, the system 100I includes a laser 132 that emits a laser beam 132*a* through substrate 116, which may be a transparent sample holder such as a glass microscope slide, and into sample 114 mounted on substrate 116. The laser beam 132*a* ablates a portion of the sample in transmission geometry and the forward motion of the ablated sample carries it into the liquid junction droplet 172 where it dissolves in the solvent and is swept into the inlet channel 108 for ionization. The distance between the sample 114 and the liquid junction 172 is between 0.1 and 100 mm and more preferably between 1.0 mm and 10 mm. The sample 114 may be a tissue slice and may be mounted on plate 116 which is movable by controlled x,y,z-stages (not shown) in order to image the surface as will be understood by one skilled in the art. Laser beam 132*a* may also strike sample 114 in reflective geometry in which laser beam 132*a* does not pass through substrate 116 and thus substrate 116 may be opaque to laser beam 132*a*.

Analyte 114 may be introduced to the liquid junction 172 using other methods such as, for example, using a capillary inserted into a living rat brain in which analyte enters the flowing solvent within the capillary through osmotic flow as in microdialysis. The microdialysis solution flows directly into the liquid junction solvent droplet. Liquid junction 172 is a means for rapidly introducing the sample for ionization and analysis by mass spectrometry or ion mobility spectrometry.

An obstruction 174 may be disposed along an axis defined by inlet channel 108 of tube 102. In some embodiments, obstruction 174 is formed from metal, but one skilled in the art will understand that obstruction 174 may be formed from other materials including, but not limited to, glasses and ceramics. As shown in FIG. 9, obstruction 174 is disposed adjacent to exit 106 and is configured to increase the abundance of analyte ions observed using LSI, MAII, and SAII by intercepting any charged droplets adjacent to the entrance of skimmer 118. Obstruction 174 may also aid in the removal of some or all solvent or matrix that is received through inlet tube 102 during collision with obstruction 174 thereby increasing the analyte ions observed by the analyzer 40. An obstruction can be used in any of the ionization arrangements illustrated in FIGS. 1-10.

Figure 10:
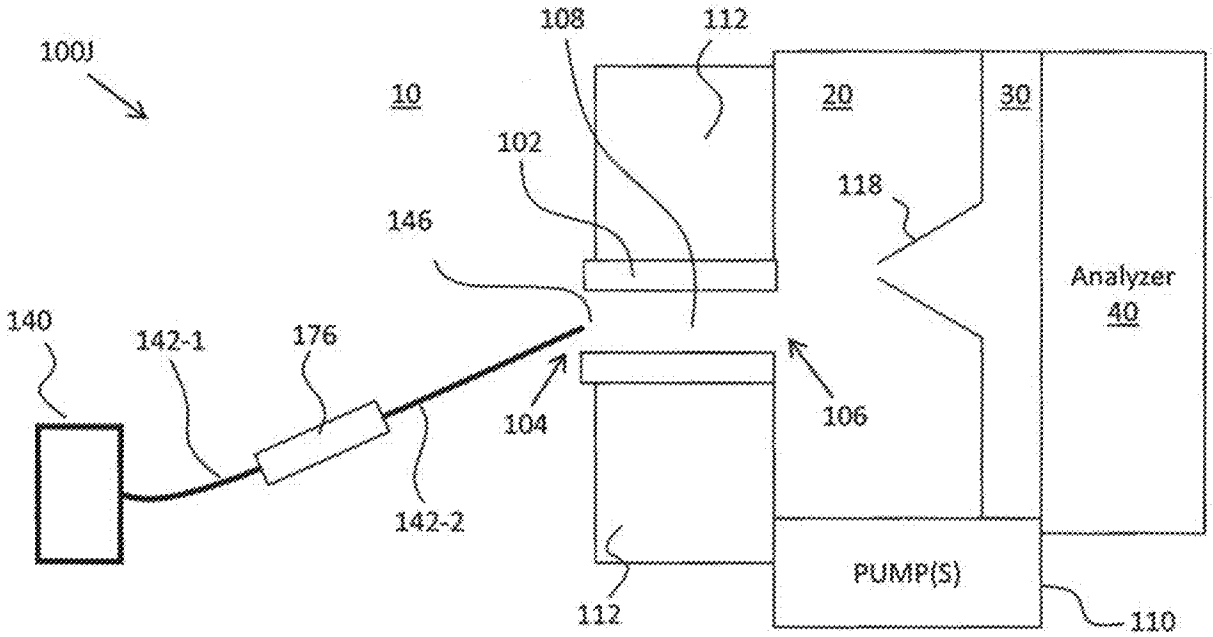
FIG. 10 illustrates another example of an improved ionization system.

FIG. 10 illustrates another embodiment of an ionization system 100J that is capable of nanoliter and microliter per minute liquid flow rates. As shown in FIG. 10, an analyte 114 is disposed within a container 140, such as a liquid chromatograph, and is in fluid contact with an LC column 176 coupled to tubing 142-1 and 142-2 (collectively referred to as "tubing"). Mobile phase of solvent 114 flows through tubing 142-1 into the LC column 176 and through tubing 142-2 where it exits at end 146. End 146 of capillary tubing 142 is positioned near the inlet opening 104 of channel 108. The flow of gas from the higher pressure region 10 to the lower pressure region 20 nebulizes the mobile phase exiting capillary 142-2 at end 146 sweeping the nebulized droplets of mobile phase solution into channel 108 for ionization.

Capillary tubing 142-2 may be disposed at an angle with respect to an axis defined by channel 108 of inlet 102. An external gas flow (not shown) may be directed at the exit end 146 of tubing 142-2 to aid the nebulization of the mobile phase liquid exiting tubing 142-2 at end 146. Tubing 142 may be, for example, fused silica or peak tubing known to those practiced in the art. The mobile phase flow rate of analyte 114 may be greater than approximately 100 nanoliters per minute.

In operation, heating device 112 of the embodiments illustrated in FIGS. 1-10 heats the transfer tube 102 to preferably between 50° C. and 600° C., more preferably between 100° C. and 500° C., and even more preferably between 150° C. and 450° C. Matrix/analyte, solvent/analyte, or analyte sample 114 is introduced into channel 108 defined by the transfer tube 102, which results in ions being produced inside channel 108 and ions or ionized particles or droplets exiting the transfer tube 102 at exit 106. The matrix/analyte, solvent/analyte, or analyte droplets or particles travel from higher pressure to lower pressure in tubing 102. Heating the transfer tube 102 and applying a matrix/analyte or analyte sample 114 to the inlet 104, which is at a higher pressure than the outlet 106, advantageously produces singly and multiply charged ions without requiring an electric field, a high velocity gas outside of the transfer tube 102, or a laser. However, one skilled in the art will understand that the application of an electric field, a high velocity gas outside of the transfer tube 102, or a laser may be utilized to introduce the matrix/analyte or analyte sample 114 to the transfer tube 102.

The ions formed within channel 108 of transfer tube 102 may be in the form of matrix or solvent droplets or particles having a few to hundreds of charges. Evaporative loss of neutral matrix or solvent molecules within heated capillary 102 may produce bare singly or multiply charged ions of analyte observed by analyzer 40 and some portion of these charged droplets may pass through exit 106 and produce the bare singly and multiply charged analyte ions observed in analyzer 40 by collision with a surface, such as of an obstruction 174, or by sublimation of matrix or solvent enhanced by gas collisions and fields such as radiofrequency ("RF") fields used in ion optics.

It has also been discovered that varying the gas in region 10 as well as the pressure of the gas influences the observed ion abundance. Experiments in which helium operating at slightly above atmospheric pressure have produced about a ten (10) fold increase in the ion current relative to a system in which air at atmospheric pressure is the only gas in region 10. It has also been discovered that a matrix or solvent is not necessary to produce ions from certain compounds introduced into inlet 104 of transfer capillary 102. Examples of such compounds include, but are not limited to, drugs, peptides, and proteins such as myoglobin.

In some embodiments, volatile or vaporizable materials including drugs and other small molecules introduced within inlet 104 of channel 102, using, for example, a gas chromatograph, may also be ionized producing singly charged ions if a solvent is simultaneously introduced into channel 108. The solvent 114 is ionized within channel 108 forming protonated solvent molecular ions and protonated clusters of solvent which ionize the analyte in the gas phase by ion-molecule reactions in an exothermic reaction.

Experimentation for Ionization of Molecules for Mass Spectrometry and Ion Mobility Spectrometry The Orbitrap Exactive and LTQ Orbitrap Velos mass spectrometers available from Thermo Fisher Scientific of Bremen, Germany and the Synapt G2 ion mobility mass spectrometer available from Waters of Manchester, England were used in various experiments. The Synapt G2 was operated in the ESI mode with its normal skimmer and a source temperature of 150° C. for the studies that used just the skimmer that separates atmospheric region 10 and vacuum region 20 of a z-spray ion source. Glass and metal heated transfer tubes of lengths from 1 cm to 20 cm were constructed by attaching to the skimmer cone with Sauereisen cement #P 1 (Sauereisen, Pittsburgh, Pa.) and wrapping with nichrome wire that was further covered with Sauereisen cement.

The chemicals and solvents used in the experiments were obtained from Sigma Aldrich (St. Louis, Mo.) and were used without further purification. The matrix 2,5-dihydroacetophenone (2,5-DHAP) was MALDI grade but 2,5-dihydroxybenzoic acid (2,5-DHB) was 98% pure. The matrix solutions were prepared at 5 mg/mL or in the case of 2,5-DHAP as a saturated solution in 1:1 acetonitrile/water (HPLC grade). The 2,5-DHAP solution was warmed in water to increase the concentration of the solution. The matrix solution was mixed in a 1:1 ratio with the analyte solution before deposition onto the target plate using the dried droplet method. Peptides and proteins were dissolve in water with the exception that bovine insulin was first dissolved in a 1:1 methanol/water solution and then diluted in pure water.

The methods of transferring sample to the skimmer or ion transfer tube were by use of a sharp point of a sewing needle to transfer a small amount of the sample, a laboratory spatula, and a melting point tube or glass microscope slide and gently tapping the area with matrix/analyte applied against the ion entrance aperture of the mass spectrometer.

An experiment was also performed in which an aluminum plate 3/16" thickness was mounted within 3 mm of the ion entrance aperture with the sample aligned with the orifice. In one case an air rifle BB gun was used to fire metal pellets at the plate directly behind the sample. For safety a section of rubber tubing extended past the barrel and was pushed against the plate to catch the projectile and the operator wore a face shield.

Another experiment was also performed utilizing a center punch device to generate the shockwave on the substrate 116. A Lisle (Lisle Corporation, Clarinda, Iowa) automatic center punch was used to impart the shockwave in some studies by pushing the punch device against the plate opposite the sample until it automatically fired producing a shockwave.

Multiply charged ions of peptides and proteins, for example, are also produced from matrix/analyte mixtures using ultrasonic devices and laser induced acoustic desorption to transfer the sample to the ion entrance capillary 102 or skimmer entrance 118. In another experiment, various analytes were introduced into a transfer capillary 102 disposed in various gases including air, argon, helium, and nitrogen. The analytes, which include 2,5-dihydroxyacetophenone (DHAP), buspirone hydrochloride, the drug Lavaquin®, angiotensin II, and myoglobin were introduced to the transfer capillary without the presence of a matrix.

Experiments were performed in which an analyte was introduced into a transfer capillary 102 using SAII. In one experiment, the analyte/solvent was 3.44 femtomoles per microliter of insulin in water. The analyte/solvent was introduced into the transfer capillary 102 at a flow rate of approximately 10 gL/minute until 280 amol was consumed. A single 0.5 second scan was performed. A similar experiment was performed in which the analyte was introduced into the transfer capillary 102 using electrospray ionization, and the results comparing these two experiments are described below.

Other experiments using the SAII method involved the peptide bradykinin (MW 1060) dissolved in water. The limit of detection was $<1\times10^{-15}$ moles (100 zeptamoles). Introduction of vapors of triethylamine into the heated transfer capillary between the high and the low pressure regions resulted in formation of the protonated molecular ions in good abundance. Introducing a flow of pure water into the heated conduit with a flow rate greater than 100 nanoliters per minute created ions that resulted in protonation of neutral compounds introduced into the transfer capillary from a gas chromatograph with high sensitivity. Ions of lipids in tissue were produced by introducing a flow of water into the heated inlet transfer capillary and at the same time ablating mouse liver tissue slices using an infrared laser. The point of ablation was near the atmospheric pressure entrance to the transfer capillary so that ablated material entered the transfer capillary along with the water flow. A liquid junction formed at the intersection of two concentric fused silica capillaries, one with a solvent flow from an infusion pump and exit end of the other inserted into the heated inlet transfer tube, was used as a surface sampler to detect compounds on surfaces such as mouse brain tissue.

The infusion of solvent through one fused-silica tube was balanced by the flow through the second fused-silica tube by the pressure difference between the entrance end and the exit end in the transfer tube such that a liquid droplet was maintained between the exit end of one and the entrance end of the other fused-silica tubes. For example, pesticides were readily detected from the surface of fruits by touching the liquid junction droplet against the fruit surface. Imaging of surfaces, such as biological tissue, with the liquid junction is also contemplated.

A Waters NanoAcquity capillary liquid chromatograph was used to deliver mobile phase in a reverse phase gradient to CI8 columns of 1 mm and 0.1 mm inner diameter by 100 mm length running at flow rates of 55 and 0.8 microliters per minute. Injection of 1 picomole of a bovine serum albumin ("BSA") digest into the 55 gL flow or 10 femtomole of BSA into the 0.8 gL flow resulted in excellent quality separation and detection of the BSA tryptic peptides.

Figure 11:
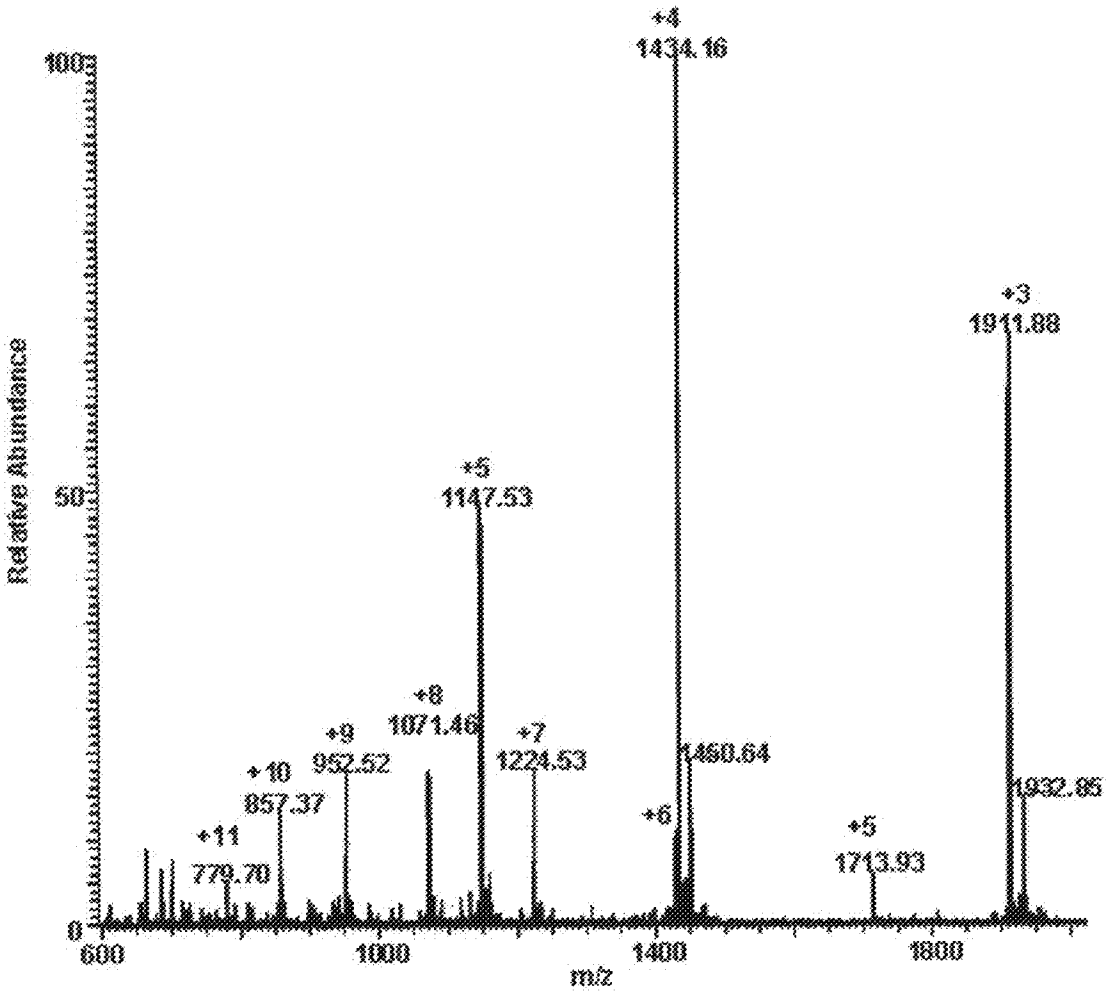
FIG. 11 is a mass spectrum of a mixture of proteins ubiquitin and insulin in 2,5-dihydroxyacetophenone as a matrix obtained by using the ionizing system illustrated in FIG. 1.

Experimental Results for Ionization of Molecules for Mass Spectrometry and Ion Mobility Spectrometry FIG. 11 illustrates the mass spectrum of a mixture of the proteins ubiquitin (having a molecular weight (MW) of 8562) and insulin (MW 5729) obtained through the system and method described above with respect to FIG. 1 using 2,5-DHAP as the matrix applied to a metal spatula as substrate 116 and the transfer capillary 102 heated to 350° C. by heater 112. About 3 picomoles of ubiquitin and 10 picomoles of insulin were in about 3 micromoles of 2,5¬DHAP matrix and the dried mixture 114 was introduced to the transfer tube 102 to produce the ions shown. The charge states +5 to +11 for ubiquitin and +3 to +5 for insulin are labeled.

Figure 12:
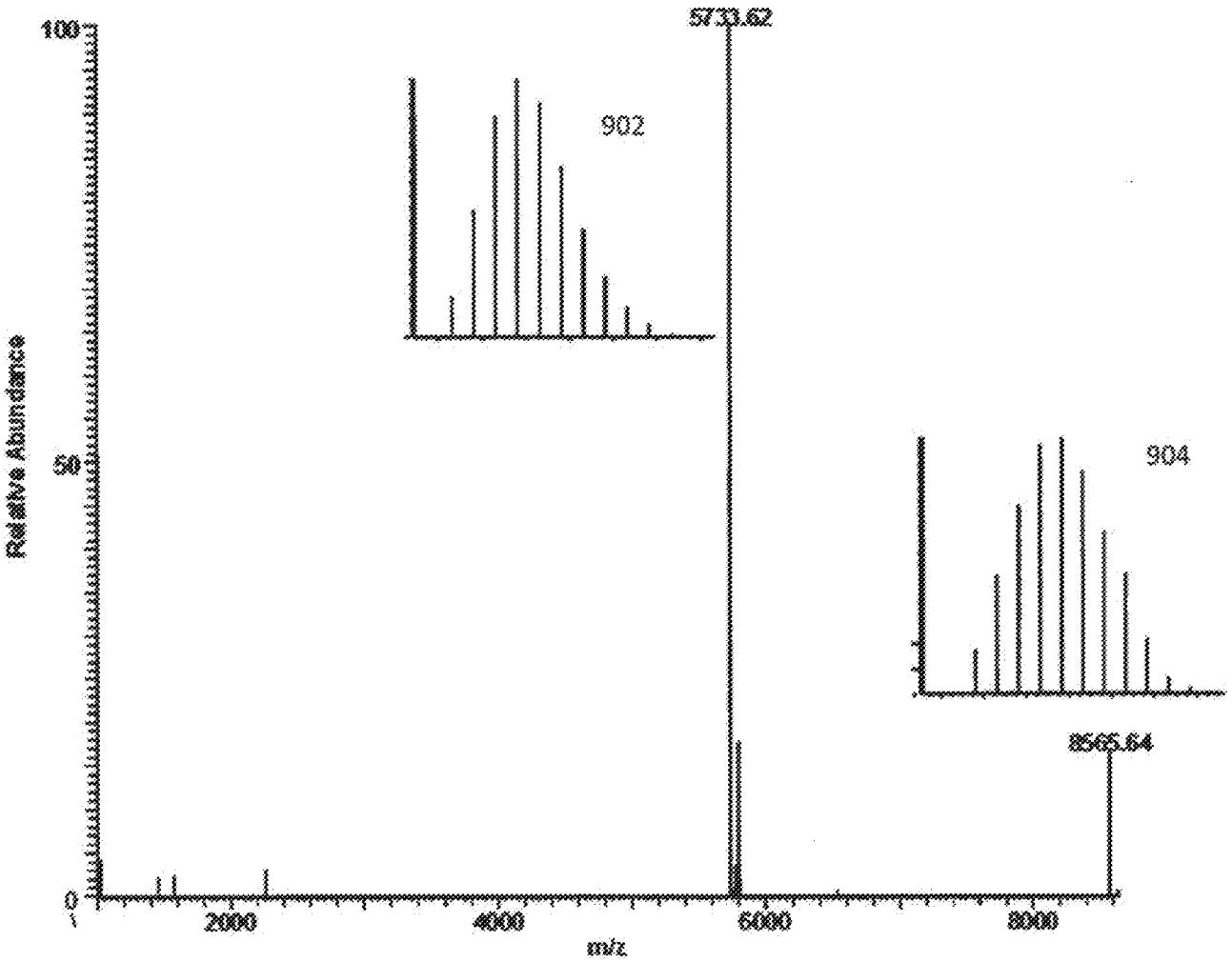
FIG. 12 is a computer deconvolution of the multiply charged spectrum illustrated in FIG. 11.

FIG. 12 is the computer deconvolution of the multiply charged spectrum in FIG. 11 providing the singly charged representation of the molecular ions generated from the multiply charged ions. Inset 902 in FIG. 12 is the isotope distribution for the insulin MH+ ion, and inset 904 in FIG. 12 is the isotopic distribution for the ubiquitin MH+ molecular ion.

Figure 13:
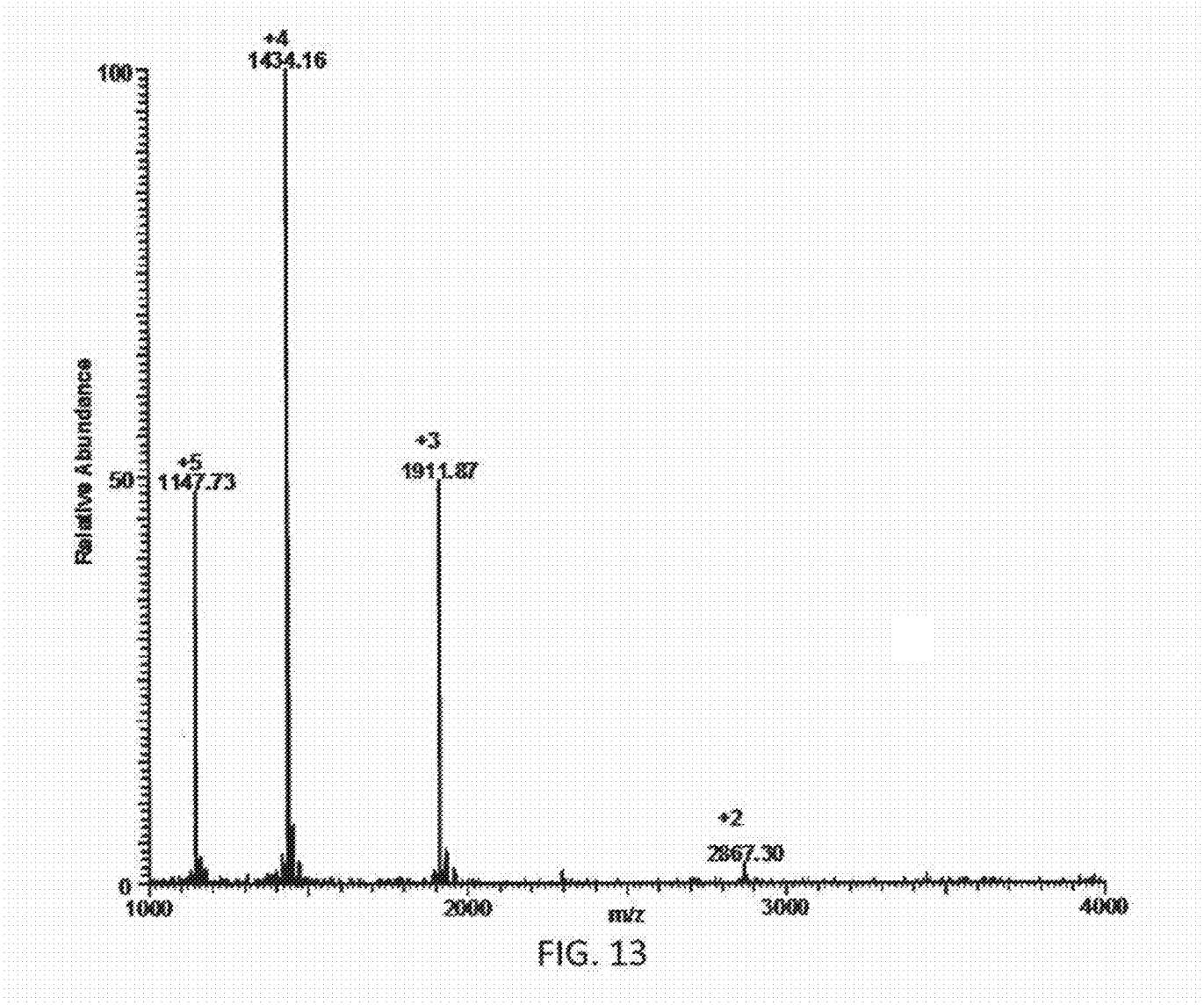
FIG. 13 is the multiply charged mass spectra obtained for insulin in the matrix 2,5-dihydroxyacetophenone in accordance with the ionizing system illustrated in FIG. 1.

FIG. 13 illustrates the multiply charged mass spectra obtained for insulin using 2,5-DHAP as matrix with a transfer tube 102 temperature of 350° C. and applying the sample to the inlet 104 of the transfer tube 102 using matrix/analyte 114 applied to a glass melting point tube as the substrate 116.

Figure 14:
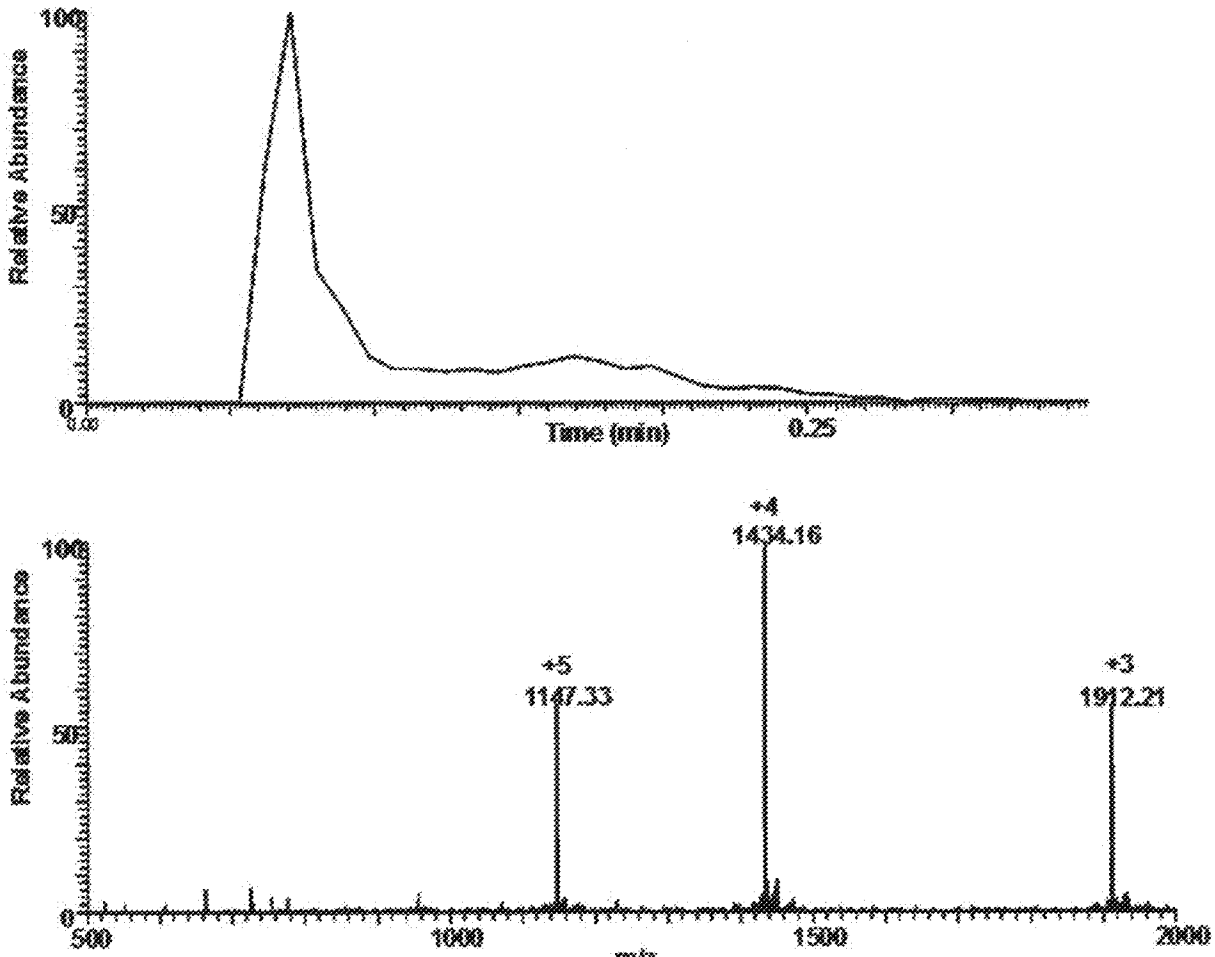
FIG. 14 illustrates the mass spectrum of insulin in the matrix 2,5-dihydroxyacetophenone obtained using the improved ionizing system illustrated in FIG. 1.

FIG. 14 illustrates the mass spectrum of insulin (bottom) in the matrix 2,5-DHAP with the transfer tube 102 temperature set for 180° C. The selected ion current chromatogram for the +4 charge state ion at m/z 1434 is plotted on top of FIG. 14. The apex of the chromatogram represents the acquisition immediately following when the sample 114 on a metal spatula 116 was touched against the entrance 104 of the transfer tube 102. At 180° C., the ion current diminished slowly. However, the apex ion current decreases with decreasing temperature.

Figure 15:
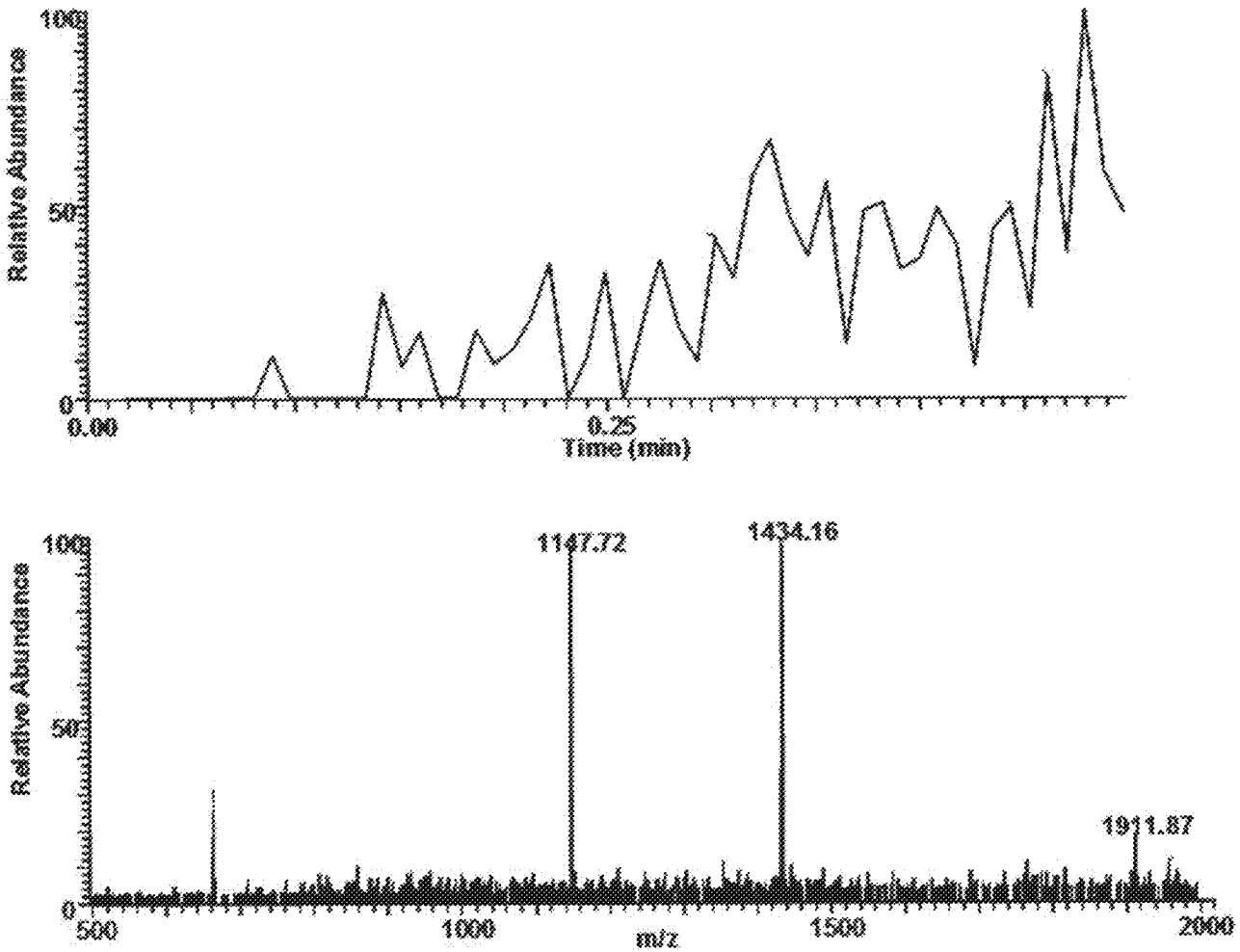
FIG. 15 illustrates the mass spectrum of insulin in the matrix 2,5-dihydroxyacetophenone obtained using the improved ionizing system illustrated in FIG. 1 when the capillary tube is heated to a different temperature.

FIG. 15 is similar to FIG. 14 except that the transfer tube 102 was heated to 150° C. by heater 112. For peptides, multiply charged ions are observed with capillary temperature as low as 40° C. with detectable abundance using the more volatile matrix 2,5-DHAP.

Figure 16:
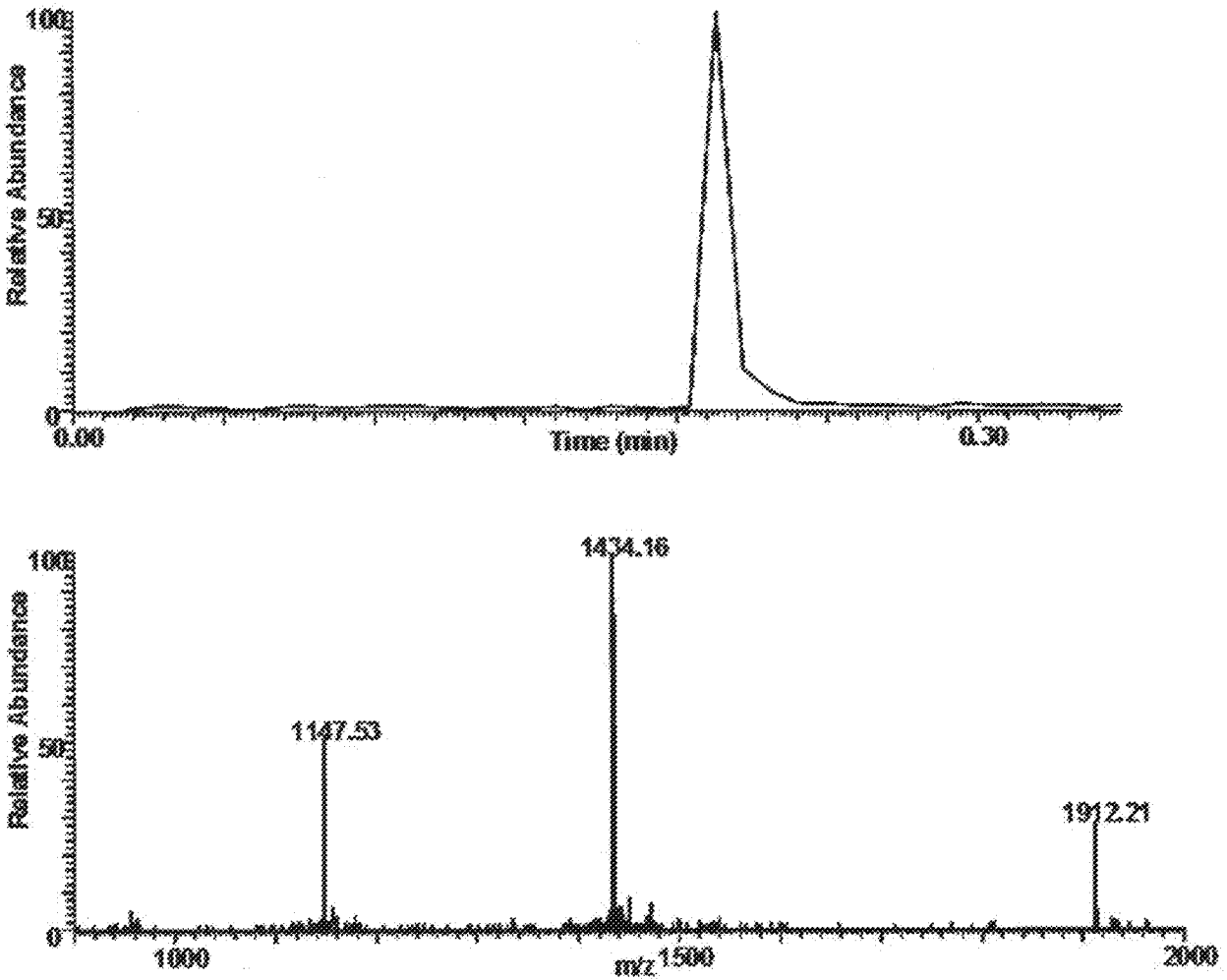
FIG. 16 illustrates the total ion current chromatogram from impact of an aluminum plate in accordance with FIG. 2 by a carpenter's center punch device to dislodge a sample of 2,5-dihydroxyacetophenone matrix with 1 picomole of insulin applied to the plate using the dried droplet method.

FIG. 16 illustrates the total ion current chromatogram from impact on an aluminum plate (e.g., substrate 116 in FIG. 2) by a carpenter's center punch device 132 to dislodge a sample of 2,5-DHAP matrix with 1 picomole of insulin applied to the plate 116 using the dried droplet method. The bottom portion of FIG. 16 illustrates the mass spectrum obtained from the single acquisition at the peak of the apex in the total ion current chromatogram (top of FIG. 16) showing the multiple charged ions of insulin.

Figure 17:
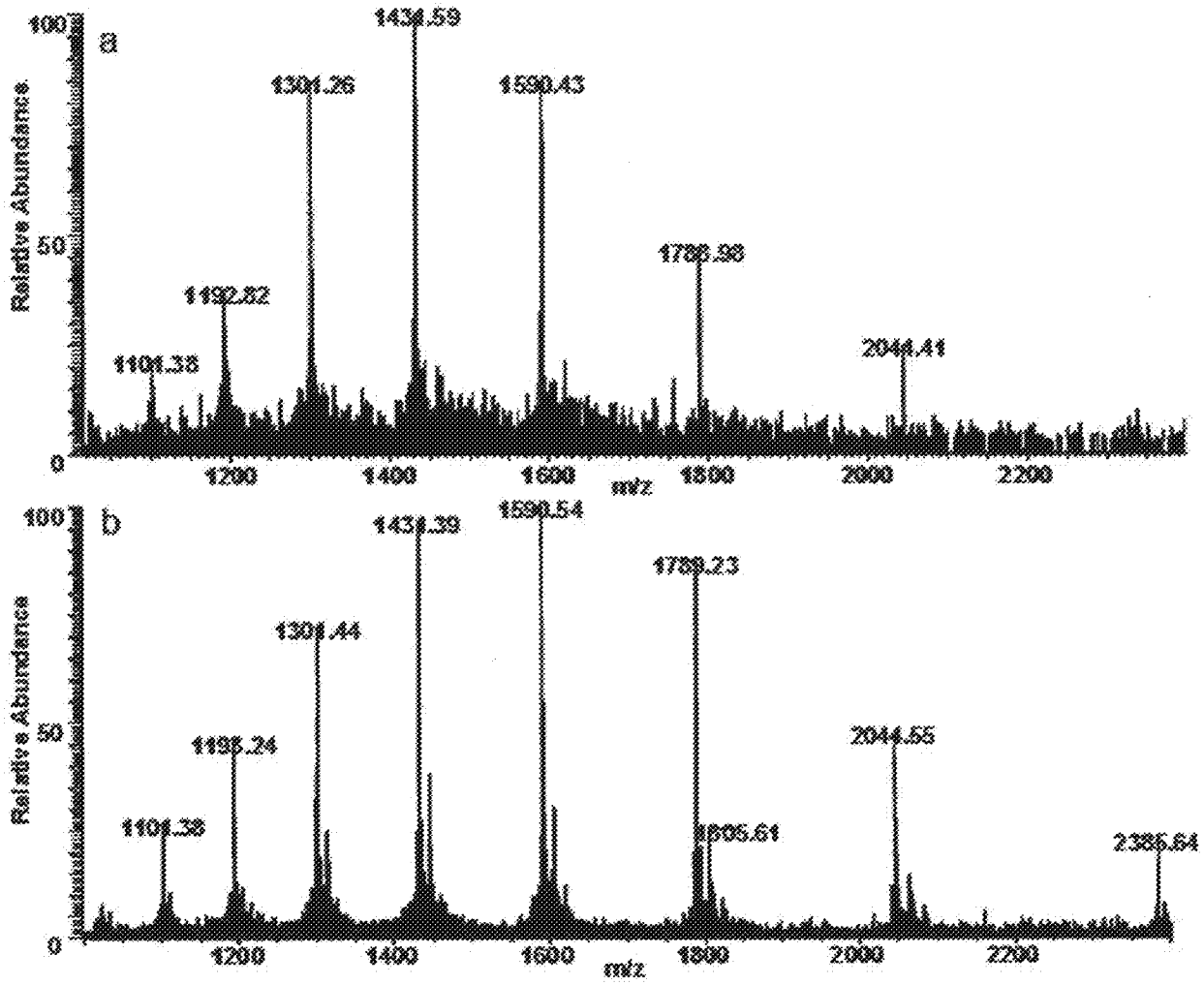
FIG. 17 illustrates the mass spectrum of lysozyme, a protein of MW>14,300, (a) obtained by the method described here using the center punch device to create a shockwave on a 3/16 inch thick aluminum plate; and (b) using laser ablation in transmission geometry for the laser beam with the plate being a glass microscope slide as in laserspray ionization.

FIG. 17 illustrates the mass spectrum of lysozyme, a protein of MW>14,300, (a) obtained by the method described here using the center punch device 132 to create a shockwave on a 3/16 inch thick plate 116; and (b) using laser ablation with the plate 132 being a glass microscope slide as in LSI. 2,5-DHAP and a transfer tube temperature of 325° C. were used to obtain both mass spectra. The ions observed are +7 to +13 for the center punch method and +6 to +13 for the laser ablation method.

Figure 18:
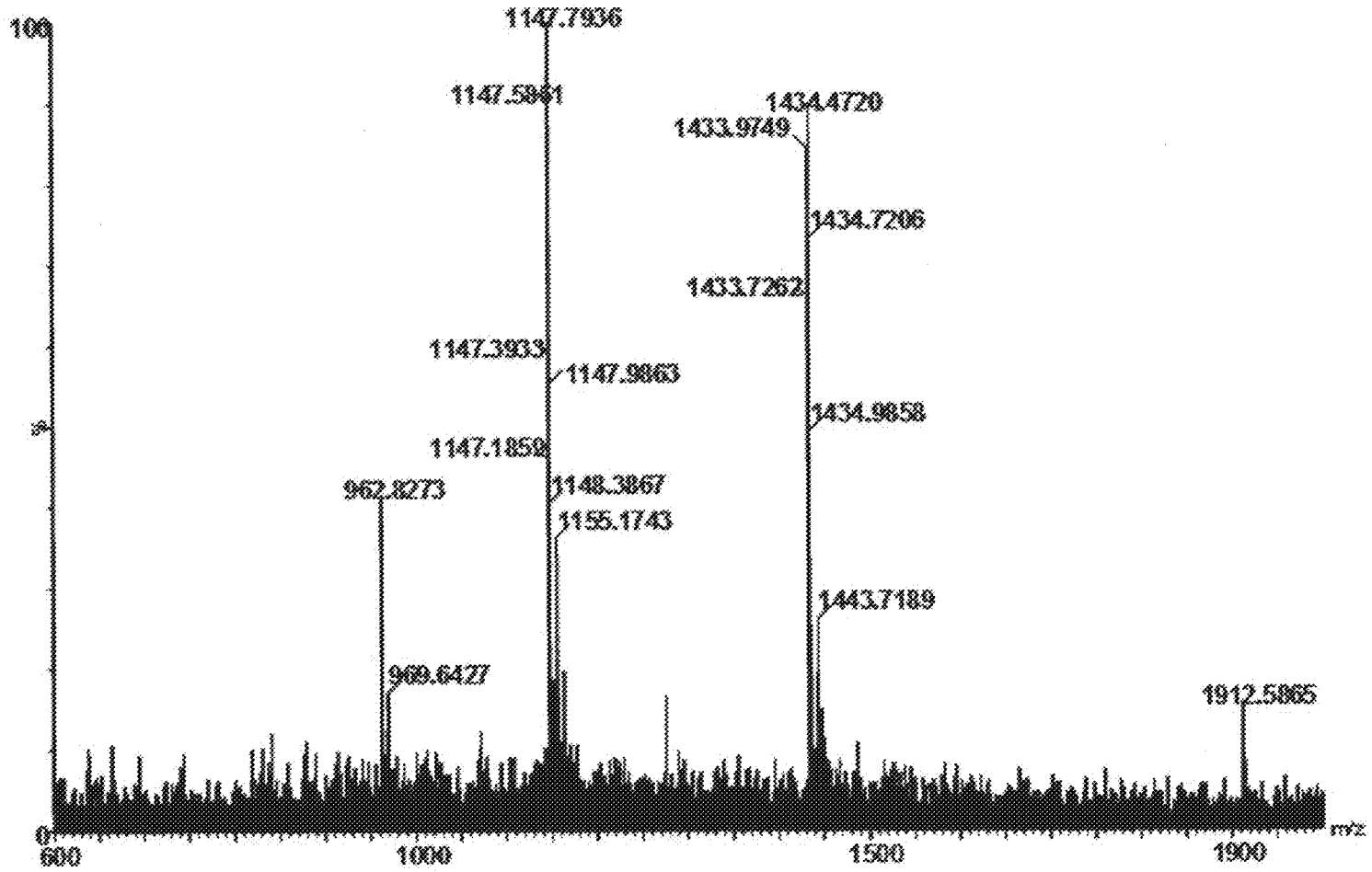
FIG. 18 illustrates the mass spectrum of the multiply charged ions of 1 picomole of insulin in 2,5-DHAP matrix in accordance with the ionizing system illustrated in FIG. 4.

FIG. 18 illustrates the mass spectrum obtained on a Waters Synapt G2 ion mobility mass spectrometer for the multiply charged ions of 1 picomole of insulin in 2,5-DHAP matrix where the transfer device is a skimmer 134 instead of a transfer tube 102 in accordance with FIG. 4. The spectrum was obtained with a skimmer temperature set to 150° C.

Figure 19:
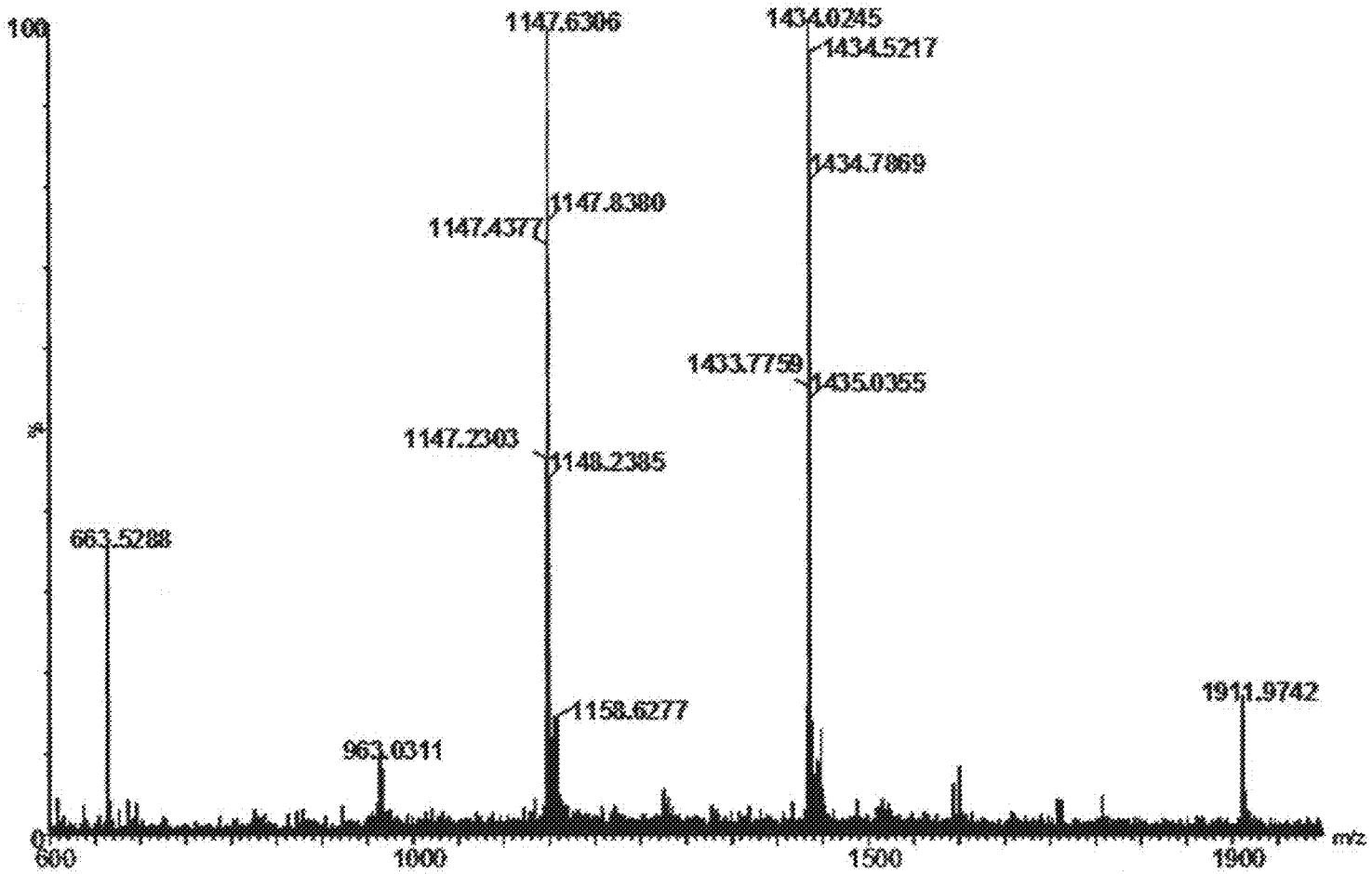
FIG. 19 illustrates the mass spectrum of 1 picomole of insulin in accordance with the ionizing system illustrated in FIG. 4 with the heater set to 150° C.

FIG. 19 illustrates the mass spectrum obtained on the Synapt G2 of 1 picomole of insulin by attaching a piece of ¾ inch long by 1/16 inch inner diameter ("ID") glass tubing to the skimmer 134 with the heater 112 set to 150° C. Changing the tubing to 4 inch copper tubing gives a similar mass spectrum (not shown).

Figure 20:
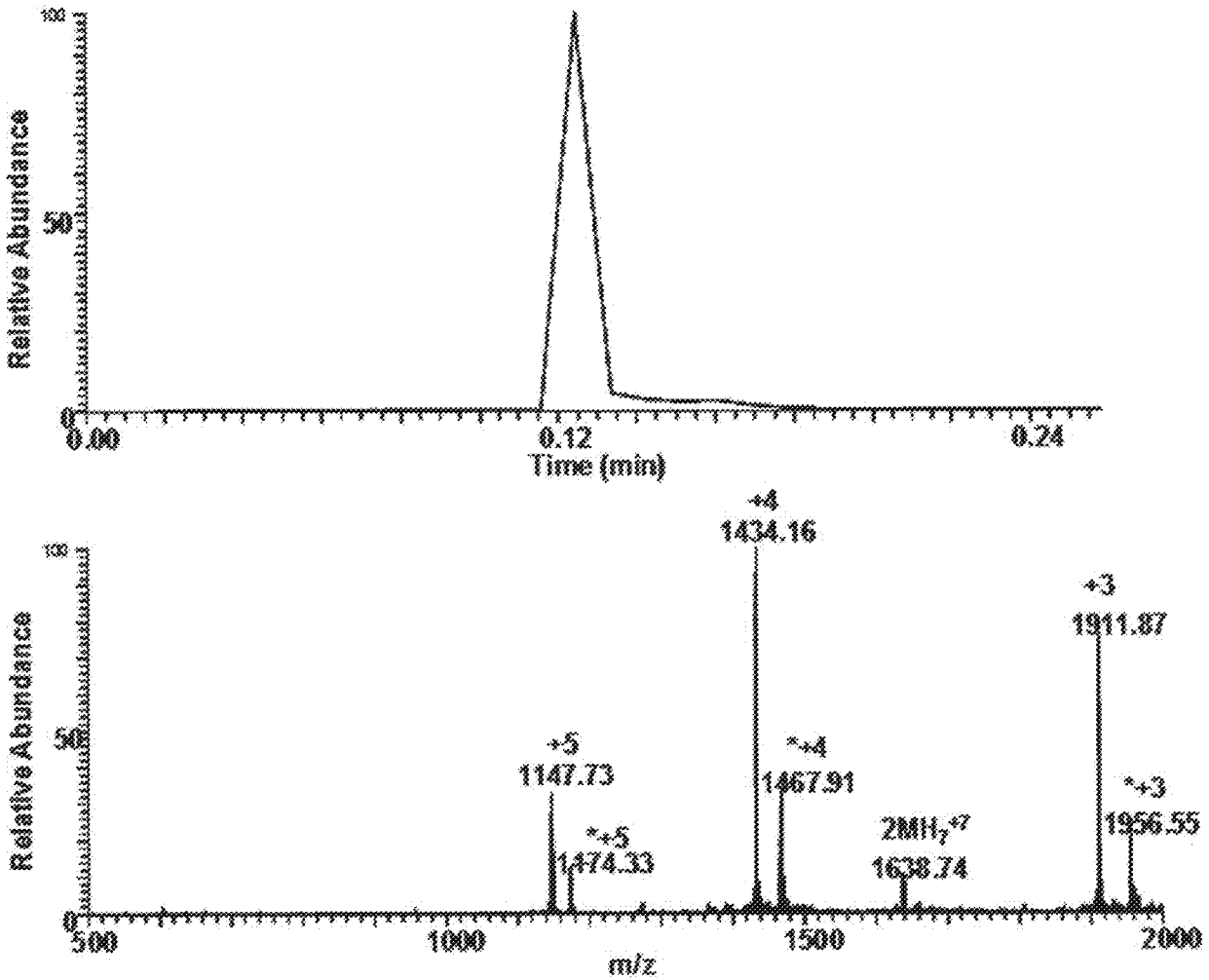
FIG. 20 illustrates the mass spectrum of insulin obtained with the ion transfer arrangement shown in FIG. 1 with an input device coupled to the entrance of the transfer tube such as the one illustrated in FIG. 2.

FIG. 20 illustrates the mass spectrum of insulin obtained on the Orbitrap Exactive with an ion transfer arrangement in accordance with the one illustrated in FIG. 2 with cone device 120 attached to entrance 104 and where an ultrasonic probe was used as substrate 116 for transferring the matrix/analyte sample 114 to the ionization region 108.

Figure 21A:
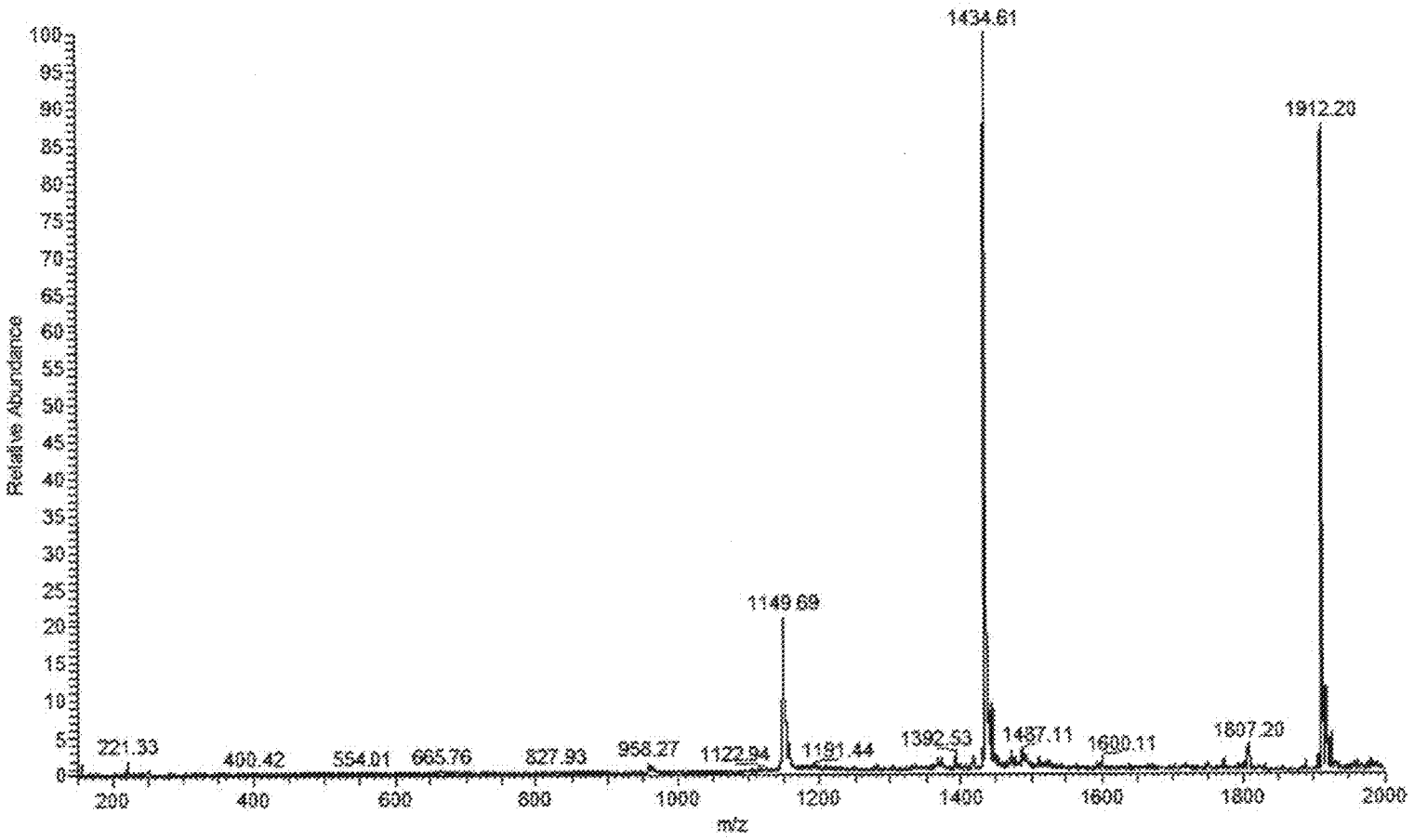
FIG. 21A illustrates the mass spectrum of insulin in the matrix 2.5-DHAP introduced to system in accordance with FIG. 1 in air at atmospheric pressure.
Figure 21B:
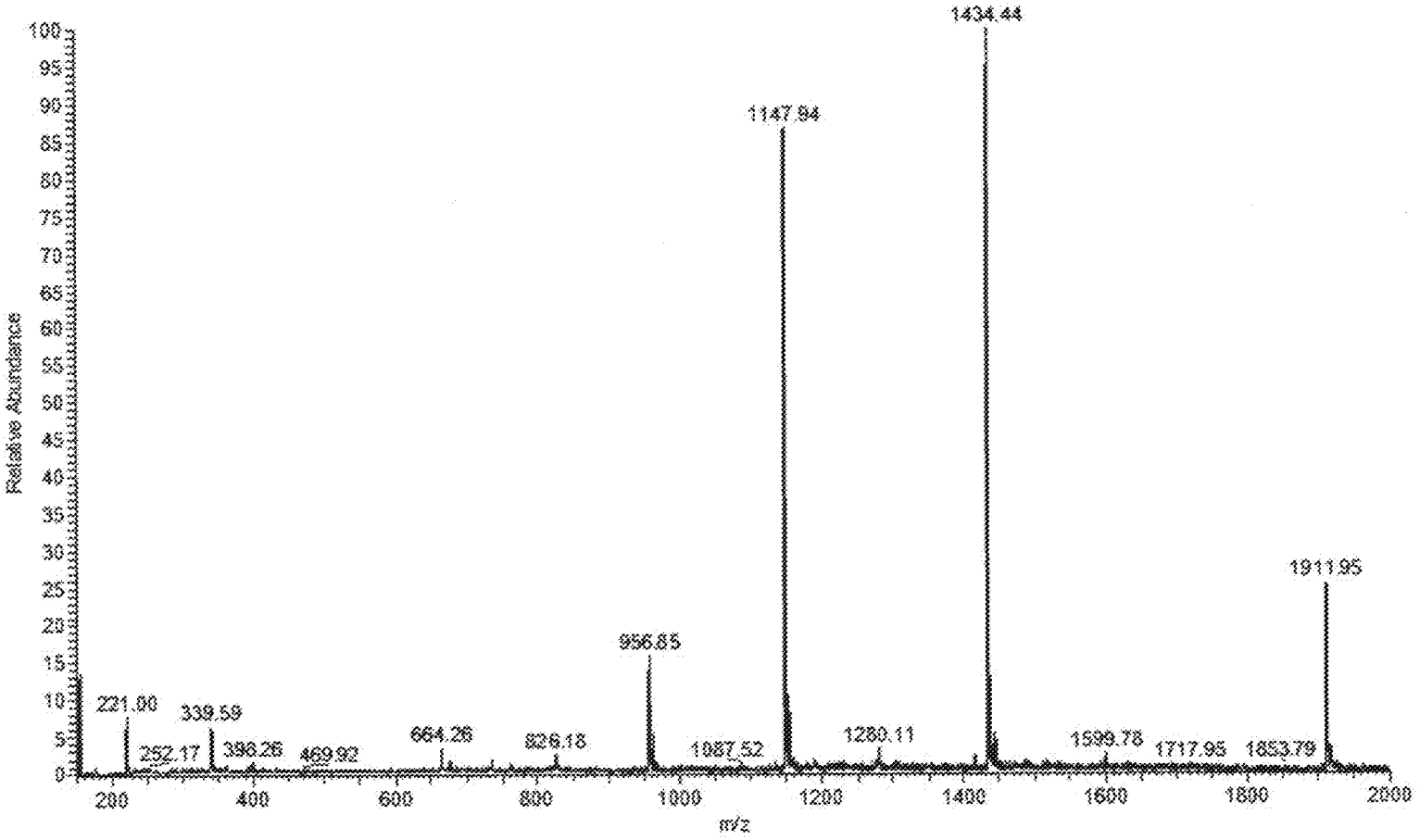
FIG. 21B illustrates the mass spectrum of the sample of insulin in matrix as in FIG. 21A introduced to a system in accordance with FIG. 1 in helium at slightly above atmospheric pressure.

FIG. 21A illustrates the mass spectrum of insulin introduced to a transfer capillary in 2,5-DHAP matrix and obtained when the mass spectrometer ion transfer inlet was disposed in air at atmospheric pressure, and FIG. 21B illustrates the mass spectrum of insulin introduced to a transfer capillary in the matrix 2,5-DHAP with the assistance of helium gas having a pressure slightly above atmospheric in region 10. The matrix/analyte sample 114 for FIGS. 21A and 21B were the same sample preparation. Comparing FIGS. 21A and 21B demonstrates that the multiply charged mass spectrum of insulin showing charge states +3 to +6 in FIG. 21B is greater than ten (10) times more ion abundant than in FIG. 21A.

Figure 22:
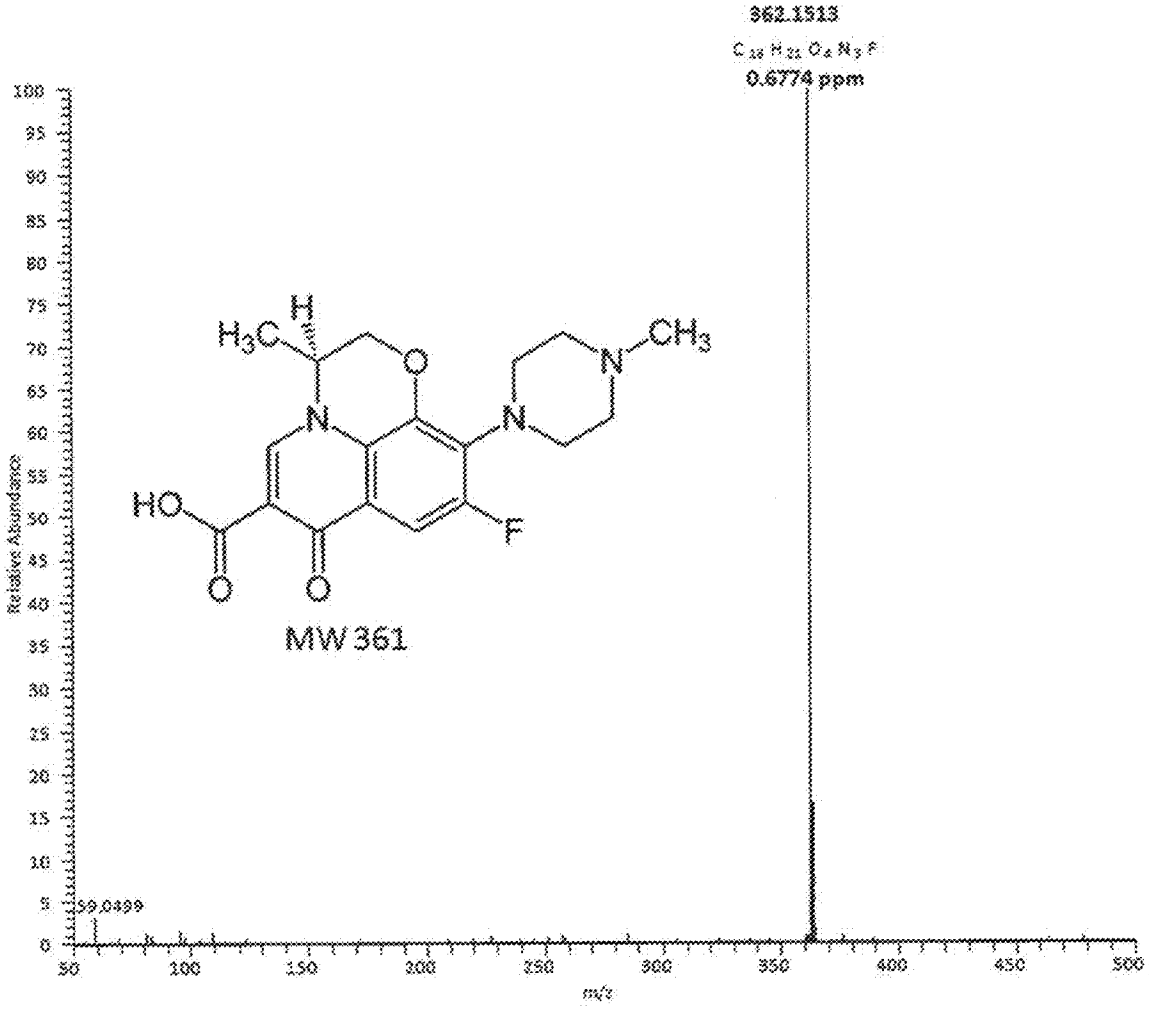
FIG. 22 illustrates the mass spectrum of Lavaquin introduced into a channel heated to 350° C. and linking a high pressure to a low pressure in the presence of air without the use of a matrix.

FIG. 22 illustrates the mass spectrum of Lavaquin introduced into the inlet 104 of a transfer capillary 102 heated to 350° C. by heater 112 and at atmospheric pressure in the presence of air without the use of a matrix.

Figure 23:
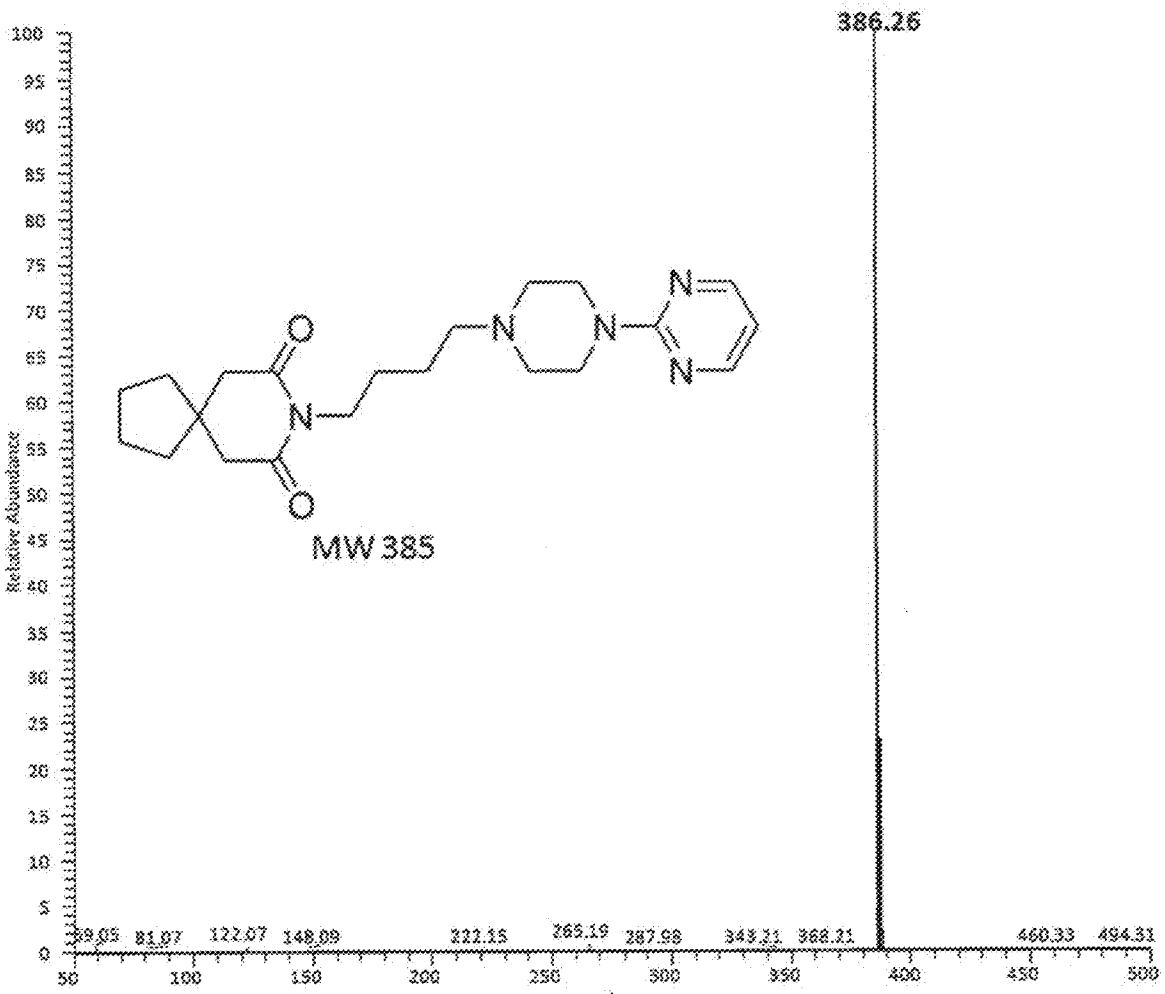
FIG. 23 illustrates the mass spectrum of buspirone hydrochloride introduced using a spatula into a heated channel at atmospheric pressure that links to a low pressure in the presence of air without the use of a matrix.

FIG. 23 illustrates the mass spectrum of buspirone hydrochloride touched against the inlet 104 of a transfer capillary 104 using a spatula 116 at atmospheric pressure in the presence of air without the use of a matrix.

Figure 24:
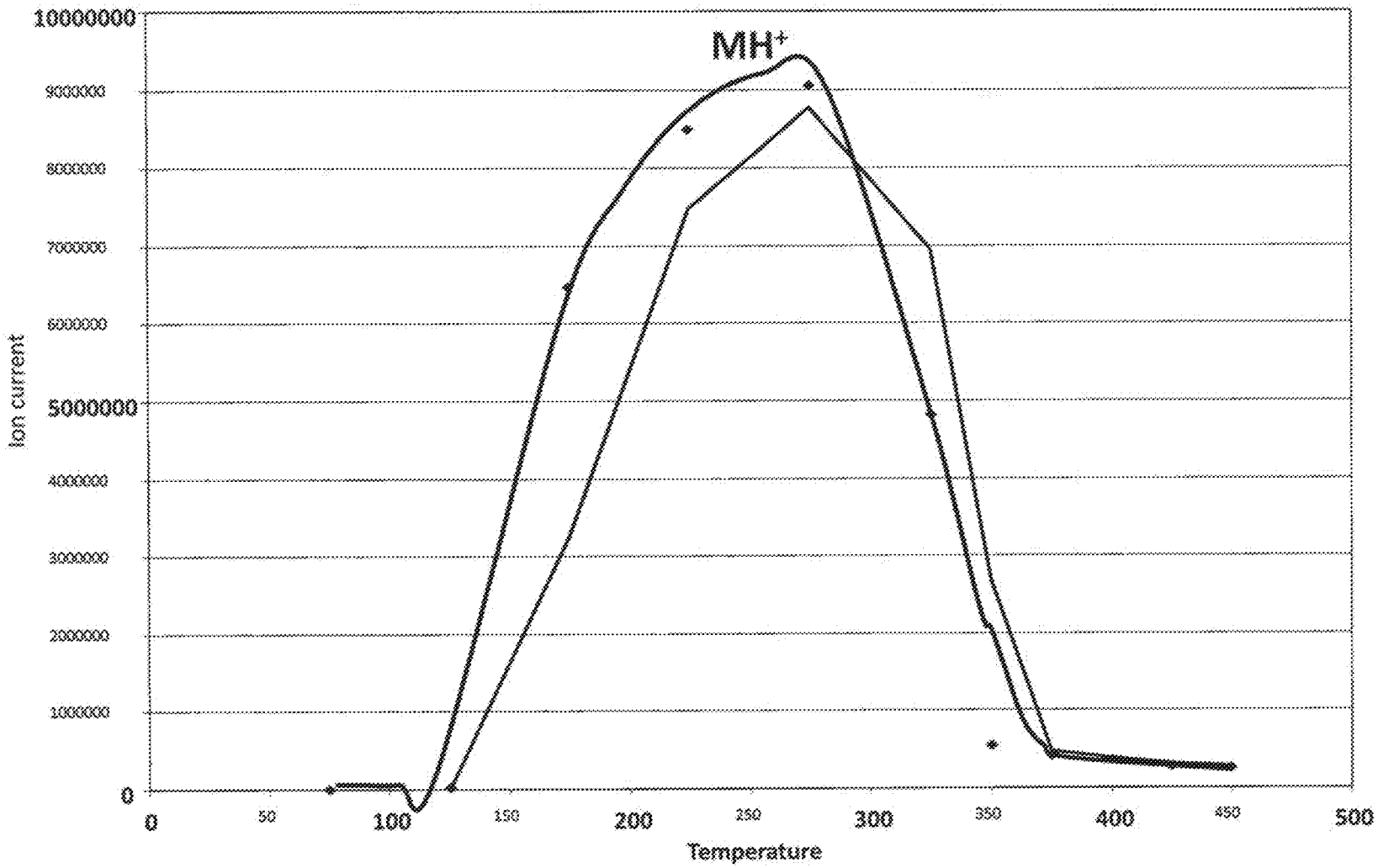
FIG. 24 illustrates the ion entrance temperature profile versus ion abundance of 2,5-di hydroxyacetophenone.

FIG. 24 illustrates the temperature profile of 2,5-DHAP. More specifically, FIG. 24 illustrates the ion abundance of MH+ ions versus the temperature of the ion entrance transfer capillary 102. As shown in FIG. 24, the ion abundance of MH+ ions increases as the temperature of the transfer capillary 102 is heated to a certain temperature after which the ion abundance decreases as the temperature continues to increase. Sample introduction was achieved at each temperature independently.

Figure 25A:
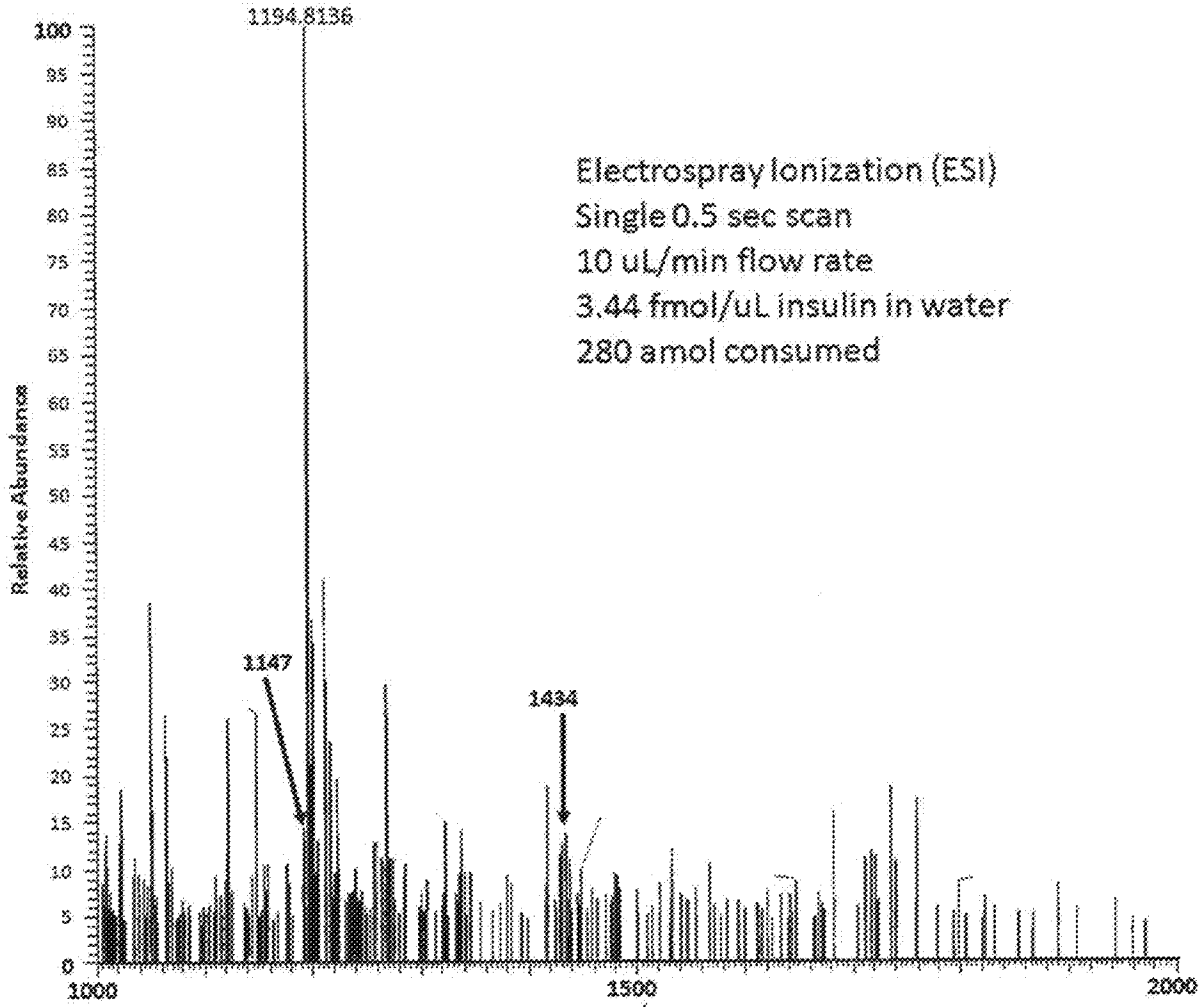
FIG. 25A illustrates the mass spectrum of a single acquisition of a solution of 3.44 femtomoles of insulin in water using electrospray ionizing at a solvent flow rate of 10 microliters per minute with masses 1147 and 1434 being associated with insulin.
Figure 25B:
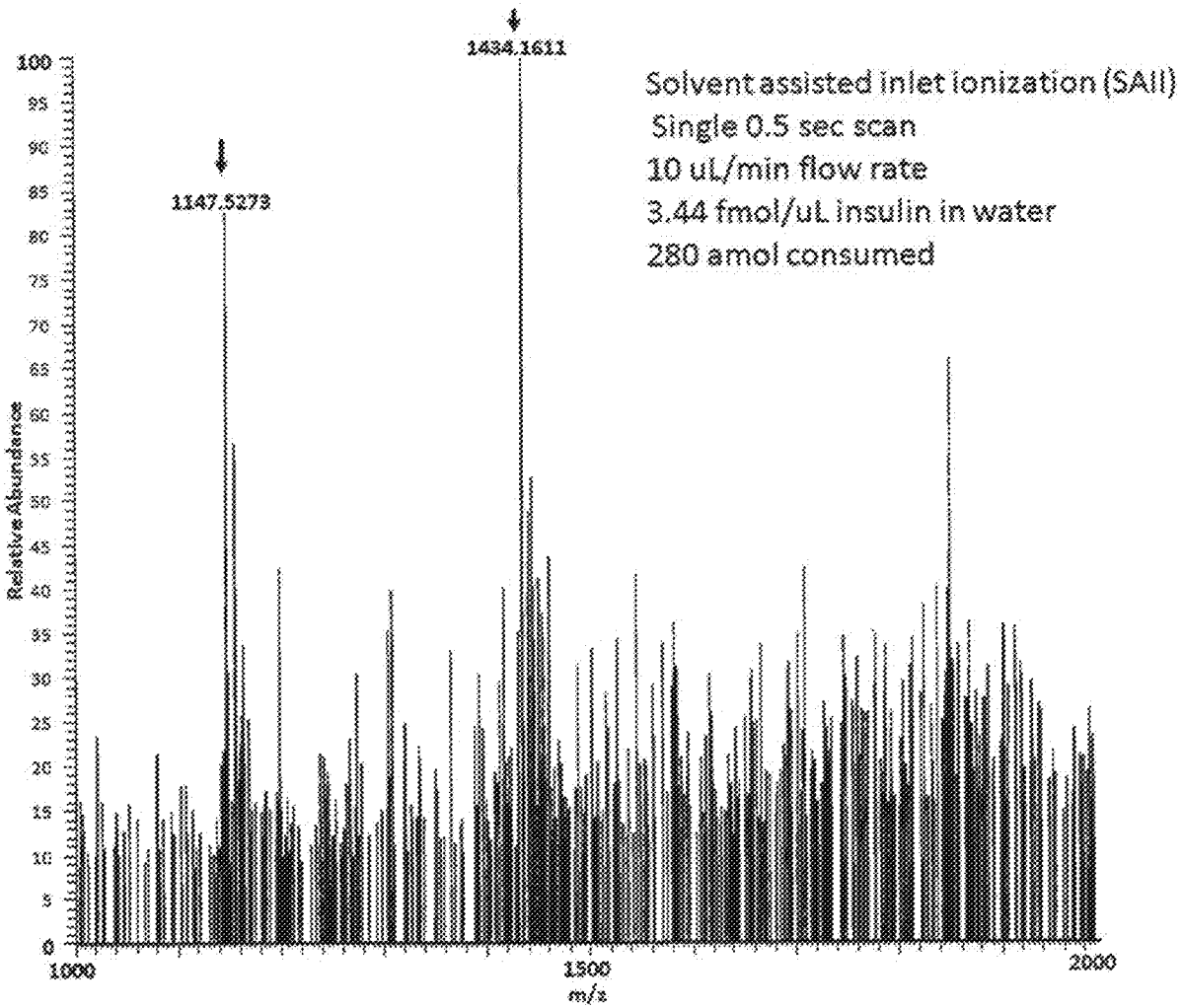
FIG. 25B illustrates the mass spectrum of a single acquisition of a solution of 3.44 femtomoles of insulin in water introduced into a heated inlet using a solvent assisted ionization inlet method under the same instrument tune conditions used in FIG. 25A for electrospray ionization.

FIG. 25A illustrates the mass spectrum of a single acquisition of a solution of 3.44 femtomoles of insulin in water that was electrosprayed at 10 microliters per minute. FIG. 25B illustrates the mass spectrum of a single acquisition of a solution of 3.44 femtomoles of insulin in water introduced to a heated transfer capillary using SAII. As can be seen by comparing FIGS. 25A and 25B, the levels of insulin (lines 1147 and 1434) are substantially greater when using SAII compared to ESI.

Figure 26:
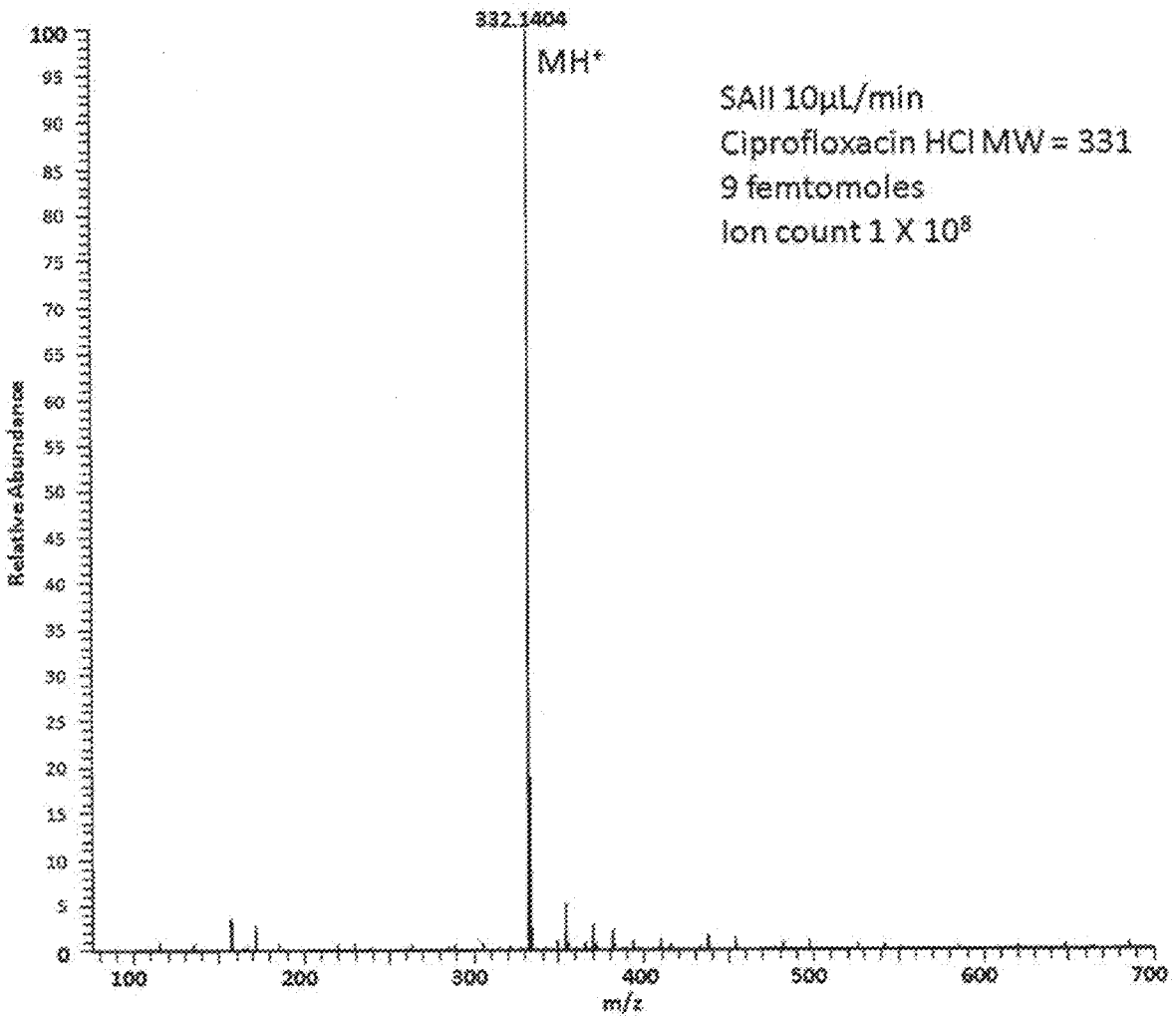
FIG. 26 illustrates the spectrum of nine femtomoles of ciprofloxacin in water acquired using solvent assisted ionization inlet.

FIG. 26 illustrates the spectrum of nine femtomole of ciprofloxacin acquired using solvent assisted ionization inlet in accordance with the setup illustrated in FIG. 6. Introducing ciprofloxacin into a heated transfer tube 102 in accordance with the SAII method described above results in a high ion count and signal-to-noise ratio.

Figure 27:
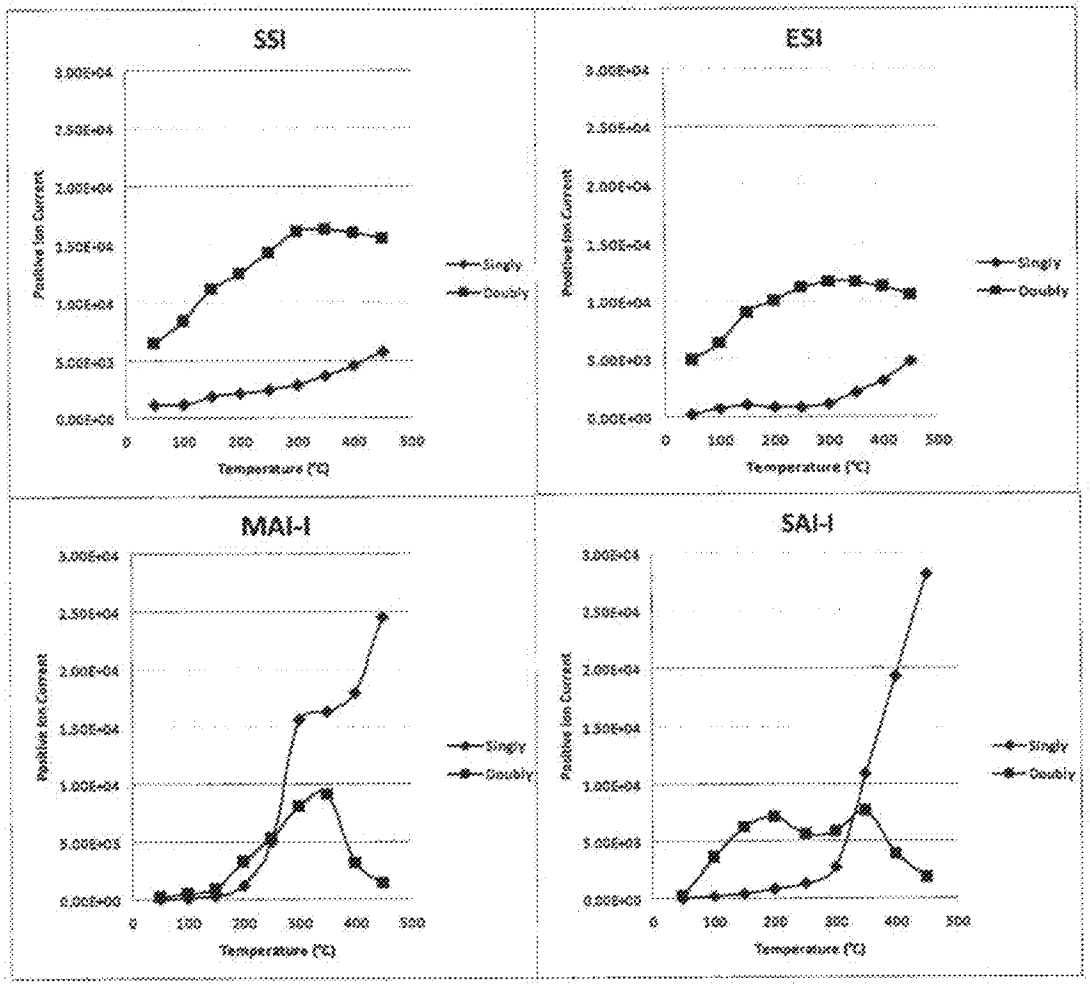
FIG. 27 includes a plurality of plots illustrating ion current versus inlet tube temperature for ions introduced using SSI, ESI, matrix assisted ionization inlet ("MAII"), and SAII

FIG. 27 includes a plurality of plots illustrating ion current versus transfer capillary temperature for ions introduced to transfer tube 102 using SSI, ESI, MAII, and SAII. As shown in FIG. 27, MAII and SAII demonstrate significant increases in ion current of singly charged ions (low mass ions) as the temperature of the transfer capillary is heated, with MAII demonstrating a noticeable increase of ion current at approximately 200° C. and SAII demonstrating a noticeable increase in ion current at approximately 300° C. The SAII and MAII plots are similar, but significantly different from the SSI and ESI plots. MAII and SAII both produce ions within capillary 102 while the SSI and ESI methods produce ions in region 10.

Analysis of Results for Ionization of Molecules for Mass Spectrometry and Ion Mobility Spectrometry The temperature requirement for the transfer tube 102 is somewhat dependent on the matrix or solvent and to some extent the analyte. Numerous matrixes have been tested experimentally, and although there may be an optimum temperature for each matrix and analyte, the peak of the optimum temperature is somewhat broad so fine tuning is not required. For example, using the matrix 2,5-dihydroxyacetophenone multiply charged ions of insulin were observed from <150° C. to >400° C.), but with a broad maximum between about 250° C. and 350° C. The maximum is only moderately compound dependant so that a single temperature can be used to ionize a wide range of compound types. Below 150° C., little ion current from insulin is observed with the matrix 2,5-dihydroxyacetophenone, but at the higher temperatures, significant ion current is observed for insulin although some background ions become more abundant at the highest temperatures. Using the same matrix with the peptide substance P, doubly charged ions were observed with a capillary temperature of only 40° C. with comparatively lower but extended abundance than those observed with higher inlet temperatures.

The matrix 2,5-dihydroxybenzoic acid (2,5-DHB) has been found to produce little ion current below 200° C. Although most matrix materials tested to date produce positively charged ions, negative ions of, for example, ubiquitin are observed with 2,5-dihydroxyacetophenone and with anthranilic acid. Higher temperatures may be used to generate negative ions compared to the temperatures for generating positive ions, and higher mass compounds may ionize at higher temperatures than lower mass compounds.

The actual temperature required for production of ions from any matrix is also dependant on the transfer tube 102 length and diameter and to some extent the material of construction. Even a skimmer device having a transfer length of a fraction of a millimeter can act as an ionization region.

As described above, multiply charged ions may be produced by the arrangement illustrated in FIG. 1 by touching or otherwise introducing the matrix/analyte sample to the heated face of transfer capillary 102. Alternatively, a heated surface near the entrance 104 of transfer tube 102 produces ions if the material ejected from the hot surface as particles or droplets enters the heated transfer capillary 102. Any means of producing particles of matrix/analyte that enters the heated transfer capillary 102 that links the higher pressure region 10 to the vacuum region 30 will produce ions if the proper matrix or solvent and heat are used. Thus, laser ablation of a matrix as with LSI is one approach for producing particles or droplets of matrix/analyte that enter the transfer capillary by the momentum imparted by the explosive deposition of laser energy into the matrix. However, unlike LSI, the present method of ionizing materials described herein does not require, nor is it dependant on, an ultraviolet (UV) laser. Consequently, visible or infrared (IR) lasers may also be utilized and using a UV laser and UV adsorbing matrix materials is merely one means of moving matrix from a substrate to the transfer tube 102 for ionization. Moreover, unlike LSI, the disclosed system and method does not require that the substrate 116 be transparent to the UV laser for transmission geometry (where the laser beam travels through the substrate before striking the matrix), but as, for example, in LIAD the laser may dislodge matrix/analyte by the acoustic wave generated by the laser striking a thin opaque substrate.

Methods used to produce aerosols or ultrasonic methods can also be used to produce the matrix/analyte or analyte particles. The experiments described above demonstrated that an ultrasonic probe with the matrix/analyte mixture applied could be used to transfer matrix/analyte through the air gap between the probe surface and the transfer tube entrance 104 and produce ionization. Consequently, it has been demonstrated that a variety of delivery systems may be utilized for introducing the matrix/analyte sample directly into a heated transfer tube 102 including, but not limited to, using a melting point tube, a glass slide, or a spatula, or indirectly by using, for example, lasers, piezoelectric devices, and the generation of shockwaves. One skilled in the art will understand that other methods of producing particles or droplets from a surface can also be employed.

There are a number of advantages to the currently described ionization method. For example, unlike being limited to matrix materials that adsorb at a particular wavelength as in matrix assisted laser desorption/ionization MALDI, the disclosed system and method are not so limited and may utilize matrixes such as 2,5-DHB and 2,5-DHAP as well as a wide array of compounds including, but not limited to, dihydroxybenzoic acid and dihydroxyacetophenone isomers such as the 2,6-isomer. Other matrices used with MALDI as well as matrices in which an amine functionality replaces the hydroxyl group are useful matrices in the disclosed system and method. Some of the amine based matrices, such as anthranilic acid, allow negative multiply charged ions to be observed in low abundance.

Additionally, the disclosed system and method for producing multiply charged ions do not require a voltage, a gas flow (except the flow through transfer tube 102 resulting from the pressure differential between the inlet 104 and outlet 106), or a laser. Therefore, methods as simple as placing the sample on a melting point tube and touching a heated surface on or near the transfer inlet to the mass spectrometer or ion mobility analyzer are sufficient to produce highly charged ions of proteins, for example. The analyte can be introduced into the transfer capillary 102 in solution, such as water, organic solvent, water with organic solvent, weak acid, weak base, or salt modifiers. Pure analyte can be introduced into the transfer capillary as a solid, liquid or vapor to effect ionization. Pure water or water with modifiers listed above can be added to the transfer capillary to aid ionization of compounds vaporized in or into the heated transfer capillary. Any method to transfer matrix/analyte sample 114 into the transfer tube 102 is suitable to produce ions. Because particles can be produced by laser ablation or LIAD, methods that use focused lasers, high spatial resolution imaging is possible.

Another advantage of the disclosed system and method is that it does not require an ion source enclosure, which reduces the cost and complexity of the mass spectrometer as the entrance 104 to the transfer tube 102 can be unobstructed allowing objects to be placed near the ionization region for ionization of compounds on the surfaces. Alternatively, the transfer capillary 102 can be extended to allow remote sampling. This is a very low-cost ionization method as ionization may be produced using a heated transfer tube 102 and a means of introducing the sample in matrix to the entrance end 104 of the transfer capillary 102.

The experimental results set forth in FIGS. 22-24 demonstrate that an analyte sample may be introduced without the presence of a matrix. Additionally, the results in FIG. 21 demonstrate that introducing the analyte, with or without a matrix, to the transfer capillary in the presence of gases such as nitrogen, argon, and helium may increase the ionization thereby increasing the sensitivity of the system.

FIG. 24 demonstrates that the ionization increases with an increase in temperature of the transfer capillary to a certain point and the ionization decreases as the temperature increases after that point. Consequently, the temperature of the transfer capillary may be optimized for different analytes.

FIG. 25A illustrates the ion abundance of the +4 (m/z 1434) and +5 (m/z 1147) charge states of insulin in 1:1 acetonitrile:water consuming 280 attomoles using ESI. An improved insulin mass spectrum is obtained for the same amount of sample consumed in water using the SAII method described above.

FIG. 26 illustrates the high ion abundance and signal-to-noise achieved for only nine femtomoles of the drug ciprofloxacin consumed using the SAII method at a solvent flow rate of 10 gL min'.

FIG. 27 illustrates ion abundance versus temperature for singly and doubly charged ions of bradykinin using the ionization methods SSI, ESI, MAII, and SAII. As shown in FIG. 27, the inlet ionization methods MAII and SAII produce a similar profile but different results compared to ESI and SSI. For example, the plots of FIG. 27 demonstrate a large dependence on the inlet temperature for MAII and SAII and a small dependence for SSI and ESI—methods in which ionization occurs before the ion transfer tube entrance.

Figure 28:
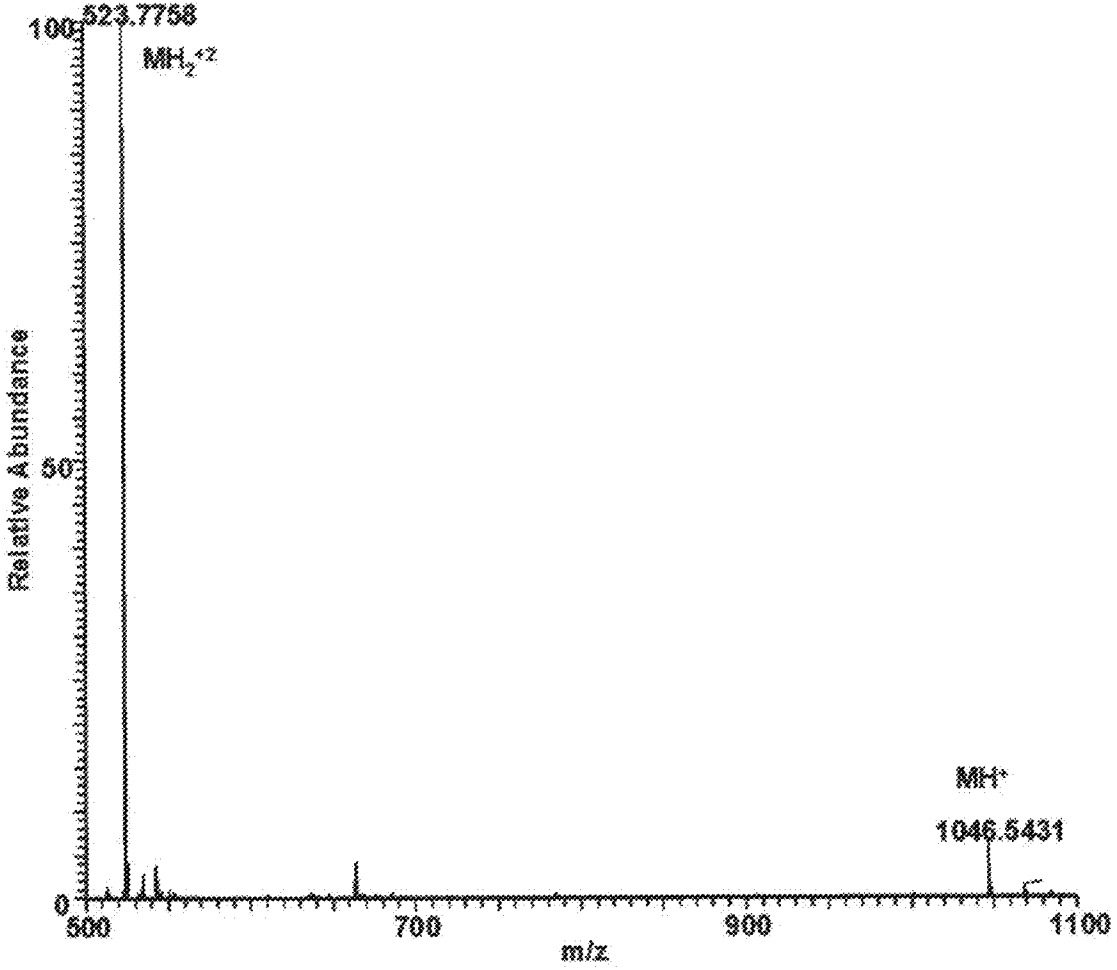
FIG. 28 shows the mass spectrum obtained for angiotensin II using the ionization configuration shown in FIG. 6.

FIG. 28 illustrates the mass spectrum obtained for angiotensin 1 using SAII with a transfer capillary temperature of 325° C. The doubly charged ions are approximately ten times more abundant than the singly charged ions.

Figure 29:
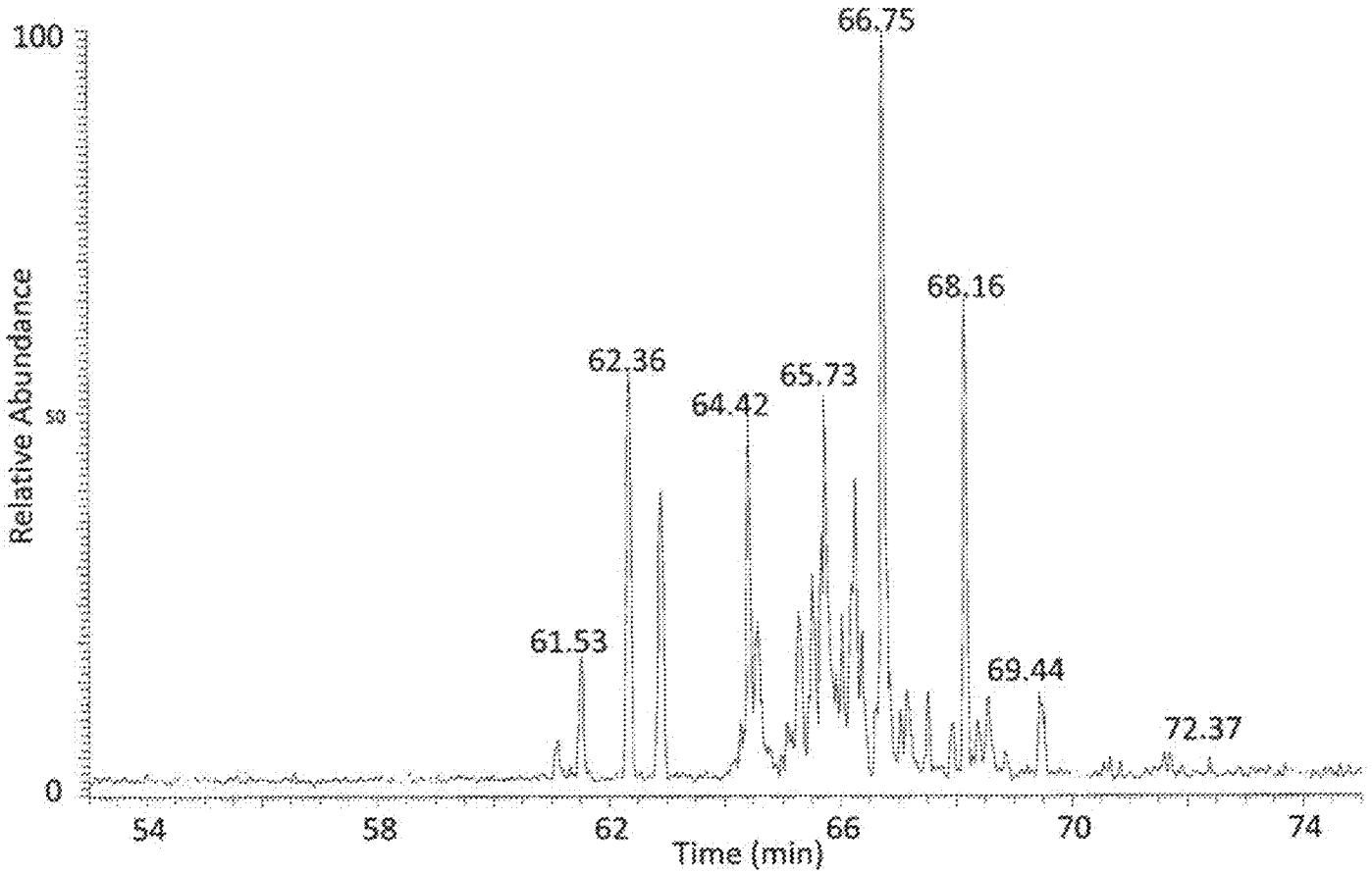
FIG. 29 illustrates a graph of elution volume versus ion abundance of bovine serum albumin tryptic digest eluting from a liquid chromatograph column.

FIG. 29 is a graph of elution volume shown as time vs. ion abundance for injection of 10 femtomoles of a BSA tryptic digest onto a CI8 100 gm×100 mm LC column and using nanoSAII at a flow rate of 800 nanoliters per minute of mobile phase. The graph demonstrates that nanoSAII provides excellent chromatographic resolution and high sensitivity.

The inlet ionization concept that ionization occurring within the heated inlet 102 provides a very sensitivity mass spectrometric method for analytes can be extended to nanoESI and nanoSSI occurring within a transfer tube 102. The combination of inlet ionization that is voltage assisted, as in nanoESI, occurring within a transfer tube 102 or assisted by gas nebulization, as with nanoSSI, provides analytical advantages such as higher ion abundances or lower background. These experiments confirm that nanoESI can be accomplished within the inlet capillary 102.

High-Throughput Analysis of Samples Using Solvent Assisted Inlet Ionization

There is a need for more efficient and effective systems and methods to analyze biological and synthetic materials more rapidly. As mass spectrometry methods continue to grow in importance in numerous fields, most notably as a tool for drug development and disease research, this need continues to grow. To date, however, SAII has been limited by the hands-on labor that is required for introducing different samples for analysis. The present disclosure demonstrates that SAII can be achieved using rapid and automated approaches to efficiently and effectively analyze large numbers of samples. Embodiments described herein show that SAII can be performed using a multiplexed approach that allows mapping of results to facilitate assessment of large amounts of rapidly-collected data. The SAII systems and methods disclosed demonstrate the simple, rapid, automated and high throughput analysis of samples with high sensitivity, a large mass range, and improved fragmentation. The multiplex systems and methods are a flexible approach for analyzing compounds independent of molecular weight and volatility, and can be used to conveniently map sample content, location, and quantities in a high-throughput manner.

The multiplex systems and methods may be adapted and combined with the ionizing systems and methods described above, and their respective embodiments, for example, the ionizing systems and methods disclosed for performing SAII/MS. In addition, the various conditions and sample preparation used in the systems and methods described above may be combined with the multiplex systems and methods.

The disclosed automated multiplex systems and methods demonstrate the ability to analyze samples from a well plate format using delivery tips, such as pipet tips; and a multiple channel pipet and/or a multiple pipet tip holder. The samples are loaded onto a multiple channel pipet or a multiple pipet tip holder by dipping the pipet tips in solutions of a well plate. The pipet tips are aligned with the mass spectrometer inlet. The pipet tips may also be aligned with a modified skimmer cone attached to the inlet. Samples can be analyzed from various numbers of wells, including 2, 6, 8, 16, 32, 64, 96, 384 or 1536 wells. Multiple channel pipets can hold various numbers of pipet tips, including 2, 6, 8, 16, 32, 64 or 96 pipet tips. Multiple pipet tip holders can hold any number of pipet tips, including 2, 6, 8, 16, 32, 64, 96, 384 or 1536 pipet tips. Multiple pipet tip holders are commercially available as the containers in which new pipet tips are shipped. In some embodiments, capillary action draws the liquid (analyte sample) into the pipet tips. In various embodiments, delivery tips can be heated or cooled. The efficiency of this rapid approach is heightened by the ability to input analyte sample directly into the inlet of the ion source, foregoing the need for a transfer tube, such as a fused silica tube or other type of capillary tube, typically used for delivering sample to the inlet of the mass spectrometer. Any type of delivery tip or tube that can hold a sample and achieve high throughput delivery can be used.

An advantage of the approach described is that the volume of sample introduced into the inlet is better controlled using pipet tips compared to using fused silica tubing. In addition, cross-contamination, caused by sample adhering to the walls of fused silica tubing, is eliminated, because the pipet tips deliver individual samples and are disposable. In some embodiments, pipet tips containing pure solvent alternate between pipet tips containing analyte samples, further reducing cross-contamination between analyte samples. In various embodiments, any number of pipet tips containing pure solvent may be placed between those pipet tips containing analyte samples to reduce cross-contamination. In alternative embodiments, pipet tips could be made from various materials and compositions such as polypropylene or glass.

In alternative embodiments, a capillary tube may be attached to the inlet of a mass spectrometer to deliver sample to the inlet. The capillary tube can deliver samples from a multiple well plate format to the mass spectrometer. The multiple well plate format can have various numbers of wells, including 2, 6, 8, 16, 30, 32, 64, 96, 384, and 1536. The capillary tube can be dipped into samples sequentially in the well plate format. The capillary tube can be heated or cooled. The multiple well plate containing samples can be heated or cooled. The multiple well plate format can be aligned with the delivery end of the capillary tube using a x,y-stage or a x,y,z-stage, a robotic arm, or other robotics. In various embodiments, the use of a capillary tube for delivery to the inlet can be combined with any of the embodiments utilizing pipet tips for sample delivery. In various embodiments, the systems and methods disclosed may be combined with microfluidic or nanofluidic systems and methods for analysis of samples.

In various embodiments, the distance between a pipet tip and the inlet to the mass spectrometer can vary. The appropriate pipet tip-to-inlet distance can vary depending on the inlet temperature or the strength of a vacuum at the inlet. The appropriate pipet tip-to-inlet distance can depend on the ability of effectively delivering the sample solution to the inlet of the mass spectrometer, while simultaneously avoiding melting of the pipet tip; for example, at higher inlet temperatures. In various embodiments, the pipet tip-to-inlet distance is a distance between 0.1 millimeter (mm) and 0.5 mm.

Various solvents may be used with the multiplex systems and methods described. Solvents include water, water/organic solvent mixtures, and pure organic solvents. Examples of solvents include acetonitrile, methanol, and ethanol. Additives may be added to the analyte/solvent. Examples of such additives include weak acids (such as acetic or formic), bases (such as ammonium hydroxide), salts (such as ammonium acetate), and/or modifiers (such as glycerol or nitrobenzyl alcohol), to name a few. The amount of an additive in the analyte may be varied as will be understood by one skilled in the art. In some embodiments, an amount of an additive may be between 0 and 50 percent weight. In some embodiments, an additive may be between 0 and 5 percent weight such as approximately 0.1 percent weight. Addition of ammonium salts may enhance signal and/or decrease chemical background, producing cleaner mass spectra results. Examples of ammonium salts include diammonium citrate and ammonium acetate.

As described in the ionizing systems and methods above, the inlet channel to the mass spectrometer may be heated to various temperatures using the multiplex systems and methods. In various embodiments, the inlet channel may be heated between 100° C. and 500° C. In various embodiments, the inlet channel may be heated between 50° C. and 600° C., between 100° C. and 500° C., or between 150° C. and 450° C. In alternative embodiments, the inlet channel to the mass spectrometer may be cooled to various temperatures, for example less than or equal to 20° C. In various embodiments, the inlet channel may be cooled to between 0° C. and 20° C., between 10° C. and 20° C., between −5° C. and −15° C., between −10° C. and 0° C., between −20° C. and −0° C., or between −25 and −5° C. The inlet may be cooled using various methods, such as dry ice, wet ice or an electric cooling system. In one embodiment, the inlet is extended with a tube and the tube is cooled.

In various embodiments, samples may be heated or cooled. In some embodiments, samples can be frozen. Samples may be cooled to between 0° C. and 20° C., between 10° C. and 20° C., between −5° C. and −15° C., between −10° C. and 0° C., between −20° C. and −0° C., or between −25 and −5° C. The samples may be cooled using various methods, such as dry ice, wet ice or an electric cooling system.

As described in the ionizing systems and methods above, a pressure differential can be created across the inlet channel. A high pressure region may exist on the outside of the mass spectrometer and a low pressure region may exist on the inside of the mass spectrometer. The pressure differential can create a vacuum by which sample can be delivered to the mass spectrometer through the inlet channel. The pressure differential may be adapted to the requirements for optimizing the multiplex systems and methods. For example, a greater pressure differential can be use to increase effective delivery of the sample to the mass spectrometer. In one embodiment, the pressure differential across the inlet channel is an existing feature of the mass spectrometer.

In various embodiments, any type of automated system that allows alignment of the delivery tips in front of the inlet of the mass spectrometer can be used, such as a platform, a robotic arm, or other robotic system. In various embodiments, the use of a x,y-stage is interchangeable with the use of a x,y,z-stage. In various embodiments, movement of the automated system can be continuous. The rate of continuous motion can be fixed or can be varied. As an example of variable motion, the movement of the stage over a distance between pipet tips may be faster than the movement of the stage when the pipet tip comes into alignment with the inlet of the mass spectrometer. In various embodiments, the movement of the automated system, can be discontinuous. For example, the stage can move between pipet tips and stop when the pipet tip is aligned in front of the inlet of the mass spectrometer.

The automated delivery of sample using an automated platform allows for rapid analysis of high volumes of samples. In one embodiment, the multiplex systems and methods can analyze 1 sample per second. In another embodiment, the multiplex systems and methods can analyze 2 samples per second. The systems and methods can be adapted to increase or decrease the volume of samples analyzed based on different conditions and/or determinations of what quality of data is acceptable for a particular application.

When acquisition is coupled to a x,y-stage, x,y,z-stage, or other automated system and recorded by an imaging software program, embodiments of the current disclosure allow rapid assessment of the content of multiple samples, for example, samples contained within the wells of a plate. The assessment of multiple samples can be sequential. The assessment of the samples can determine the content of each sample, for example, the presence or absence of a particular compound based on the mass-to-charge ratio recorded by the mass spectrometer. In particular embodiments, quantitative approaches, can be incorporated to determine the amounts of analytes of interest that are present. For example, quantitative approaches such as standard and deuterated standards, and MS/MS can be incorporated.

In embodiments disclosed herein, a large amount of data can be collected in a short time period (e.g. 1000 samples/hour), therefore, a method to sort data according to particular criteria is helpful. One feature of the systems and methods disclosed herein is that a user can map the results of many sample wells. In various embodiments, commercially-available imaging software can be used to map samples. In one embodiment, the results of sample wells in a well plate are mapped visually. Software can visually show qualitative values, for example, the presence or absence of a compound in the well of a plate. Software can also visually show quantitative values, for example, the amount of a compound in a well of a plate, which can be mapped using a visual indicator of the intensity level in the well. In various embodiments, software can map samples for multiple user-defined parameters. In one embodiment, these maps can be generated as color plots. This mapping approach allows users to identify and focus on wells of interest. Additionally, analyzed samples can be re-analyzed, for example, using fragmentation such as collision induced dissociation ("CID"), electron transfer dissociation ("ETD"), or electron capture dissociation ("ECD"). Analyzed samples can be re-mapped according to different targets or thresholds, because all spectra data can be saved for each well. A targeted approach can be employed, for example, for a known analyte. A non-targeted approach can also be employed, for example, using changes of multiple components and methods by principal component analysis ("PCA").

Additional benefits of the systems and methods disclosed herein include the ability to temporarily resolve measurements because the pipet tips are dipped into sample wells simultaneously at any given time. Moreover, pipet tips can be "reloaded" from the original sample well plates allowing repeat testing over time (note, in preferred embodiments, pipet tips are not re-used). This ability to serially re-test wells enables collection of mass spectral analysis that may vary over time.

Figure 30:
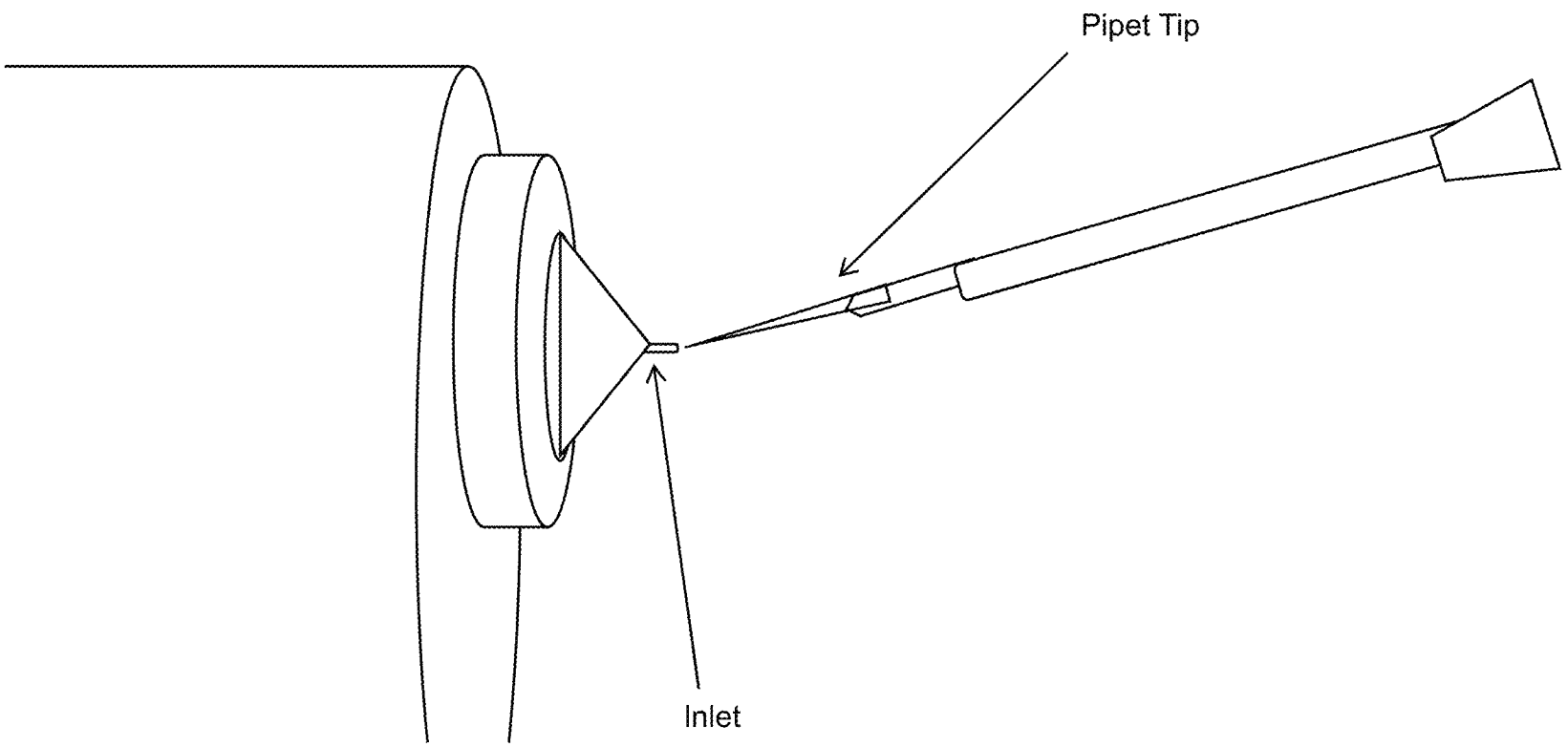
FIG. 30 illustrates an example of a system and method for delivering an analyte to a mass spectrometer.

FIG. 30 illustrates an example of a system and method for delivering analyte to a mass spectrometer for analysis by SAII/MS. In this embodiment, the analyte is introduced directly into the inlet aperture of the mass spectrometer using a single pipet. In one embodiment, the pipet tip can be dipped into the sample well of a sample well plate, loading the sample into the pipet tips by capillary action. In one embodiment, the sample can be loaded into the pipet tip mechanically using a pipet. In some embodiments, the pipet tips can be loaded using a liquid handling system. In one embodiment, analyte is manually loaded into the inlet. In one embodiment, analyte is loaded by vacuum. In a preferred embodiment, the pipet tip does not touch the inlet aperture of the mass spectrometer. The inlet aperture of the mass spectrometer can be fitted with or without a skimmer cone. In preferred embodiments, the inlet channel of the mass spectrometer is heated and there is a pressure differential across the inlet channel.

Figure 31:
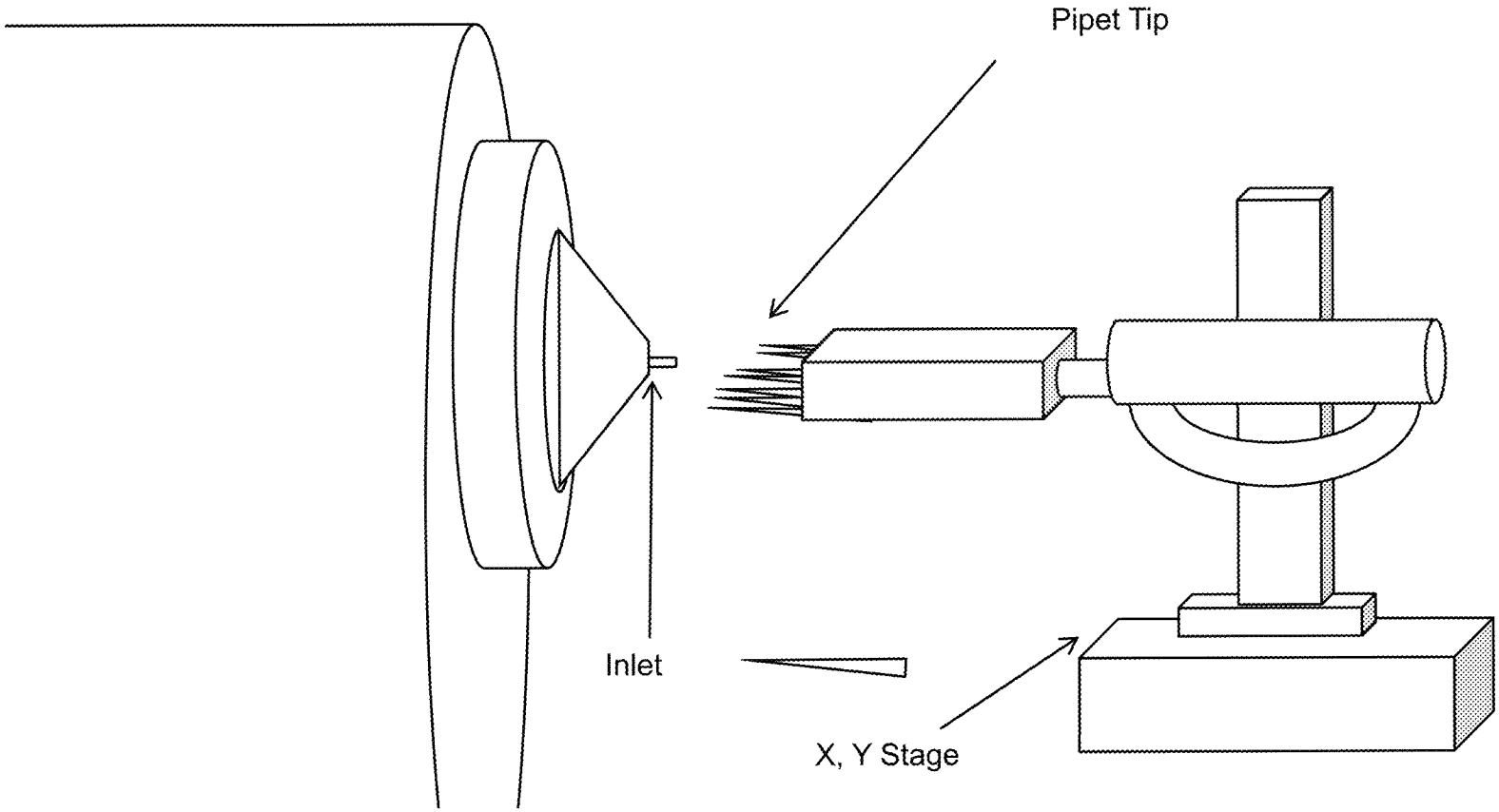
FIG. 31 illustrates an example of a multiplex system and method for analysis by SAII/MS using a multiple channel pipet.

FIG. 31 illustrates an embodiment of a system and method for delivering analyte to a mass spectrometer for analysis by SAII/MS using a multiple channel pipet. In the embodiment illustrated in FIG. 31, the multiple channel pipet is an 8-channel pipet. The pipet tips are dipped into the sample wells of a sample well plate, loading the sample into the pipet tips by capillary action. In some embodiments, the pipet tips can be loaded using a liquid handling system. In various embodiments, the multiple channel pipet can have any number of channels, including 2, 6, 8, 16, 32, 64 or 96. In various embodiments, the multiple channel pipet is affixed to a stage, whereby each pipet tip is sequentially moved in front of the inlet aperture of the mass spectrometer. The stage can be a x,y-stage or a x,y,z-stage. The pipet tip can be specifically aligned with the inlet aperture. In preferred embodiments, the stage is automated and can be controlled by a computer software program, by which particular variables can be determine, such as the number of samples, the distance between pipet tips and the speed of movement of the stage or multiple channel pipet. In a preferred embodiment, the pipet tips do not touch the inlet aperture of the mass spectrometer. The inlet aperture of the mass spectrometer can be fitted with or without a skimmer cone. In preferred embodiments, the inlet channel of the mass spectrometer is heated and there is a pressure differential across the inlet channel.

Figure 32:
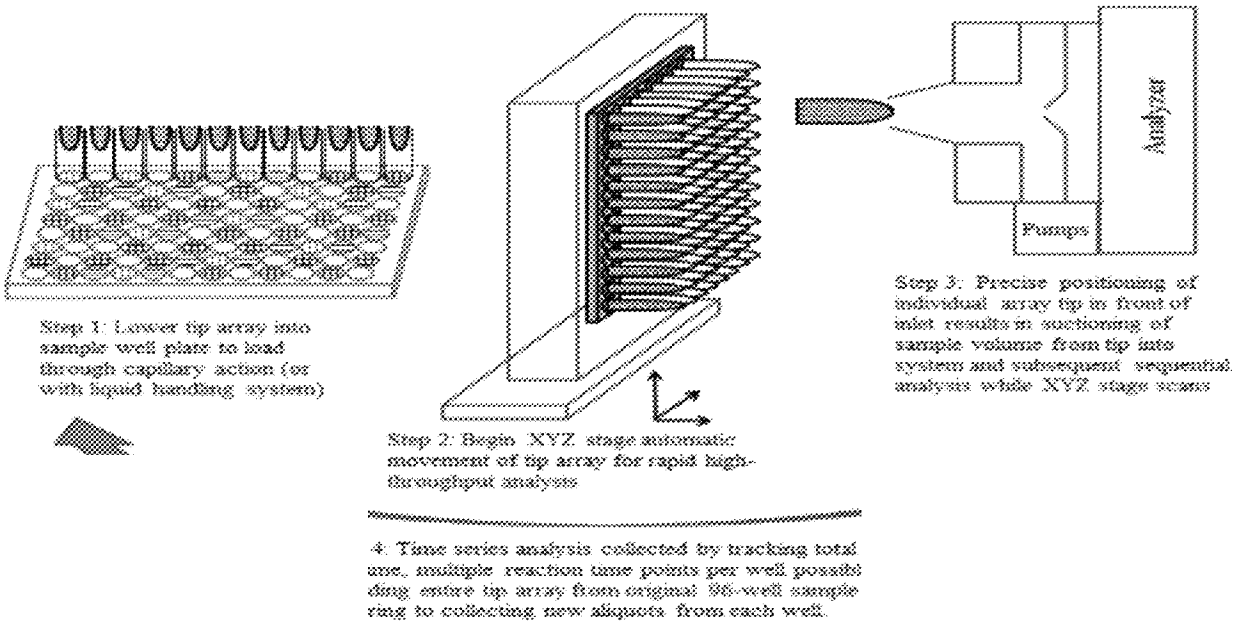
FIG. 32 illustrates another example of a multiplex system and method for analysis by SAII/MS using a multiple pipet tip holder.

FIG. 32 illustrates an embodiment of a system and method for delivering analyte to a mass spectrometer for analysis by SAII/MS using a multiple pipet tip holder. In the embodiment illustrated in FIG. 32, the analytes are delivered to the mass spectrometer using a 96-pipet holder. The pipet tips are dipped into the sample wells of a sample well plate, loading the sample into the pipet tips by capillary action. In some embodiments, the pipet tips can be loaded using a liquid handling system. In various embodiments, the multiple pipet tip holder can hold any number of pipet tips, including 2, 6, 8, 16, 32, 64, 96, 384 or 1536 pipet tips. In various embodiments, the multiple pipet tip holder is affixed to a stage, whereby each pipet tip is sequentially moved in front of the inlet aperture of the mass spectrometer. The stage can be an x,y-stage or a x,y,z-stage. The pipet tip can be specifically aligned with the inlet aperture. In preferred embodiments, the stage is automated and can be controlled by a computer software program, by which particular variables can be determine, such as the number of samples, the distance between pipet tips and the speed of movement of the stage or multiple pipet tip holder. In a preferred embodiment, the pipet tips do not touch the inlet aperture of the mass spectrometer. The inlet aperture of the mass spectrometer can be fitted with or without a skimmer cone. In preferred embodiments, the inlet channel of the mass spectrometer is heated and there is a pressure differential across the inlet channel.

Experimentation for High-Throughput Analysis of Samples Using Solvent Assisted Ionization Inlet Mass Spectrometry The SAII-MS and SAII-MS/MS experiments used to test the multiplex systems and methods were carried out on an LTQ Orbitrap Velos mass spectrometer available from Thermo Fisher Scientific (Bremen, Germany), from which the ESI source was removed and the interlocks were overridden. The inlet channel of the mass spectrometer was heated from 150° C. to 450° C. depending on the solvent used and its respective pH. For these experiments, pipet tips (10 μL micro pipet tips, Fisher Scientific, Pittsburgh, Pa.) were aligned with the inlet aperture using an 8-channel pipet holder or a 96-pipet tip holder in which new pipets are shipped. To avoid cross-contamination, pipet tips filled with only solvent, used for dissolving the analyte in the previous pipet tip, were added to alternate pipet tips. Solutions containing sample, or pure solvent, were loaded by simultaneously dipping the pipet tips into a 96 multi-vial or well plate containing the various analyte solutions; 3 μL of each solution was drawn into the pipet tip by capillary action (based on acetonitrile:water solution). The holder was affixed on the x,y-stage with the first pipet tip (typically empty) placed in close proximity (0.1 mm at low inlet temperatures and 0.5 mm at high inlet temperature) to the inlet aperture. Using the control of the x,y-stage, rows of pipet tips were moved automatically in front of the inlet aperture so that the solution containing the analyte exited the pipet tip under the influence of the existing pressure differential, when the tip was in close proximity with the inlet aperture of the mass spectrometer. The x,y-stage movement was continuous and the rate of movement was controlled from 1.5 millimeters per sec (mm $sec^{-1}$) to 18 mm $sec^{-1}$. The x,y,z,-stage can travel 150 mm in all directions with a maximum speed of 40 mm $sec^{-1}$ and a resolution of 0.04 microns. The physical limitations of the design of the mass spectrometer reduce movement to a maximum of 65 millimeters in the y-direction. Data were acquired in the m/z range of 150-2000, unless otherwise stated. Mass spectra were displayed as a single acquisition, generally by acquiring 1 microscan using a maximum injection time of 100 milliseconds for pipetting; 1 microscan using a maximum injection time of 300 milliseconds for multiplexing; and 1 microscan using a maximum injection time of 500 milliseconds for quantitative studies. Biomap imaging software (Novartis Institution for Biomedical Research, Basel, Switzerland), typically used for imaging applications, was incorporated to map the presence of analyte in sample solution, as determined by the m/z ratio values obtained by MS or MS/MS. In addition to mapping the location of the analyte, the software displayed relative concentrations by color code.

Collision induced dissociation and electron transfer dissociation were employed for characterization of certain analytes by selecting the parent ion using a mass tolerance of 1 m/z unit. The CID MS/MS spectra were obtained using a normalized collision energy setting between 20 to 30 depending on the analyte, and ETD using an activation time of 100 milliseconds.

Sample Preparation

Clozapine was obtained from Santa Cruz Biotechnology (Santa Cruz, Calif.); leucine enkephalin was obtained from Waters Corporation (Manchester, UK); sphingomyelin was obtained from Avanti Polar Lipids Inc. (Alabaster, Ala.); angiotensin I and galanin were purchased from American Peptide Co. (Sunnyvale, Calif.); bovine insulin, ubiquitin, lysozyme, myoglobin, and carbonic anhydrase were obtained from Sigma Aldrich Inc. (St. Louis, Mo.); N-acetylated myelin basic protein was obtained from Anaspec (Fremont, Calif.); and phosphopeptide standard I was obtained from Protea Biosciences (Morgantown, W.V.). Clarithromycin tablet (500 mg) was obtained from a local pharmacy and ground to a fine powder by mortar and pestle. The solvents, acetonitrile and formic acid were obtained from Fisher Scientific Inc. (Pittsburgh, Pa.); ethanol was obtained from Decon Labs, Inc. (King of Prussia, Pa.); acetic acid was obtained from Mallinckrodt Chemicals (St. Louis, Mo.); and all the other solvents were from EMD Chemicals (Gibbstown, N.J.). The stock solution of 1 mg $mL^{-1}$ of clozapine was prepared in ethanol and was diluted to 10 picomoles per microliter (pmol $\mu L^{-1}$) in water. The stock solution of sphingomyelin was prepared in methanol; bovine insulin was prepared in 50:50 methanol:water with 1% acetic acid; and all the other stock solutions were prepared in water.

For the experiments using direct pipetting, the phosphorylated peptide mixture was prepared in 50:50 acetonitrile: water with 0.1% formic acid for positive mode acquisition at 150° C., and in 0.5% ammonia for negative mode acquisition at 400° C. Myoglobin and carbonic anhydrase were diluted in water with 0.1% formic acid and analyzed at an inlet temperature of 250° C. In the pH study, bovine insulin and lysozyme solutions at pH of 3, 4.5, 6, and 9 were tested. The bovine insulin stock solutions were prepared in 50:50 methanol:water with 1% acetic acid and 50:50 methanol: water with 1% ammonia. The acidic solution was diluted with methanol:water with acetic acid or water, and the basic solution was diluted with methanol:water with ammonia or water. Lysozyme was prepared by dissolving lysozyme in 1% formic acid, 50:50 acetonitrile:water with 0.1% formic acid, 50:50 acetonitrile:water with 0.05% formic acid, water, and 0.1% ammonia, respectively. Carbonic anhydrase was diluted in water with 0.1% formic acid.

For the experiments using an 8-channel pipet, leucine enkephalin and galanin were prepared in water with 0.1% formic acid, and ubiquitin was prepared in 50:50 acetonitrile:water with 0.1% formic acid. Clozapine was diluted by methanol to desired concentrations. For the analysis of tablets, 8 wells in the first row of a 384-well microtiter plate (Greiner Bio-One Inc., Monroe, N.C.) were filled with 100 μL of methanol. A pipet tip was used to dip into the tablet powder to transfer a random amount of the powder, and the pipet tip was swirled into the second, fifth, and eighth well. The tablet solutions were then diluted 100 fold by methanol in the second row of the microtiter well plate, and the diluted tablet solutions were diluted again 100 fold in the third row.

For experiments using a 96-well plate, analytes were diluted from their stock solutions using the following solvent systems: clozapine was diluted in methanol; sphingomyelin was diluted in methanol with 1% acetic acid; bovine insulin was diluted in 50:50 methanol:water with 1% acetic acid; and all the others were diluted in 50:50 acetonitrile: water with 0.1% formic acid.

Example 1

Single Pipet Tip

Initial mass spectrum results were obtained using a single pipet and purchased standards using the systems and methods described in FIG. 30.

Figure 33:
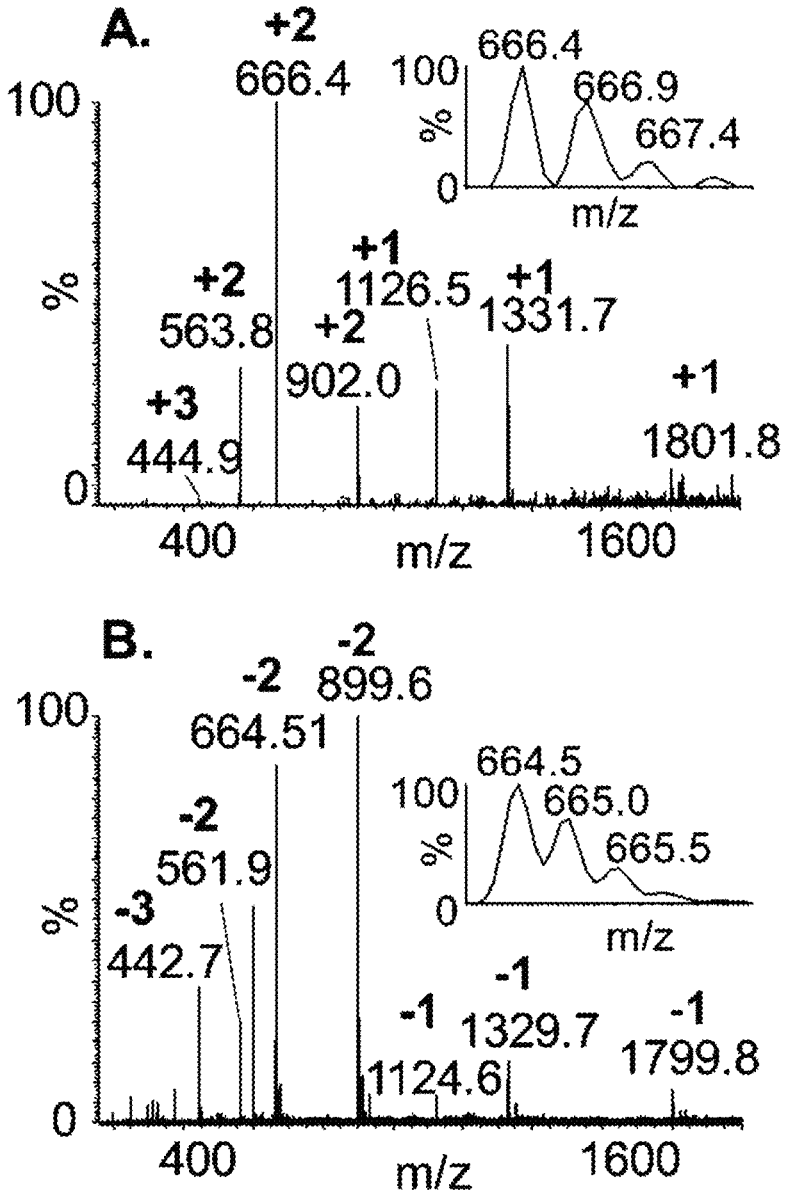
FIG. 33 illustrates the SAII/MS mass spectrum of a mixture of phosphorylated peptides using the delivery system in FIG. 30.

FIG. 33 illustrates the mass spectrum of a mixture of phosphorylated peptides. Sample solution was introduced for mass analysis from a single pipet tip held close to the inlet aperture of the mass spectrometer. For ease of operation, the source housing was removed and interlocks overridden. Analyte ions were observed as soon as the pipet tip was close to, but not touching, the heated (150° C.) inlet tube entrance and solution was drawn into the inlet. Standards, and standard mixtures, of varying concentrations were run to acquire initial benchmark results for ongoing improvements. FIG. 33 illustrates that both positive (A) and negative (B) ions were produced using this method on phosphorylated peptides, without the loss of phosphorylation.

Figure 34:
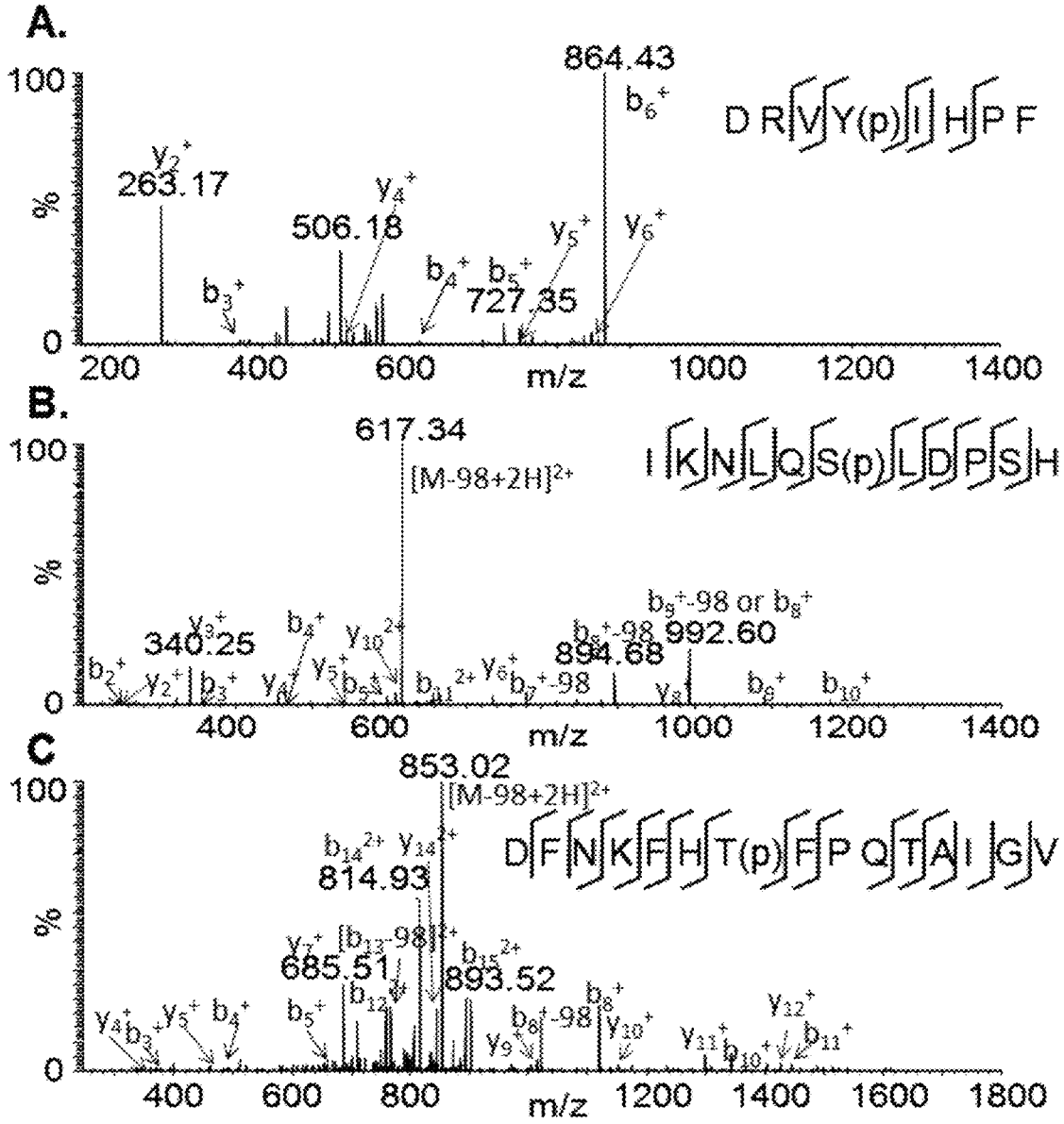
FIG. 34 illustrates the SAII/MS/MS mass spectrum of a mixture of phosphorylated peptides using the delivery system in FIG. 30.

FIG. 34 illustrates the SAII/MS mass spectra of a mixture of phosphorylated peptides (angiotensin II, cholecystokinin (10-20), and calcitonin (15-29)) delivered into the inlet channel, which was heated to 250° C. Fragmentation using CID provided good sequence coverage of each phosphorylated peptide when dispensing 1 μL of a 2.5 pmol μL-1 solution. MS/MS spectra from the mixture of the doubly charged ions using CID and 1 μL of 2.5 pmol μL-1 solution for each acquisition, are shown in (A) for phosphorylated angiotensin II at collision energy 30, data acquired in the mass range of 155-2000; (B) phosphorylated cholecystokinin (10-20) at collision energy 20, data acquired in the mass range of 180-2000; and (C) phosphorylated calcitonin (15-29) at collision energy 20, data acquired in the m/z range of 245-2000.

Figure 35:
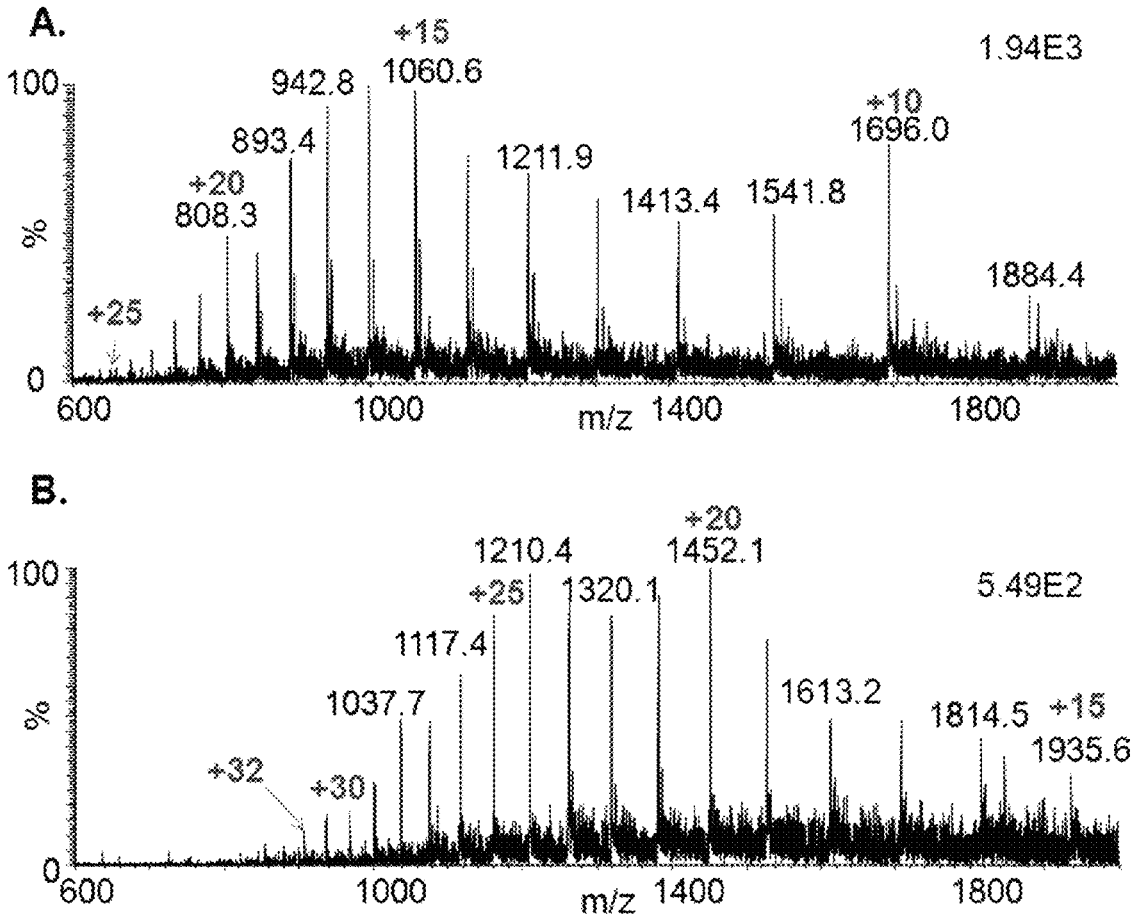
FIG. 35 illustrates the SAII/MS mass spectra of proteins of myoglobin and carbonic anhydrase using the delivery system in FIG. 30.

FIG. 35 illustrates the SAII/MS mass spectra of proteins as large as (A) myoglobin dispensed in 1 μL 2.5 pmol μL-1 and (B) carbonic anhydrase dispensed in 1 μL 5 pmol μL-1; obtained by pipetting the solution into the inlet at an inlet temperature of 250° C. The number in the top right corner of each denotes the ion intensity. Data were acquired in the m/z range of 600-2000. The results in FIG. 35 demonstrate the proteins were efficiently ionized and detected using this approach. The angle of the pipet relative to the inlet had little effect so long as solution was drawn into the inlet.

Figure 36:
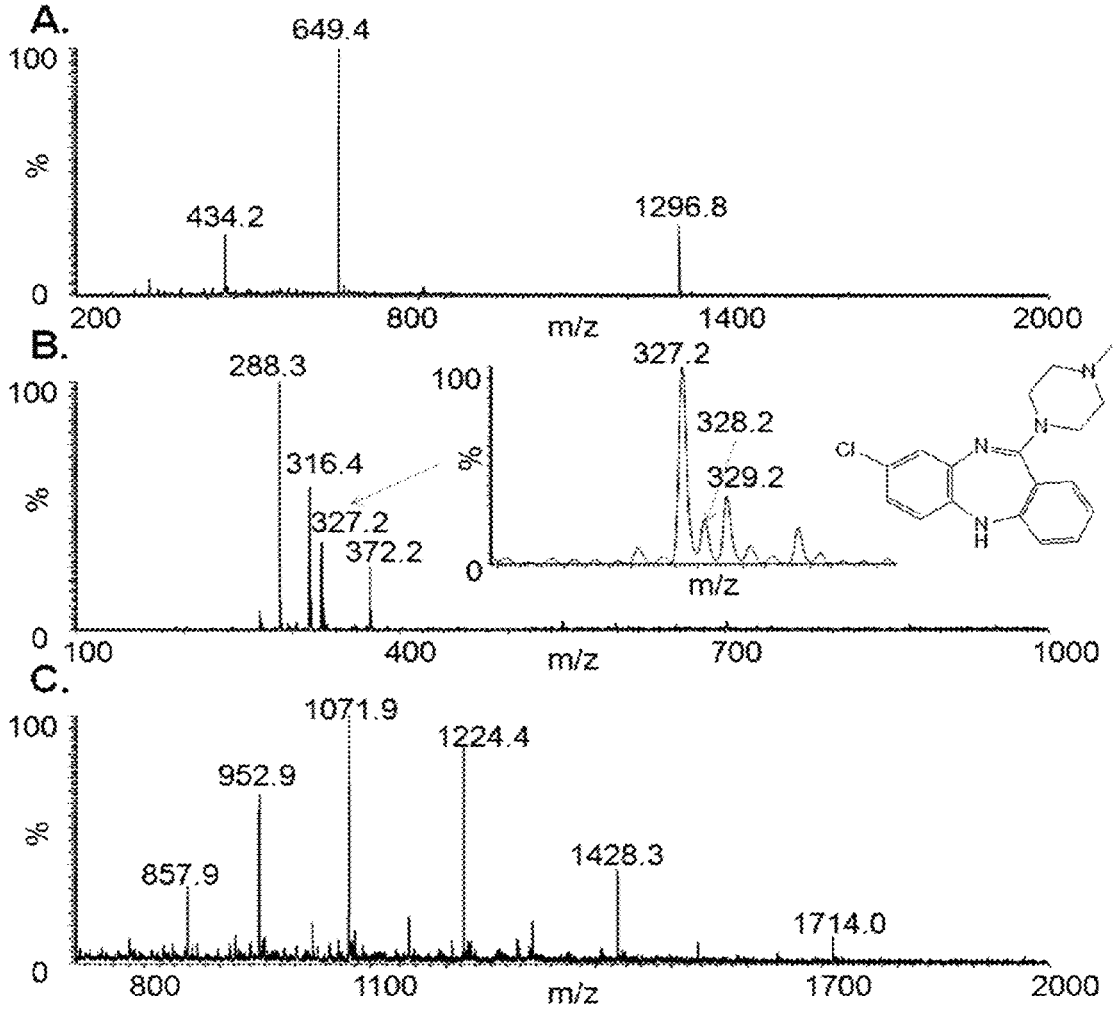
FIG. 36 illustrates the SAII/MS mass spectra of angiotensin, clozapine, and ubiquitin in various solvents using the delivery system in FIG. 30.

FIG. 36 illustrates the SAII/MS mass spectra results demonstrating that SAII is operationally simple and tolerant of a wide range of solvents, such as (A) 100% water, (B) chloroform, and (C) 90% acetonitrile. FIG. 36(A) illustrates a SAII mass spectrum of 5 pmol $\mu L^{-1}$ angiotensin I in water at 150° C.; FIG. 36(B) illustrates a SAII mass spectrum of 5 pmol $\mu L^{-1}$ clozapine in chloroform at 250° C. with matching isotopic distribution and data acquired in the mass range of 100-1000; and FIG. 36(C) illustrates a SAII mass spectrum of 1 pmol $\mu L^{-1}$ ubiquitin in 90:10 acetonitrile: water at a 400° C. inlet temperature. For each, 1 μL of each solution was pipetted into the inlet and data were acquired in the m/z range of 150-2000.

Figure 37:
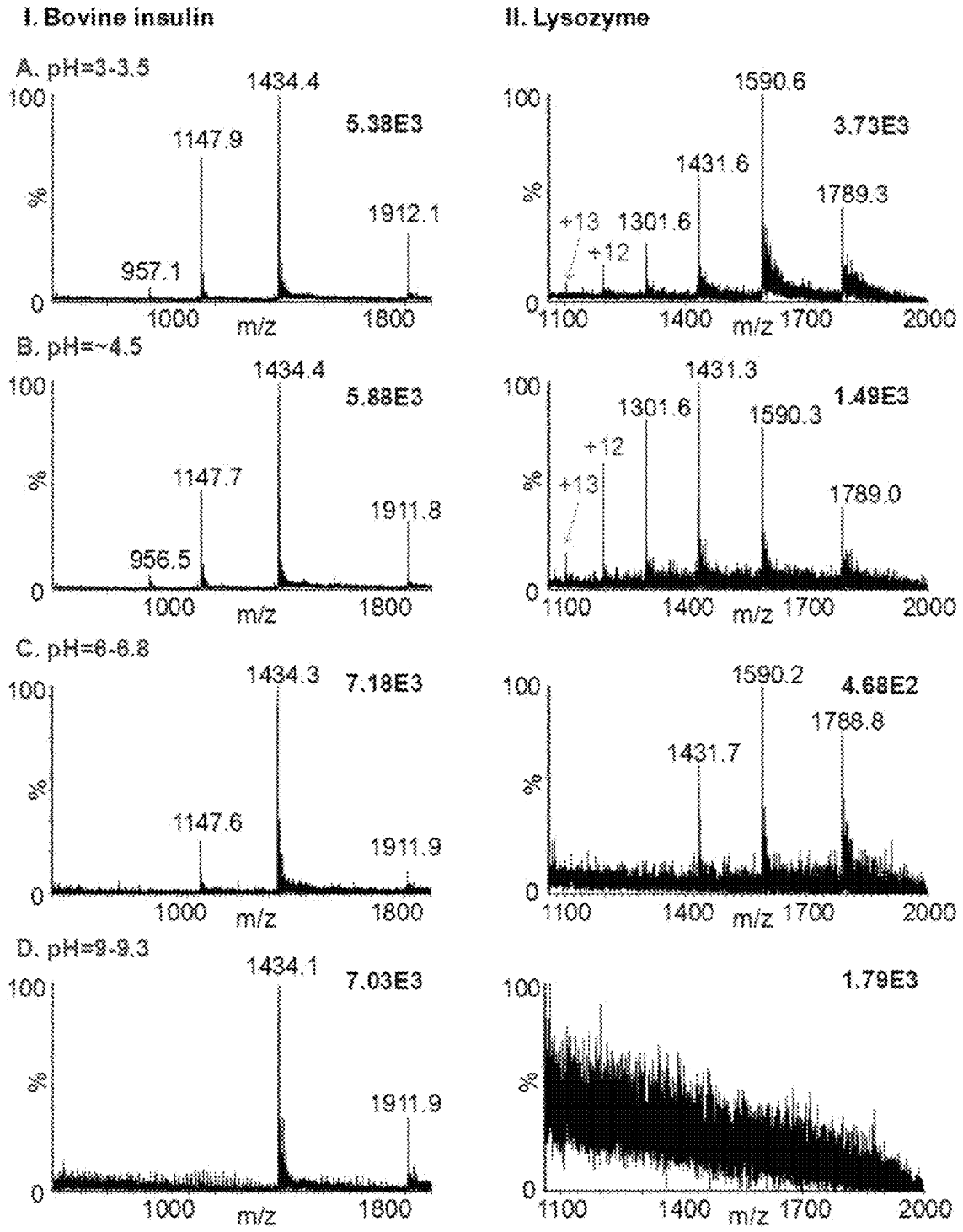
FIG. 37 illustrates the SAII/MS mass spectra of a pH study using bovine insulin and lysozyme using the delivery system in FIG. 30.

FIG. 37 illustrates the SAII/MS mass spectra results of a pH study using bovine insulin and lysozyme, carried out at an inlet temperature of 250° C. The results showed that higher charge state ions were obtained in acidic solutions, and that the highest intensity for the most abundant charge state was obtained at pH 4.5 for (II)(B) lysozyme. Basic pH decreased the charge states of bovine insulin as shown in (I).

Figure 38:
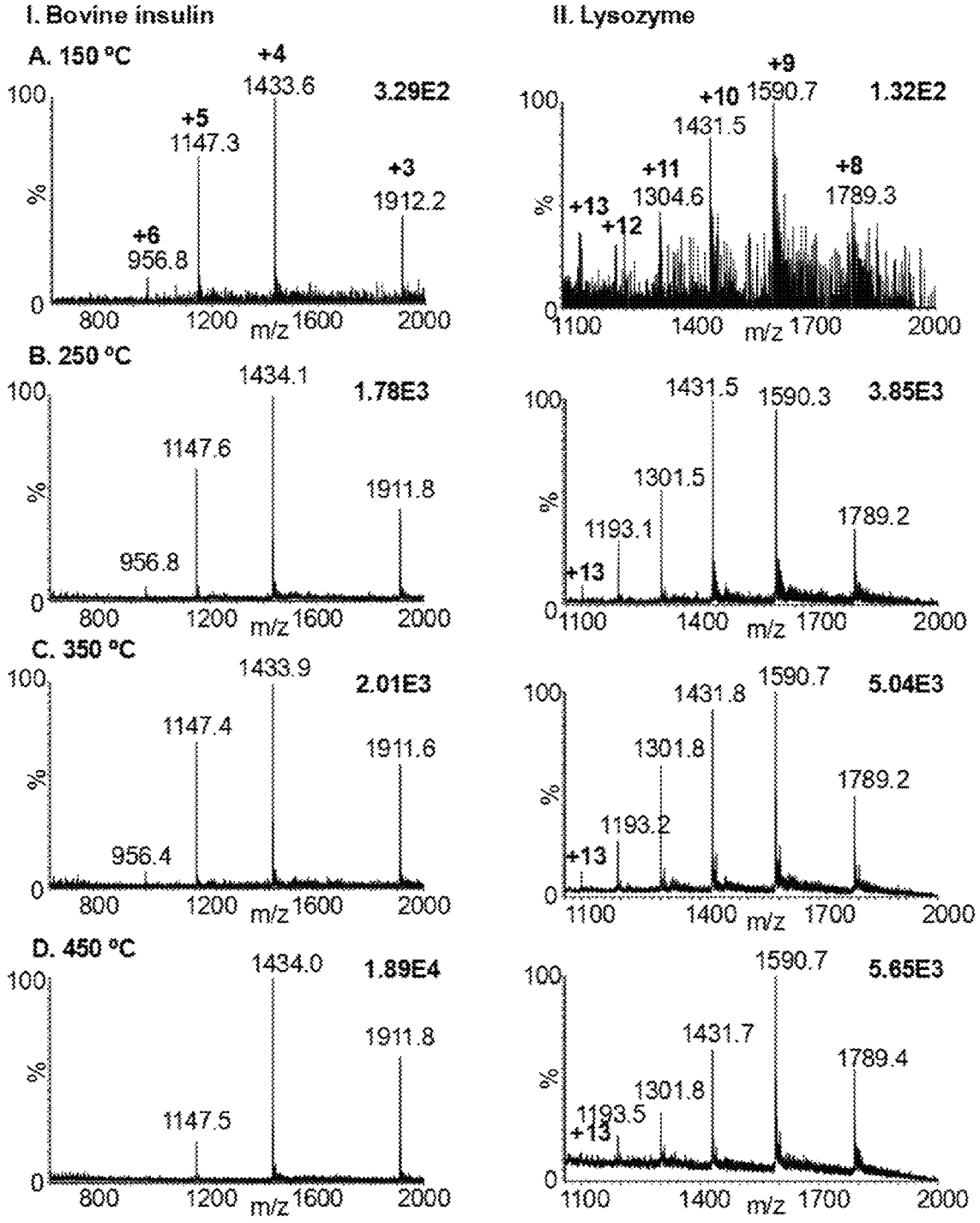
FIG. 38 illustrates the SAII/MS mass spectra of a temperature study using bovine insulin and lysozyme solution using the delivery system in FIG. 30.

FIG. 38 illustrates the SAII/MS mass spectra results of a temperature study using bovine insulin and lysozyme. FIG. 38(I) shows the mass spectra of bovine insulin at 5 pmol μL-1 bovine insulin in 50:50 methanol:water with 1% acetic acid and (II) shows the mass spectra of 10 pmol μL-1 lysozyme in 50:50 acetonitrile:water with 0.1% formic acid at different inlet temperatures: (A) 150° C., (B) 250° C., (C) 350° C., and (D) 450° C. Data were acquired in the m/z range of 150-2000. Similar charge states, but increasing ion abundance were observed at higher temperatures (100° C. increments from 150° C. to 450° C.), as expected from previous SAII studies on an Orbitrap with the solution introduced inside the inlet tube. Over a wide range of temperatures, the method shows analytical utility.

Figure 39:
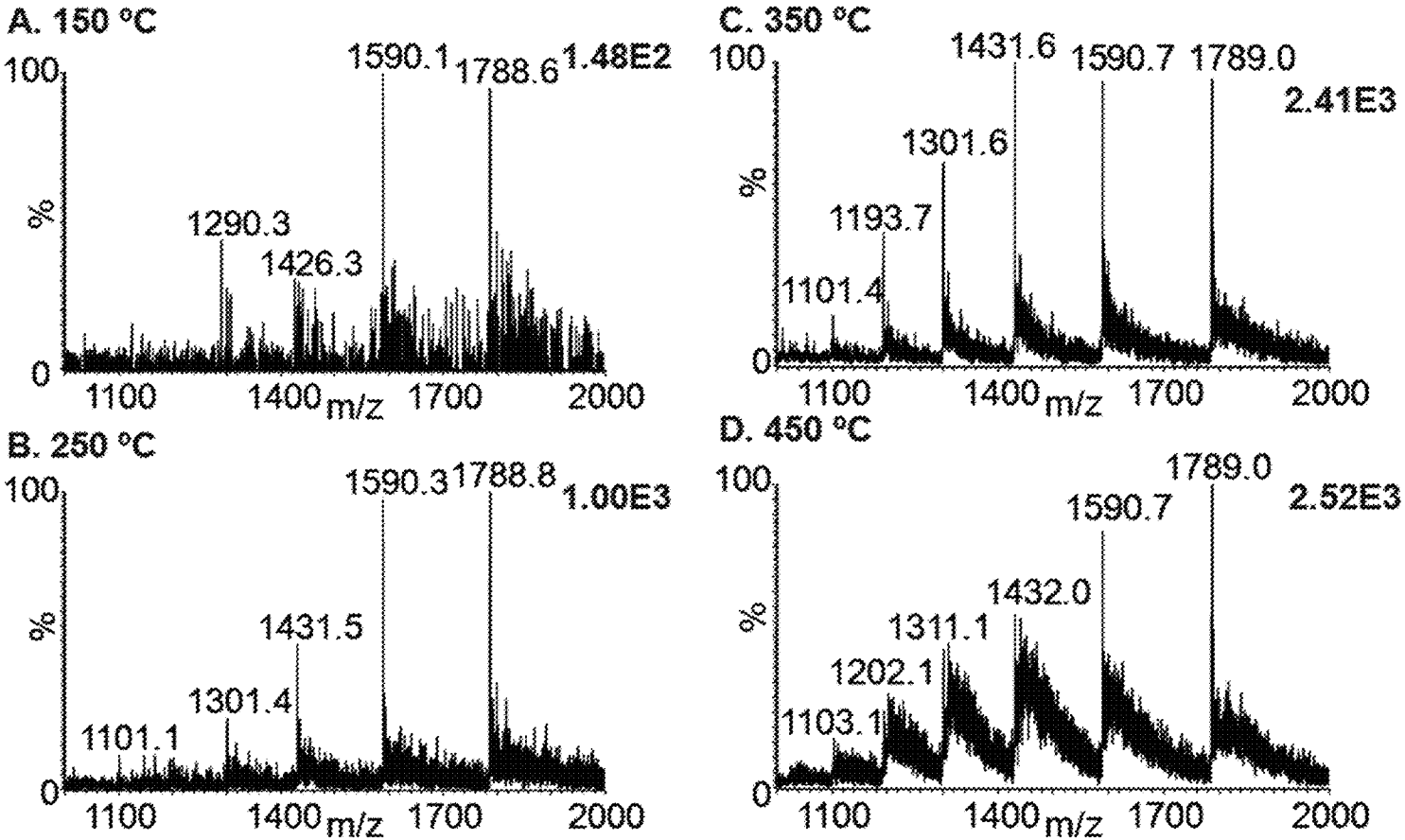
FIG. 39 illustrates the SAII/MS mass spectra of lysozyme at various temperatures in water using the delivery system in FIG. 30.

FIG. 39 illustrates the SAII mass spectra of 10 pmol μL-1 lysozyme in water at inlet temperatures of: (A) 150° C., (B) 250° C., (C) 350° C., and (D) 450° C. when 2 μL of solution was pipetted into the inlet. Data were acquired in the m/z range of 150-2000. FIG. 39 demonstrates that higher temperature is required to produce abundant ions when using a less volatile solvent such as water. However, 'signal tailing' is observed using pure water and at high temperatures, indicating the undesired adduction of sodium cations to the protein. Metal adduction is prevented through the addition of acids as shown in FIG. 38(II).

The results show that although the optimum inlet temperature is somewhat different for certain analytes and sample preparation methods, sufficient ion abundance for analytical utility is obtained over a wide range of conditions using the systems and methods in FIG. 30. As is the case with the traditional methods of ESI and MALDI, smaller molecules are more easily detected than the larger nonvolatile molecules. The optimum inlet temperature is lower than those reported for an Orbitrap Exactive in which solution was introduced inside the mass spectrometer inlet.

Example 2

Multiple Channel Pipet

The initial automation experiment with pipet tips used an eight channel pipet and produced mass spectra results using the systems and methods described in FIG. 31. The setup was designed to operate with the capillary inlet source (i.e. the inlet channel or the transfer tube) of the LTQ Velos.

Figure 40:
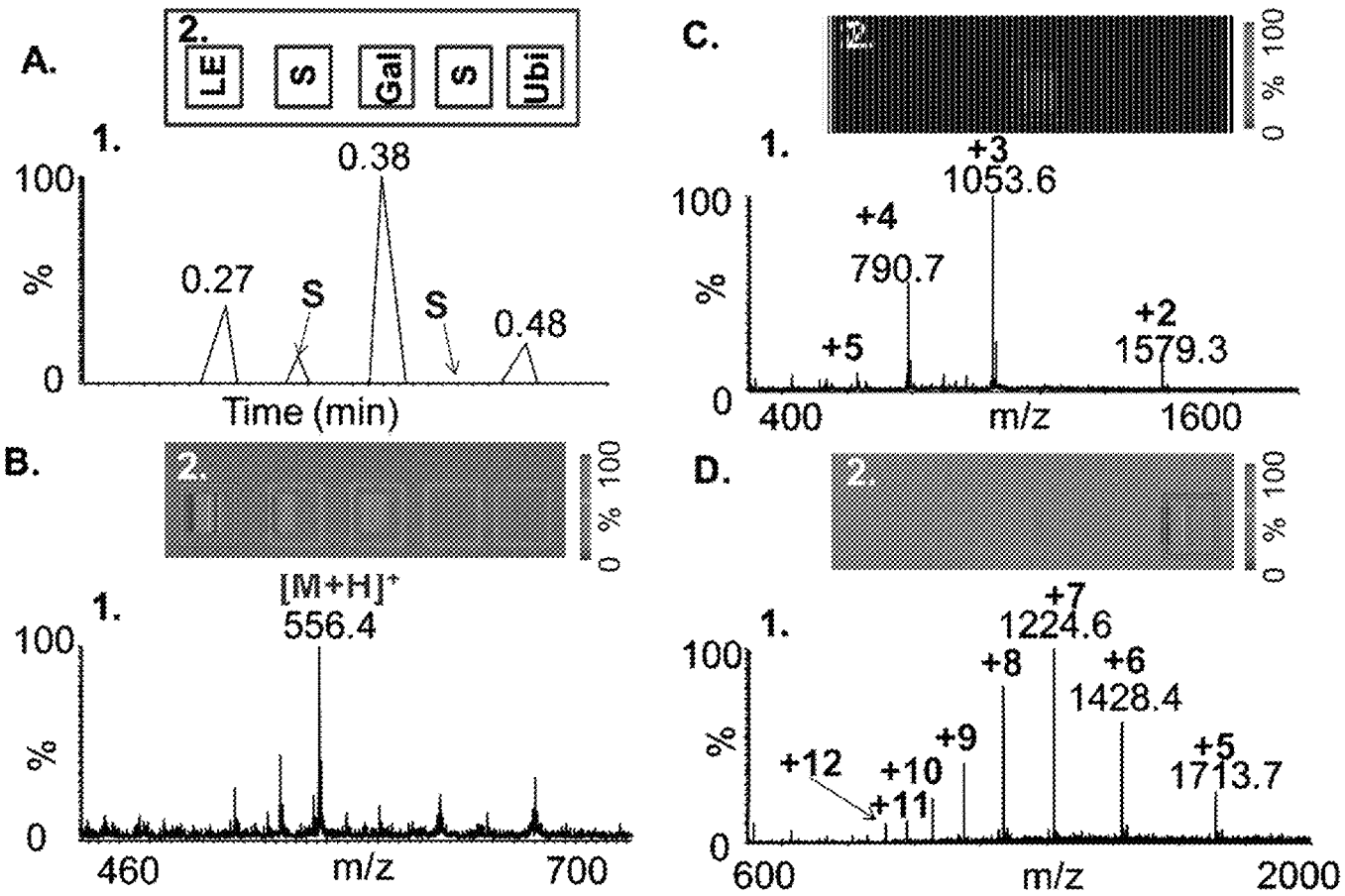
FIG. 40 illustrates the SAII/MS total ion chronogram and mass spectra of analytes leucine enkephalin, galanin, and ubiquitin using the system and method in FIG. 31.

FIG. 40 illustrates the results of multiplexing SAII-MS, using an eight channel pipet. Pipet tips with analyte solution were alternated with pipet tips containing pure solvent between each analyte solution as shown in FIG. 40(A)(2). The eight channel pipet dispenser was fastened to a x,y-stage and each tip was sequentially moved in front of the inlet of the mass spectrometer. The setup was previously aligned so that all pipet tips moved in front of the inlet and within 0.1 mm to 0.5 mm of the inlet aperture. Five tips were analyzed in 15 seconds by moving the stage at 3 mm per second. Separated peaks were observed by plotting the total ion chronogram ("TIC"), from which mass spectra of leucine enkephalin, galanin, and ubiquitin were extracted, as shown in FIG. 40(A). FIG. 40 also shows (1) mass spectra and (2) mapping of the location of individual analytes. Three microliters of solution, each containing (B) leucine enkephalin at 2.5 pmol μL-1, (C) galanin at 1 pmol μL-1, and (D) ubiquitin at 1 pmol μL-1 were simultaneously drawn from multisample well plates into different pipet tips. FIG. 40(B)(1)-(D)(1) show that good ion abundance was observed for each sample without cross-contamination. The Biomap software displayed the location of any selected m/z in the multisample well plate. The imaging results are exemplified in FIG. 40(B)(2)-(D)(2) for leucine enkephalin (+1, m/z 556), galanin (+3, m/z 1053), and ubiquitin (+7, m/z 1224) using a 150° C. inlet temperature.

Figure 41:
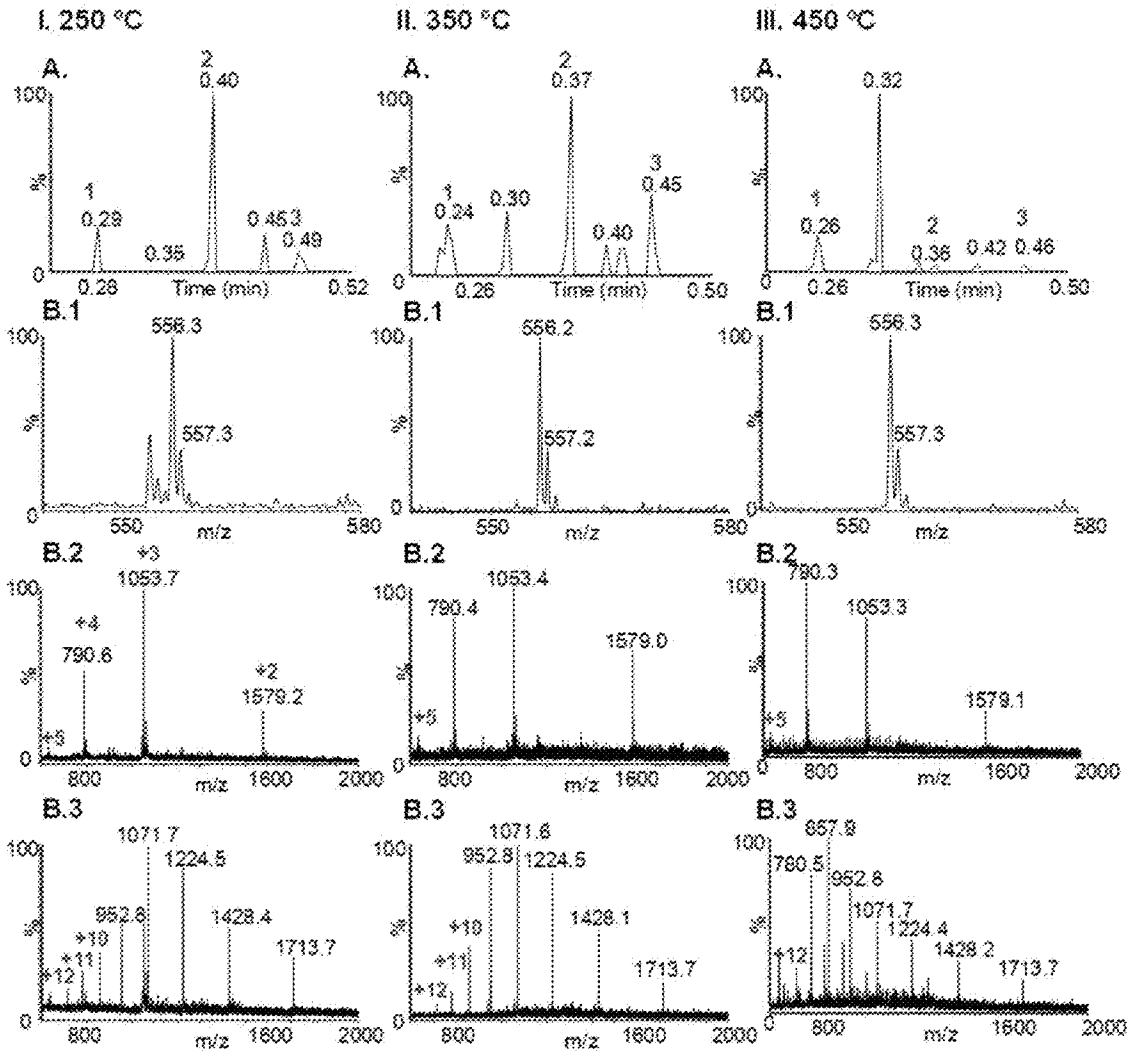
FIG. 41 illustrates the SAII/MS mass spectra of leucine enkephalin, galanin, and ubiquitin tested at different inlet temperatures using the system and method in FIG. 31.

FIG. 41 shows the SAII-MS mass spectra from the same set of analytes (leucine enkephalin, galanin, and ubiquitin) were similar when tested at different inlet temperatures (I) 250° C., (II) 350° C., and (III) 450° C. in a total of 15 seconds. Split peaks were observed in the TIC at 350° C. and 450° C. because the pipet tips needed to be further from the heated inlet to prevent the pipet tips from melting. Pipet tip melting caused the solutions to be drawn inconsistently and slowly, consequently, droplets were drawn into the inlet instead of a liquid stream. FIG. 41(A) shows the TIC and (B) mass spectra of the analysis of tips filled with (1) 2.5 pmol μL-1 leucine enkephalin, (2) 1 pmol μL-1 galanin, and (3) 1 pmol μL-1 ubiquitin with solvent between each of two samples. Two microliters of analyte or solvent was drawn into each pipet tip. The maximum injection time was 100 milliseconds and data were acquired in the m/z range of 150-2000.

With the setup described above, the pipet tip size was not critical, but the smaller tips were more difficult to align properly with the inlet. The speed of the x,y-stage had little impact for any given size of pipet tips tested. As soon as the solution was exposed to the vacuum, it was drawn into the mass spectrometer.

Figure 42:
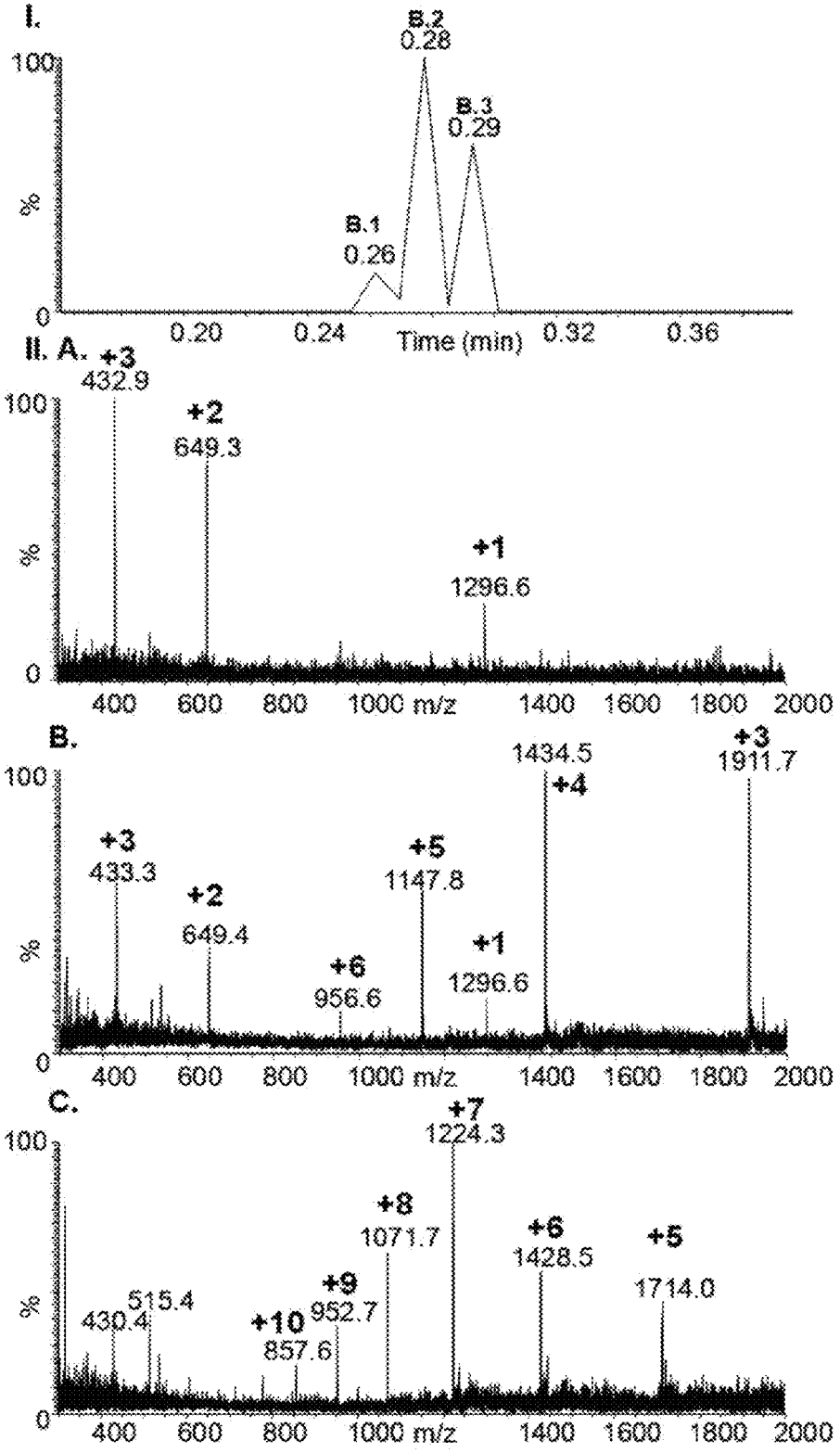
FIG. 42 illustrates the SAII/MS mass spectra of angiotensin I, bovine insulin, and ubiquitin using the system and method in FIG. 31.

The rate of analyses can be paced by adjusting the movement of the x,y-stage and can be as short as one sample per second, accepting some cross-contamination between samples. In principle, one could also actively stop the x,y-stage movement at the expense of time requirements. FIG. 42 illustrates the SAII/MS mass spectra data for three analytes (angiotensin I, bovine insulin, and ubiquitin) at an inlet temperature of 150° C. in only two seconds per sample with some acceptable carry-over between samples. For high throughput screening, this performance may already be sufficient. FIG. 42(I) shows the TIC of 5 tips filled with angiotensin 1, bovine insulin, and ubiquitin with pure solvent between each of two analytes. FIG. 42(II) shows mass spectra extracted from (A) 0.26 (minutes) min for 1 pmol $\mu L^{-1}$ angiotensin I, (B) 0.28 min for 5 pmol $\mu L^{-1}$ bovine insulin with some angiotensin I cross-contamination, and (C) 0.29 min for 1 pmol $\mu L^{-1}$ ubiquitin. For this experiment, 2.5 μL of analyte or solvent was drawn into each pipet tip.

The maximum injection time was 500 milliseconds and data were acquired in the m/z range of 150-2000.

Figure 43:
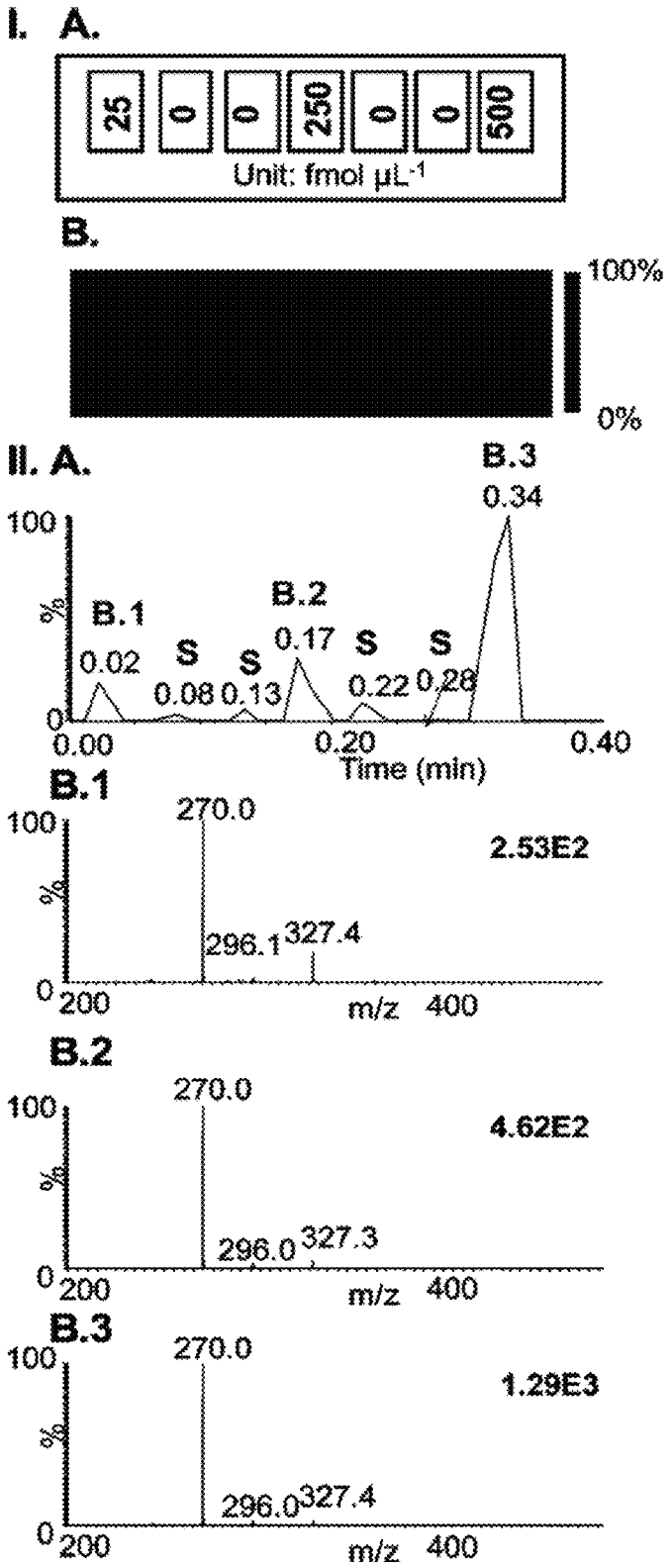
FIG. 43 illustrates the SAII/MS/MS total ion chronogram and mass spectra of clozapine using different concentrations with the system and method in FIG. 31.

Using this construction, three solutions of an antipsychotic drug clozapine at 25 femtomoles per microliter (fmol μL-1), 250 fmol μL-1, and 500 fmol μL-1 were mapped for relative amounts as indicated in FIG. 43. Two solvents were used between each two analyte solutions. The pipet tips were filled with clozapine solutions of different concentration or pure methanol solvent. FIG. 43(I) illustrates (A) a schematic representation of the content of each pipet tip. Boxes labeled with numerical values indicate tips filled with 2 μL clozapine solutions at concentrations of 25 fmol μL-1, 250 fmol μL-1, and 500 fmol μL-1, respectively; and boxes labeled with "0" represent pure solvent methanol. MS/MS was used to enhance the specificity of the experiment. The protonated ion (m/z 327) was selected and fragmented by CID. The mass spectral data of the transition 327→270, was visualized by a mapping display using Biomap. FIG. 43(I)(B) illustrates the mapping of the m/z 270 peak. A color trace correctly displayed the location of the analytes with little or no carryover in the methanol acquisitions. The color code also reflected the relative analyte concentration, with blue at lower concentrations and red at higher concentrations (color not shown). FIG. 43(II) shows (A) the TIC and (B) the mass spectra extracted from (1) 0.02 min, (2) 0.17 min, and (3) 0.34 min of the TIC. Data were acquired in the m/z range of 200-500.

Figure 44:
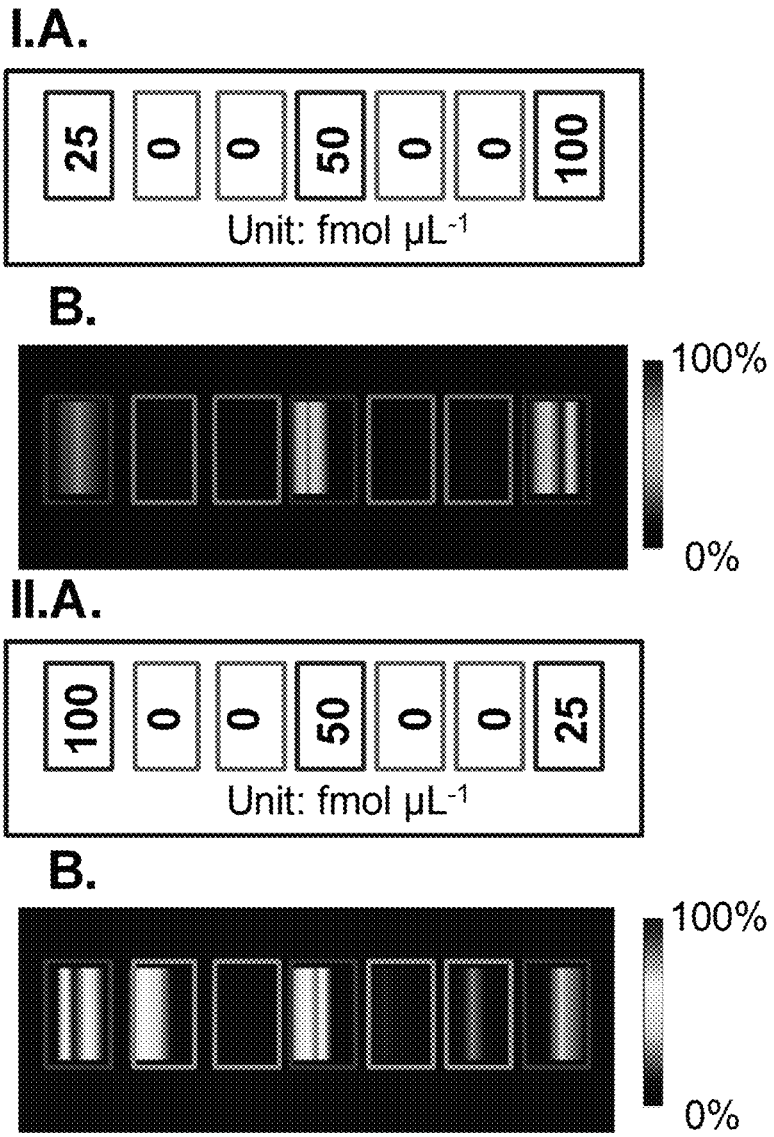
FIG. 44 illustrates the SAII/MS visual mapping using the system and method in FIG. 31.

The mapping display of the methanol solutions in FIG. 44 suggested that more concentrated samples may have an effect on less concentrated samples. FIG. 44 illustrates visual mapping using the eight channel pipet. The solutions were scanned (I) from low concentrations to high concentrations, and (II) from high concentrations to low concentrations. FIG. 44 illustrates (A) a schematic representation of content in each pipet tip. Boxes labeled with numerical values indicate tips filled with 2 μL clozapine solutions at 25 fmol $\mu L^{-1}$, 50 fmol $\mu L^{-1}$, and 100 fmol $\mu L^{-1}$, respectively; and boxes labeled with "0" represent pure solvent methanol; FIG. 44(B) shows the mapping of the m/z 270 peak. Note that the methanol solutions furthest to the right in (I) and (II) are more intense than the prior methanol solutions (second to the last), suggesting that carryover for the sample is negligible in both cases (sample solutions furthest to the right). Data were acquired in the m/z range of 90-345.

Figure 45:
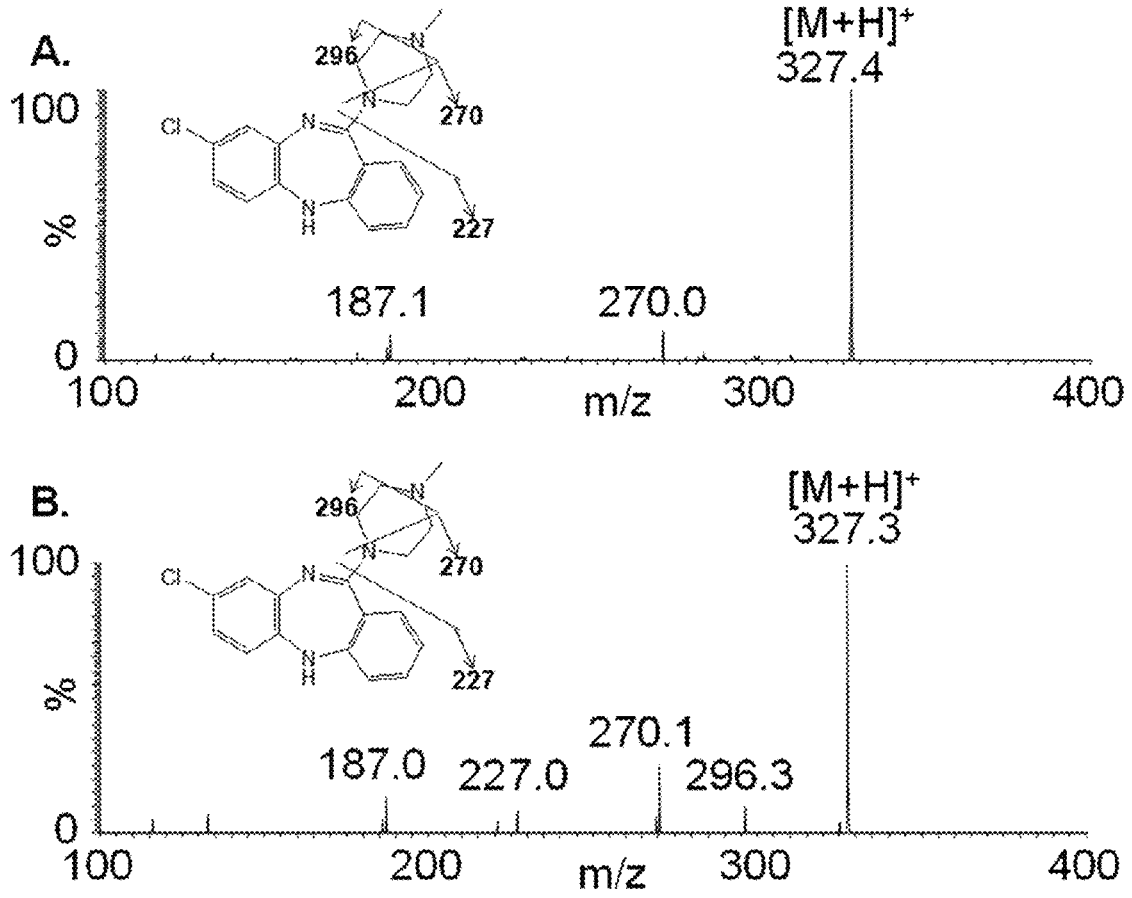
FIG. 45 illustrates the SAII/MS/MS mass spectra of clozapine using the system and method in FIG. 31.

If necessary, more pure methanol solutions can be employed to reduce cross-contamination between samples for quantitative analyses. Using this approach, a 1 μL solution of 1 fmol μL-1 clozapine was readily detected as shown in FIG. 45. The protonated ions were selected and fragmented by CID using normalized collision energy of 30 and the maximum injection time was 100 milliseconds. FIG. 45 illustrates mass spectra from analysis of (A) 1 μL of 1 fmol μL-1 clozapine and (B) 3 μL of 0.5 fmol μL-1 clozapine drawn into the pipet tip. The inlet temperature was 250° C. and data were acquired in the m/z range of 100-400. Results showed that the automated method is sensitive, rapid, simple, and robust and can characterize small and large molecules.

Figure 46:
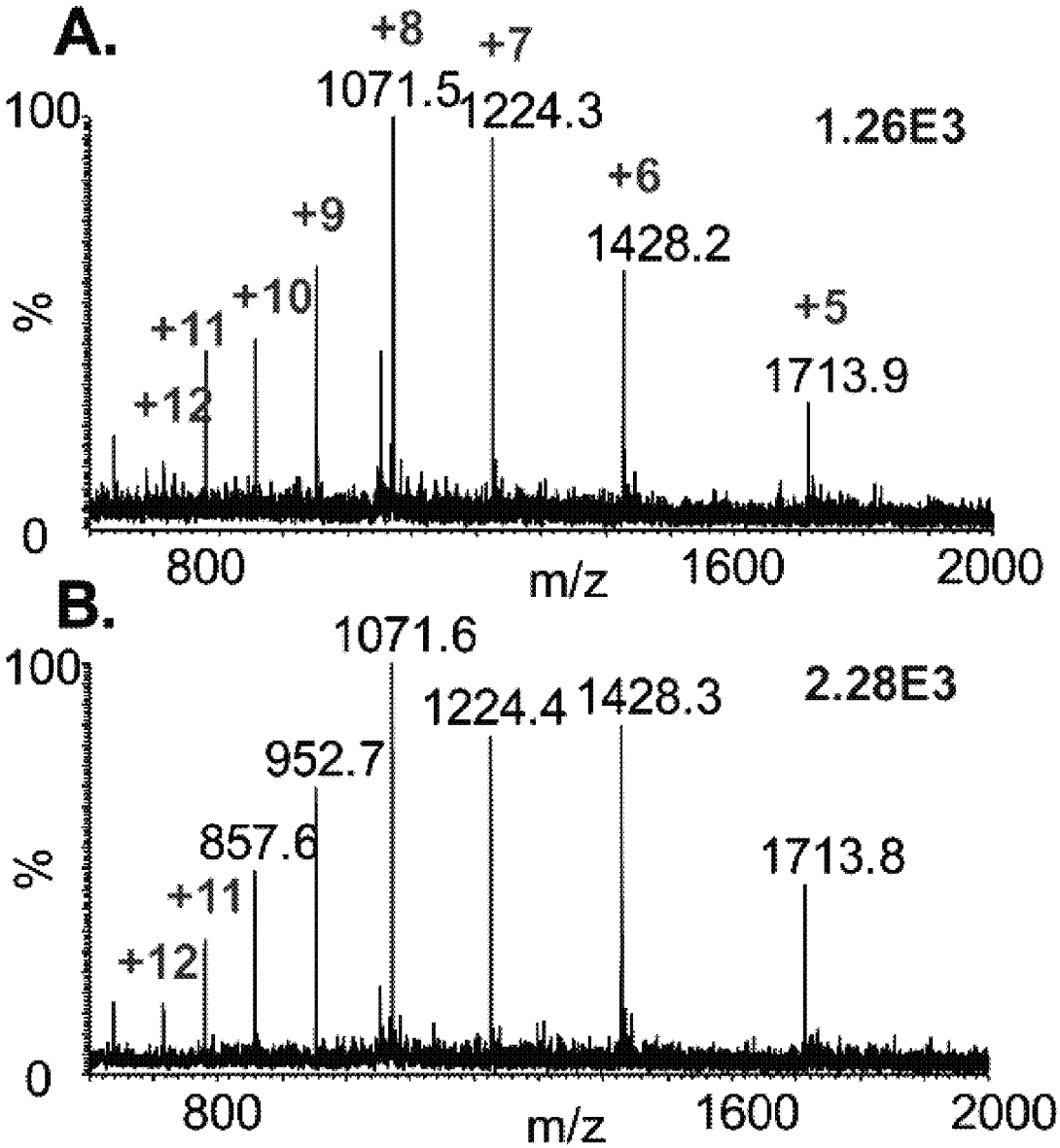
FIG. 46 illustrates the SAII/MS/MS mass spectra of ubiquitin using manually pipetting compared to vacuum drawing.

FIG. 46 shows that introducing the same amount of ubiquitin (3 μL) by either (A) manually injecting or (B) vacuum drawing produced nearly identical results. SAII mass spectra of ubiquitin was generated at an inlet temperature of 250° C. and data were acquired in the m/z range of 150-2000.

A pipet tip-to-inlet distance of approximately 0.5 mm allowed solution transfer, without the concern that the pipet tip would melt at higher inlet temperatures; but increasing distance beyond this, made drawing the entire content of each pipet tip problematic. The sample can only be dispensed for ionization when the pipet tip is close to the inlet aperture. This setup provides a simple means for high throughput sampling by making use of the existing mass spectrometer vacuum for sample introduction.

Figure 47:
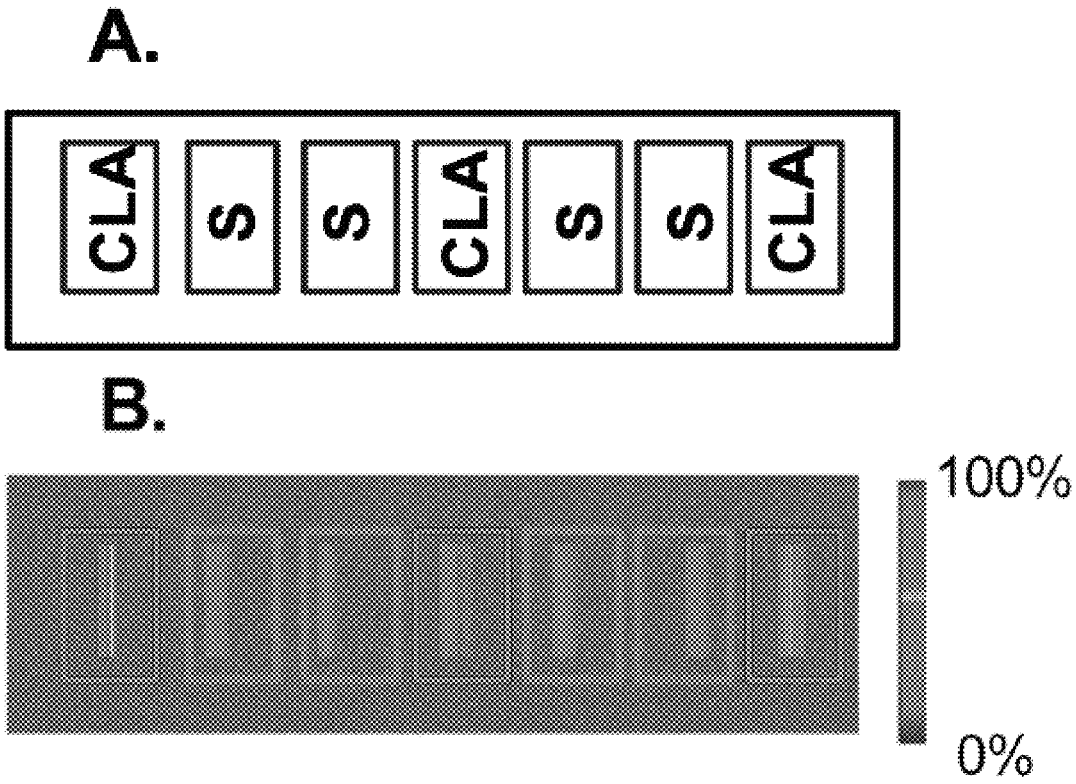
FIG. 47 illustrates mapping of clarithromycin from tablet form in a 384-microtiter plate using the system and method in FIG. 31.

Higher capacity microtitre plates are widely used in the pharmaceutical industry. A 384-well plate was used to analyze the drug clarithromycin in tablet form obtained from a local pharmacy. Random amounts of tablet powder were dissolved and diluted in the microtitre plate wells, and analyzed using CID by introducing the solution using the eight channel pipet approach as described in FIG. 31. The major fragment ion at m/z 590 was mapped using Biomap software. The map correctly displayed the locations where drug was present. The first well with the first sample contained the highest amount of tablet and the fourth well with the second sample contained the least, based on the color code of the map. FIG. 47(A) illustrates a schematic representation of the content of each pipet tip. Boxes labeled with "CLA" indicate tips filled with solutions containing the clarithromycin tablet; and boxes labeled with "S" represent the pure solvent, methanol. FIG. 47(B) illustrates the mapping of a major fragment at m/z 590.3. Data were acquired in the m/z range of 205-1000.

Quantitative Results for SAII Using an Eight Channel Pipet

Figure 48:
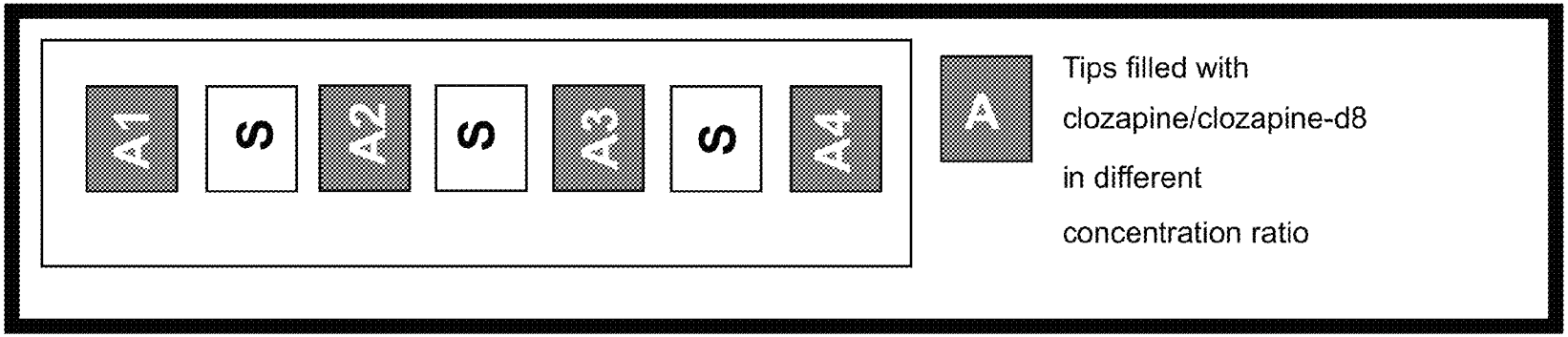
FIG. 48 illustrates a schematic representation of six pipet tips containing four analyte solutions at varying concentration ratios of clozapine/clozapine-d8 analyzed using the system and method in FIG. 31.

For evaluation of quantitative results from the automated multiplexing SAII systems and methods, an eight channel pipet was used on a x,y-stage. Pipet tips were filled with sample solution of clozapine/clozapine-d8 in different concentration ratios. FIG. 48 illustrates a schematic representation of the content of each of six pipet tips. Pipet tips contained four analyte solutions at concentration ratios of A1=0:1, A2=0.4:1, A3=1:1, and A4=2:1, respectively, with pure solvent between each analyte solution.

Figure 49:
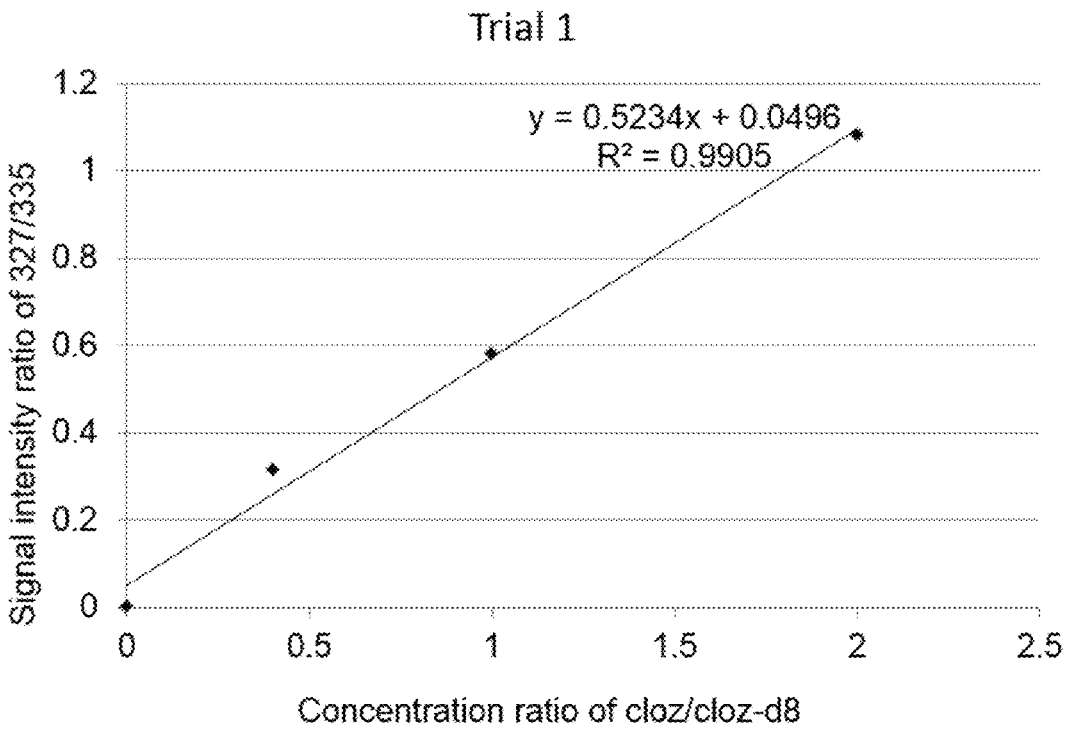
FIG. 49 illustrates the calibration curve generated from four analyte concentration ratios of clozapine/clozapine-d8 from trial 1 using the system and method in FIG. 31.
Figure 50:
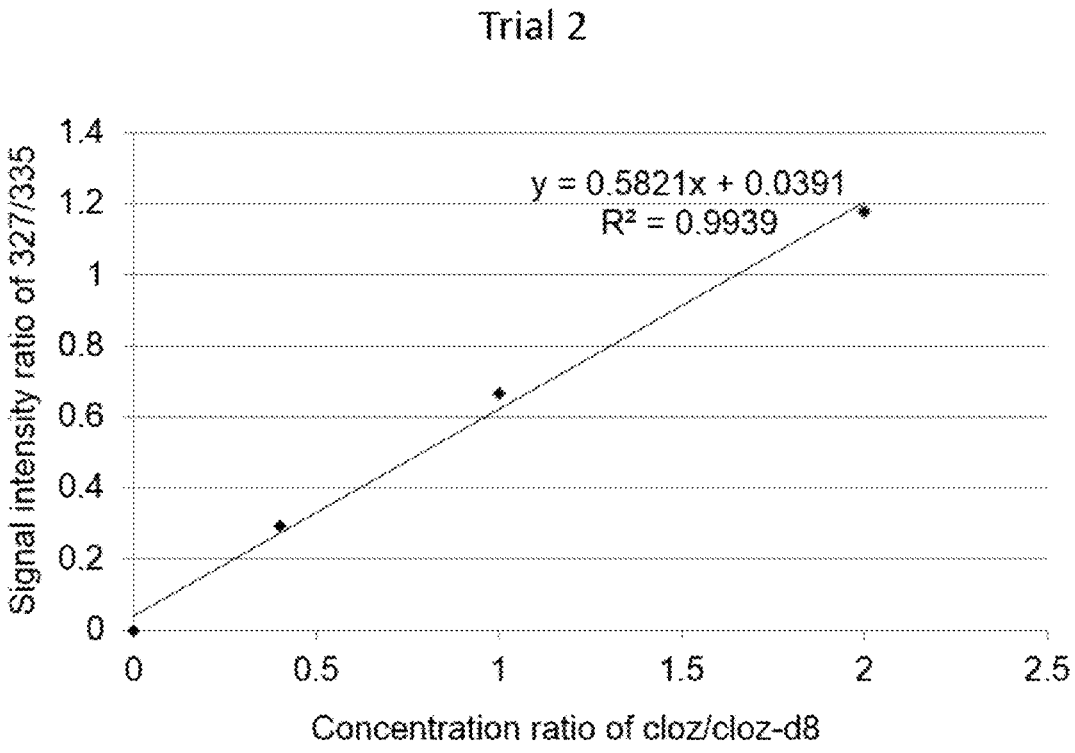
FIG. 50 illustrates the calibration curve generated from four analyte concentration ratios of clozapine/clozapine-d8 from trial 2 using the system and method in FIG. 31.
Figure 51:
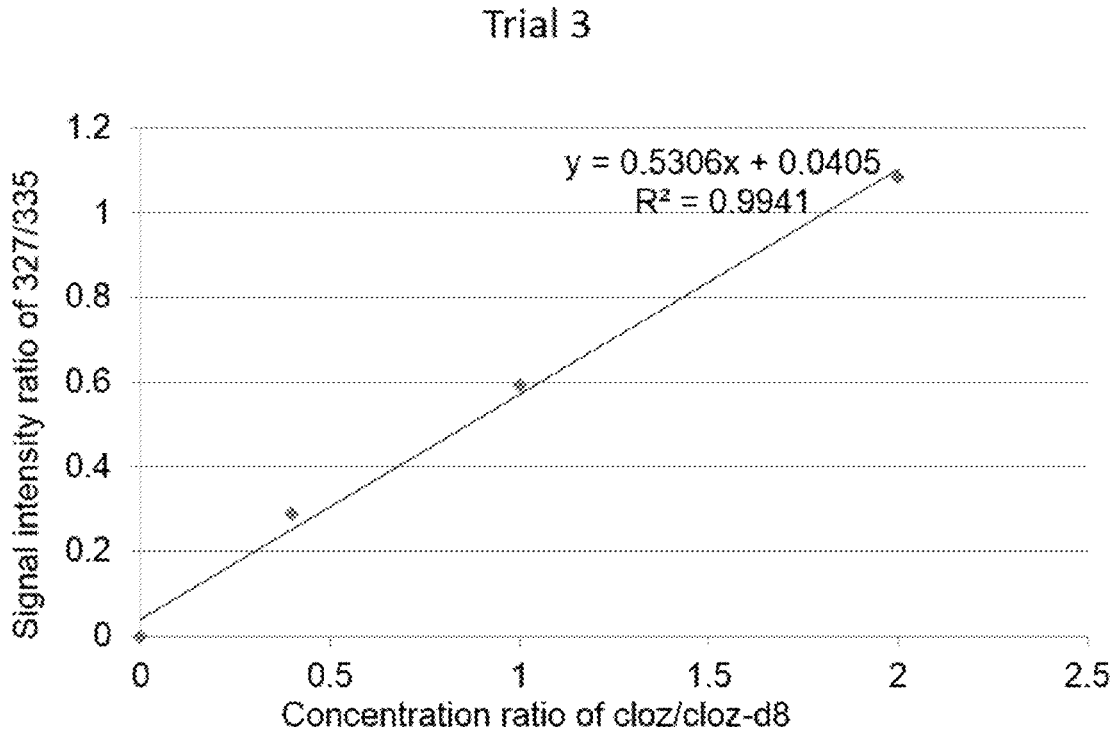
FIG. 51 illustrates the calibration curve generated from four analyte concentration ratios of clozapine/clozapine-d8 from trial 3 using the system and method in FIG. 31.
Figure 52:
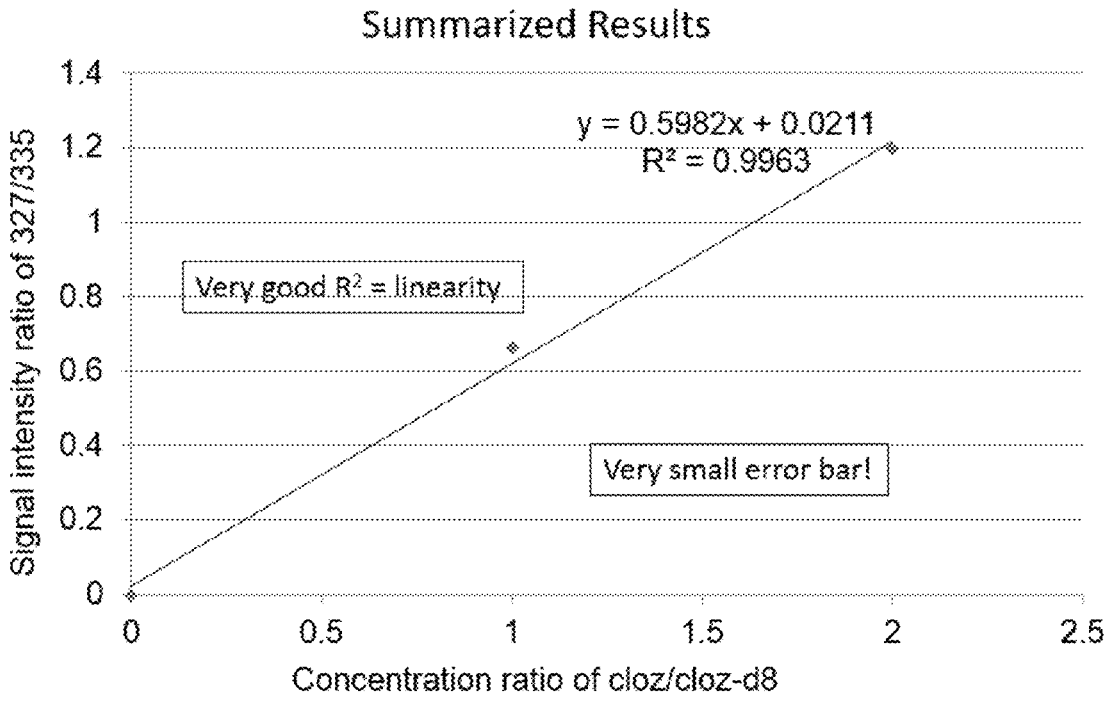
FIG. 52 illustrates the calibration curve generated from the average of the measurements and standard deviations from the three trials of four analyte concentration ratios of clozapine/clozapine-d8 using the system and method in FIG. 31.

FIG. 49, FIG. 50 and FIG. 51 show the calibration curves resulting from three different trials using the format from FIG. 48, with the clozapine/clozapine-d8 concentration ratio plotted on the x-axis compared to the signal intensity ratio at m/z ratio of 327/335 plotted on the y-axis. FIG. 52 summarizes the results of the three trials, showing the calibration curve based on average measurements obtained for each concentration ratio, and their respective standard deviations.

Figure 53:
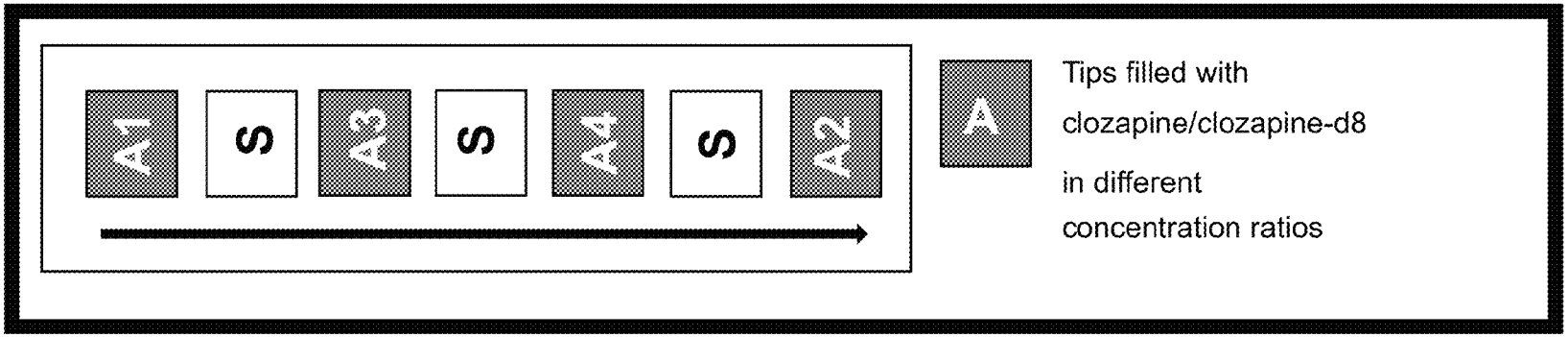
FIG. 53 illustrates a schematic representation of the content of six pipet tips containing four analyte solutions, including an unknown analyte, at varying concentration ratios of clozapine/clozapine-d8 analyzed using the system and method in FIG. 31.

FIG. 53 illustrates the experimental design for identifying an unknown concentration ratio for an analyte. Pipet tips were filled with sample solution of clozapine/clozapine-d8 in different concentration ratios. FIG. 53 illustrates a schematic representation of the content of each of six pipet tips. Pipet tips contained four analyte solutions at concentration ratios of A1=0:1, A2=0.4:1, A3=2:1, and A4=1:1, respectively, with pure solvent between each analyte solution. The "Unknown" concentration ratio was 0.4:1 of analyte solution A2.

Figure 54:
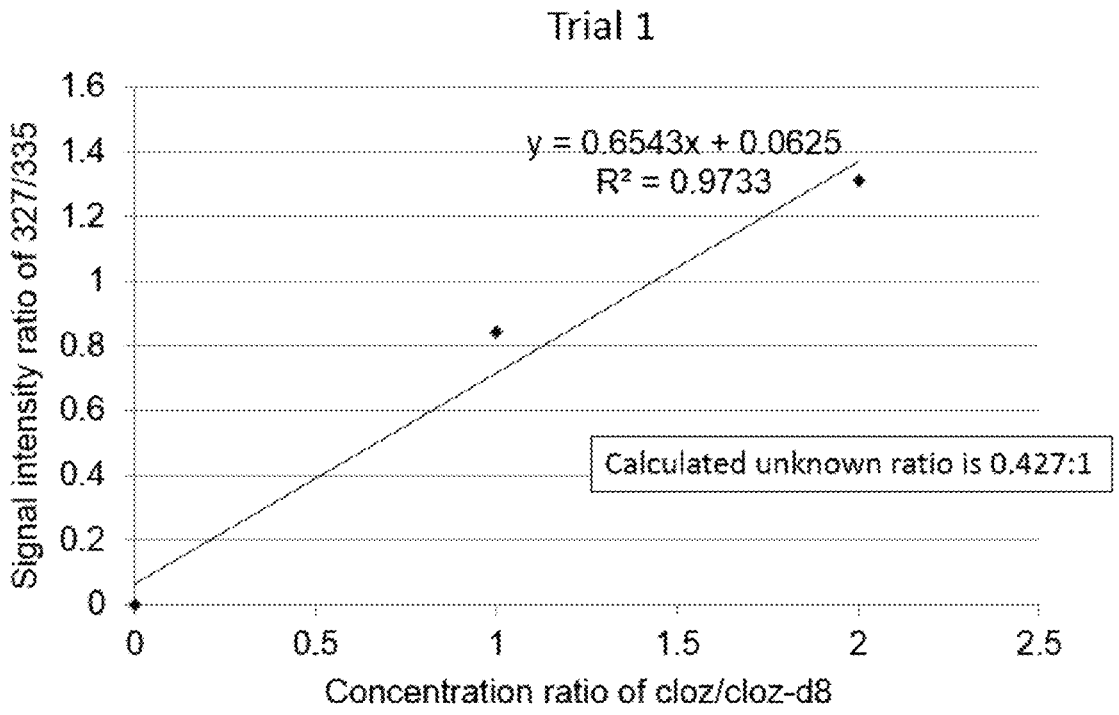
FIG. 54 illustrates the calibration curve generated from four analyte concentration ratios of clozapine/clozapine-d8, including an unknown, from trial 1 using the system and method in FIG. 31.
Figure 55:
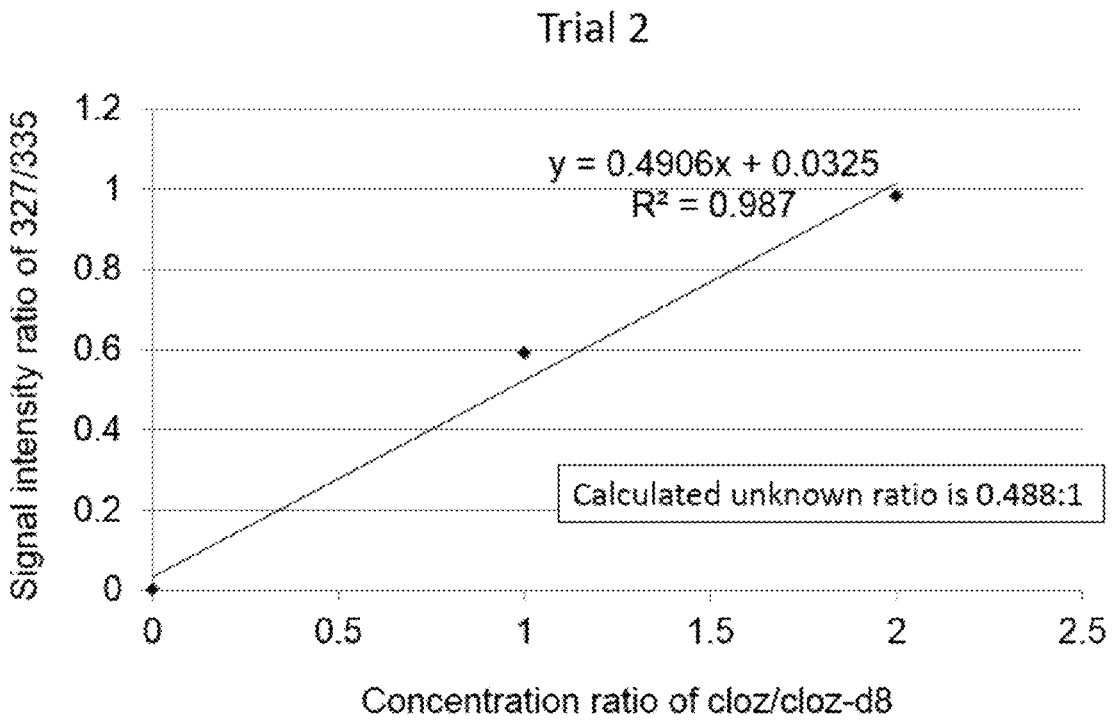
FIG. 55 illustrates the calibration curve generated from four analyte concentration ratios of clozapine/clozapine-d8, including an unknown, from trial 2 using the system and method in FIG. 31.
Figure 56:
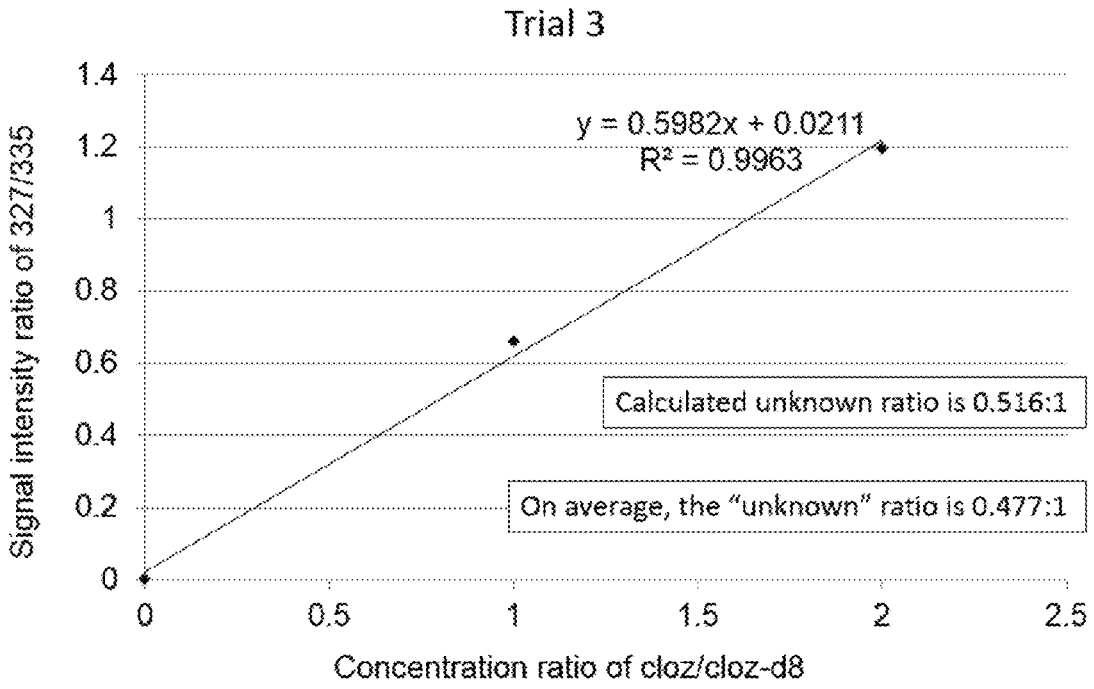
FIG. 56 illustrates the calibration curve generated from four analyte concentration ratios of clozapine/clozapine-d8, including an unknown, from trial 3 using the system and method in FIG. 31.

FIG. 54, FIG. 55, and FIG. 56 show the calibration curves resulting from three different trials using the format from FIG. 53, with the clozapine/clozapine-d8 concentration ratio plotted on the x-axis compared to the signal intensity ratio at m/z ratio of 327/335 plotted on the y-axis. In each trial, the unknown ratio was determined. The average of the clozapine/clozapine-d8 concentration ratios calculated for the "unknown" sample was 0.477:1.

Example 3

Multiple Pipet Tip Holder

The automation experiments analyzing an increased number of samples, using pipet tips in a multiple pipet tip holder, employed the systems and methods described in FIG. 32. The number of samples which could be analyzed in a single automated analysis was extended using a commercial 96-pipet holder which held pipet tips for sampling 96-well plates. Only 84 samples of the possible 96 positions were in the range of the x,y-stage motion because of the physical limitations of the x,y-stage relative to the mass spectrometer inlet. For sample loading, pipet tips were placed into the well of a multi-sample plate containing the various solutions, and capillary action loaded the pipet tips with approximately the same volume of each solution or solvent, provided the solvents used were of approximately the same composition, especially with regards to water content. Approximately 3 μL were drawn into each of the pipet tips based on a 1:1 acetonitrile:water solution and the pipet tips used in the experiment. Different pipet tips are expected to load different volumes. Higher viscosity solvents, such as water, were more problematic using this approach; consequently, organic solvents such as acetonitrile or methanol were added to lower viscosity. Again, to avoid the possibility of carry-over, solvent was placed between any two samples.

Figure 57:
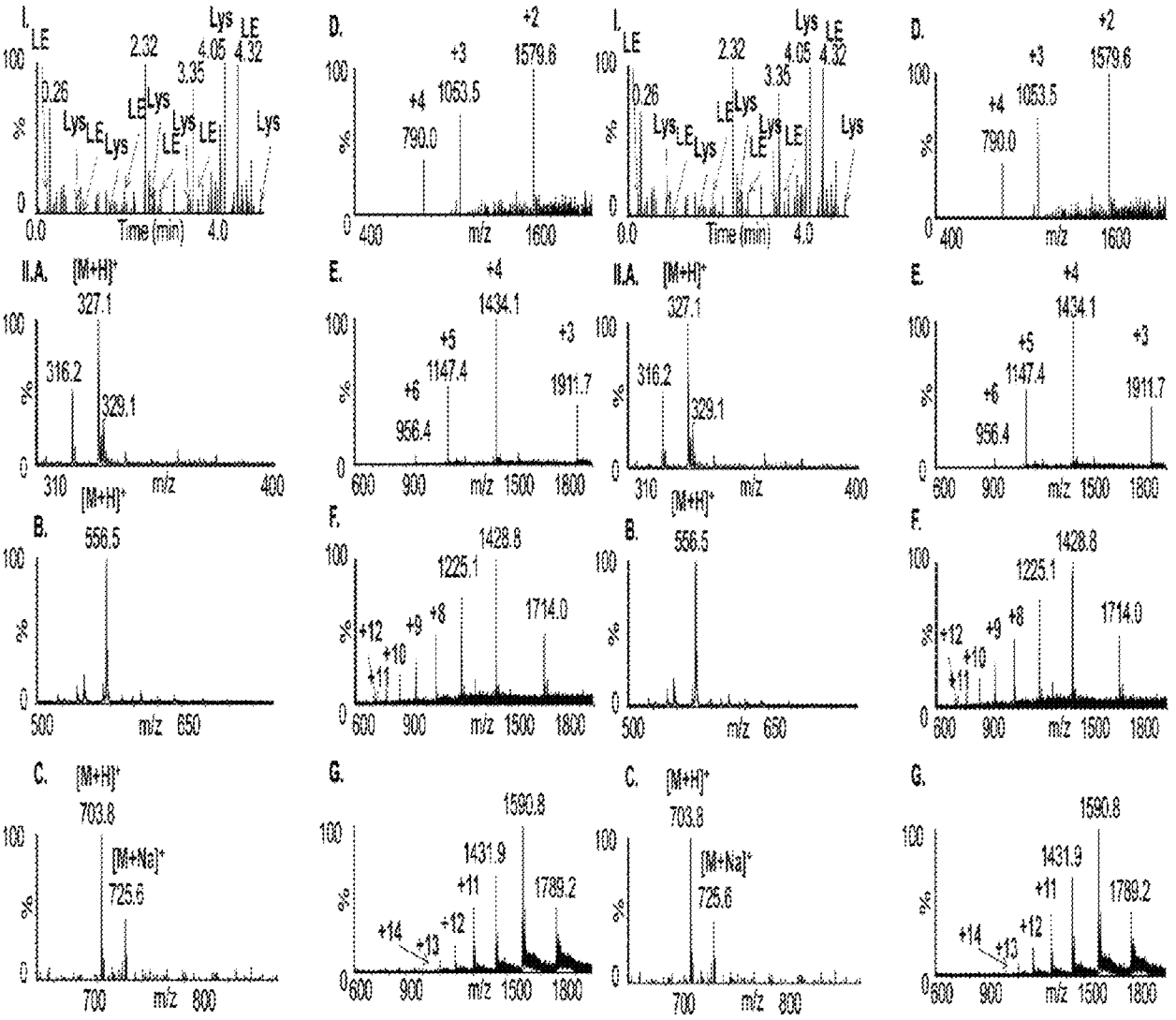
FIG. 57 illustrates the total ion chronogram and SAII/MS mass spectra of clozapine, leucine enkephalin, sphingomyelin, galanin, ubiquitin, and lysozyme using the system and method in FIG. 32.
Figure 58:
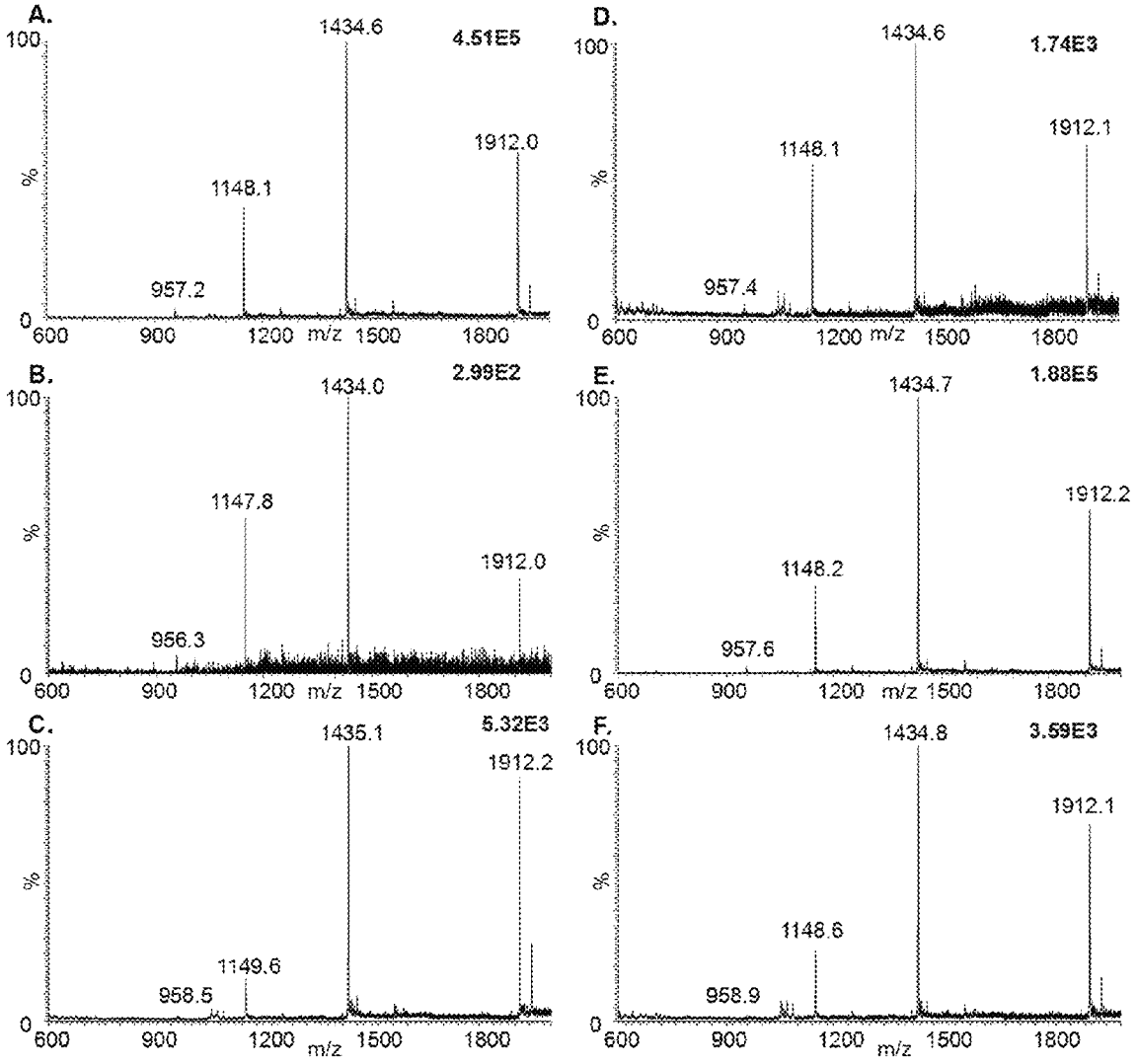
FIG. 58 illustrates SAII/MS mass spectra for bovine insulin extracted from six cycles using the system and method in FIG. 32.

FIG. 57 shows a typical TIC in which 42 tips out of 84 were analyzed with seven different analyte solutions, providing six analyses of each solution. This corresponds to 1 sample per 5 seconds for the analyses of liquid samples using this approach. Individual mass spectra of clozapine, leucine enkephalin, sphingomyelin, galanin, bovine insulin, ubiquitin, and lysozyme were observed with little or no cross-contamination. Because of multiple charging, proteins can also be analyzed on a limited m/z mass spectrometer. The minimal chemical background allows small and large molecules to be characterized at sub-picomole concentrations using an inlet temperature of 250° C. The results of FIG. 57 were generated using 84 tips mounted on a 96-pipet tip holder with an inlet temperature of 250° C., and acquired in 5 min. FIG. 57 illustrates (I) the TIC and (II) mass spectra of (A) 1 pmol μL-1 clozapine in methanol, (B) 2.5 pmol μL-1 leucine enkephalin in acetonitrile:water with formic acid, (C) 1 pmol μL-1 sphingomyelin in methanol with acetic acid, (D) 1 pmol μL-1 galanin in acetonitrile:water with formic acid, (E) 5 pmol μL-1 bovine insulin in methanol:water with acetic acid, (F) 1 pmol μL-1 ubiquitin in acetonitrile:water with formic acid, and (G) 10 pmol μL-1 lysozyme in acetonitrile:water with formic acid. Data were acquired in the m/z range of 150-2000. All six mass spectra for bovine insulin, at 5 pmol μL-1 in methanol:water with acetic acid, extracted from each cycle are displayed in FIG. 58, showing poor reproducibility as indicated by the ion intensity. We attribute this to the difficulty with our home-built approach to properly align all 84 pipet tips in the same position relative to the inlet aperture. The results of FIG. 58 were generated using an inlet temperature of 250° C. and data acquired in the m/z range of 150-2000. The numbers in the top right corners indicate the ion intensity.

Figure 59:
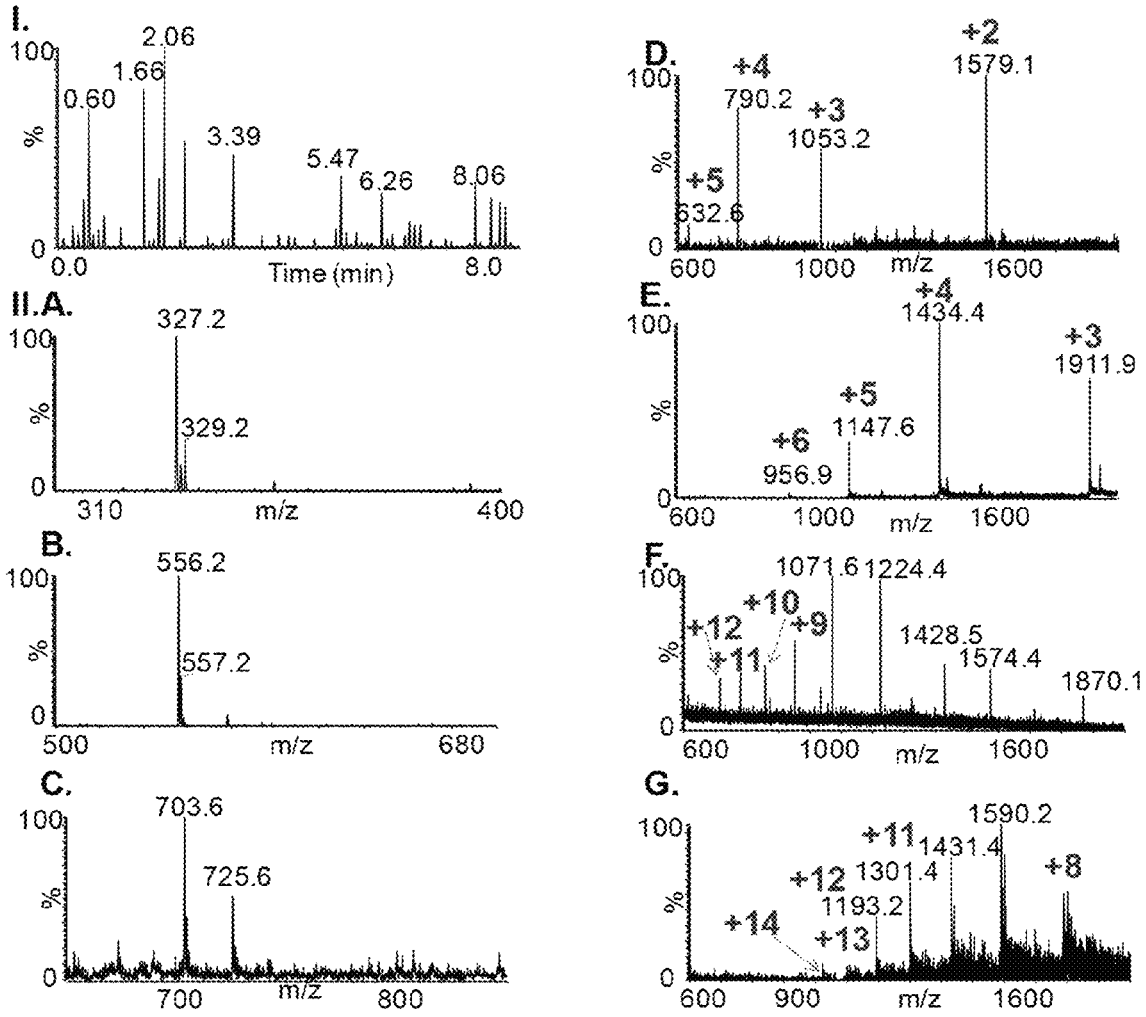
FIG. 59 illustrates the total ion chronogram and SAII/MS mass spectra for of clozapine, leucine enkephalin, sphingomyelin, galanin, ubiquitin, and lysozyme using the system and method in FIG. 32.
Figure 60:
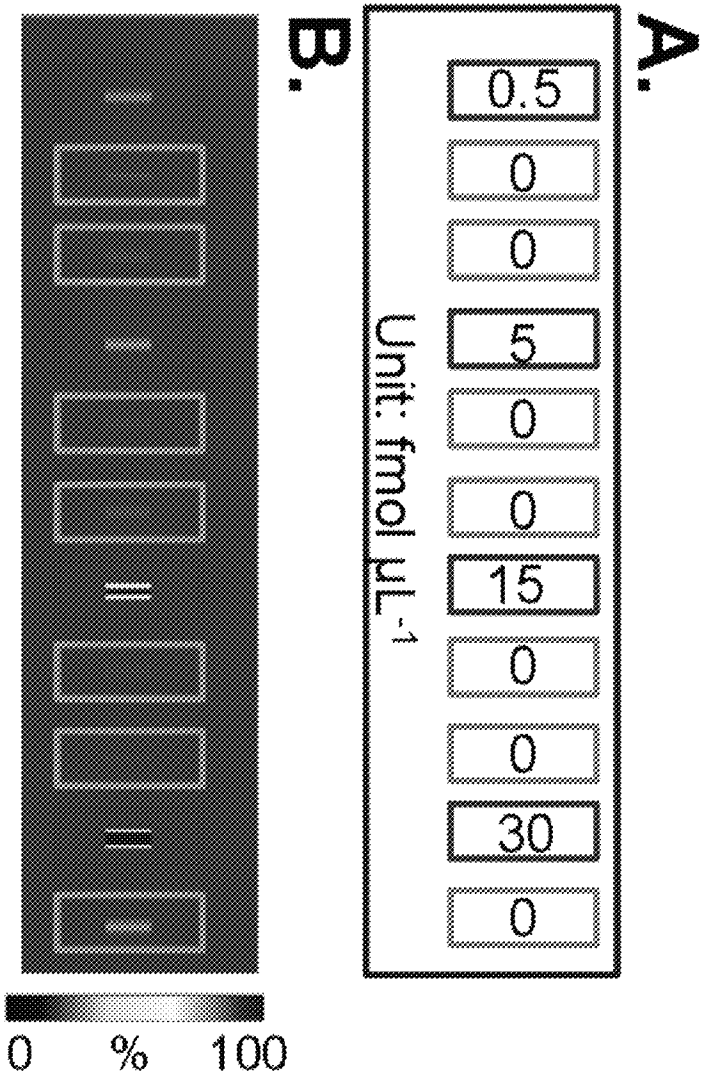
FIG. 60 illustrates a schematic representation of the content of pipet tips and the mapping of four concentrations of clozapine using the system and method in FIG. 32.

FIG. 59 provides the TIC and mass spectra the set of samples clozapine, leucine enkephalin, sphingomyelin, galanin, ubiquitin, and lysozyme, but at a lower speed. All 84 pipet tips containing 42 samples were analyzed in 10 min by reducing the x,y-stage movement to 1.5 mm sec-1. No cross-contamination was observed, but at the expense of analysis time. This approach is also less reproducible for larger molecules. However, in these experiments we used compounds ranging in molecular weight from 326 to 14300. In practice, better reproducibility and higher sensitivity is obtained when looking at a specific mass range for certain compound types, such as drugs or peptides. For example, analyzing the drug clozapine in four different substantially lower concentrations (0.5 to 30 fmol $\mu L^{-1}$) using MS/MS and mapping at m/z 270, the location and the relative amount present is correctly displayed for each vial as shown in FIG. 60. FIG. 60(A) illustrates a schematic representation of the content of each pipet tip. Boxes labeled with numerical values indicate tips filled with clozapine solutions at 0.5, 5, 15, and 30 fmol $\mu L^{-1}$, respectively; and boxes labeled with "0" represent pure solvent methanol. FIG. 60(B) illustrates the mapping of the m/z 270 peak, obtained by selecting the m/z 327 ($[M+H]^+$ ion) for CID fragmentation using normalized collision energy of 30. The maximum injection time was 100 milliseconds and data were acquired in the m/z range of 90-345.

For the pipet tips used in this study, the speed of sample introduction is greatly influenced by the exposure to the vacuum, and thus on the distance of the pipet exit to the inlet aperture of the mass spectrometer, the scanning nature of the mass spectrometer, and little if at all on the speed of movement of the x,y-stage. With increasing numbers of samples, reproducibility becomes more challenging to achieve because of alignment issues with the current method. Another possible issue is the pulsed nature of the ionization, which may be improved using the appropriate analyzer with ion trapping synchronized with the ionization event similar to the challenges previously observed with MALDI. It is expected that this can be optimized using shorter ion trapping and multiple microscans. Narrower scan windows will increase reproducibility as is the case for any targeted ESI analyses approach.

Automation of the SAII method provides a simple high throughput analysis approach for compounds regardless of mass, volatility, or "sprayability". The system and methods disclosed also provide large versatility, allowing variations in temperature ranges and solvents. With this approach, potentially 4000 samples can be analyzed per day per instrument using profile mode, without significant cross-contamination. In addition, higher throughput is envisioned with larger well plate numbers.

Example 4

Capillary-Microtiter Plate

Figure 61A:
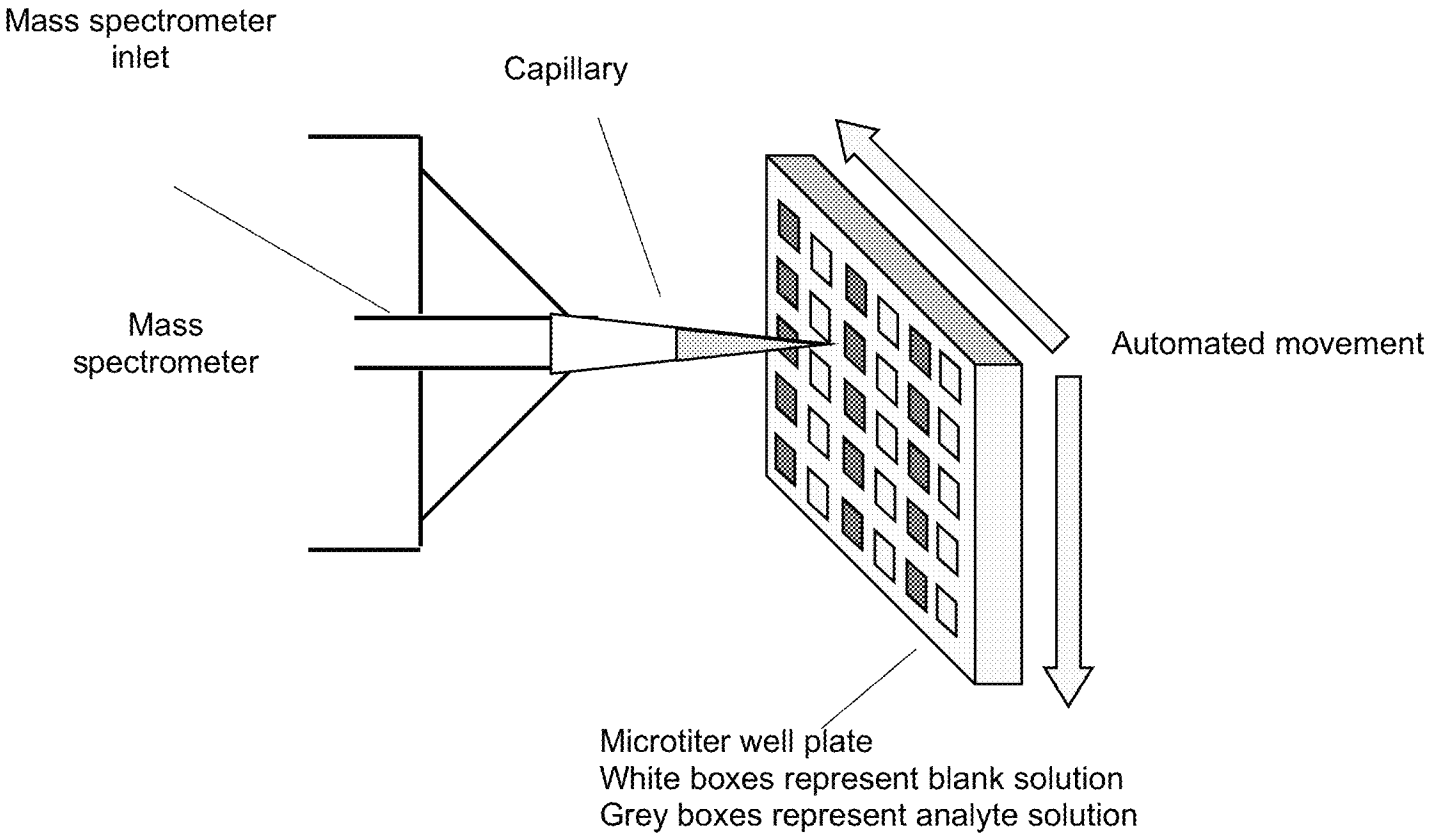
FIGS. 61A and 61B illustrate examples of multiplex systems for analysis by SAII/MS using a capillary and a multiple well plate format.
Figure 61B:
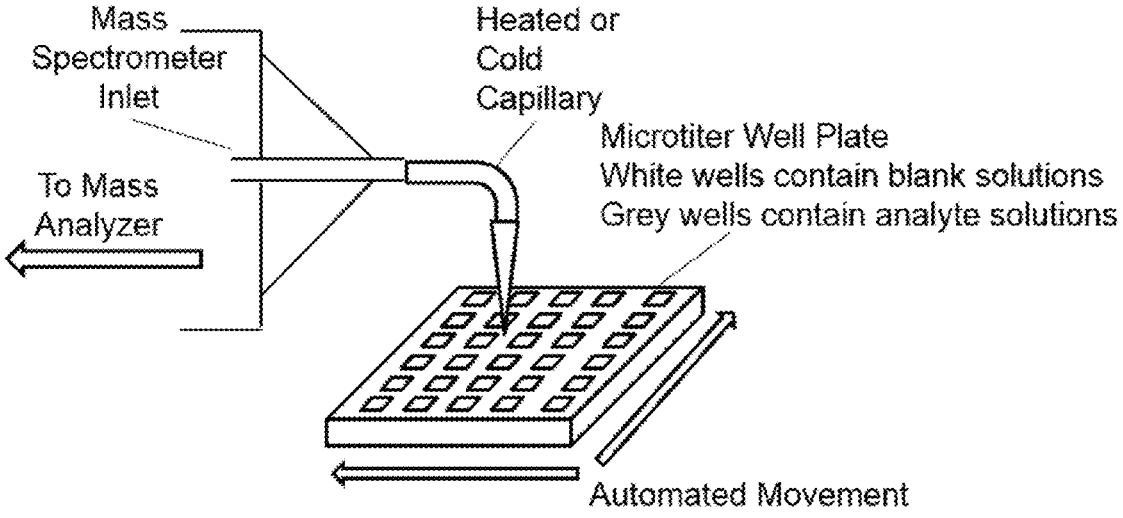

FIG. 61 illustrates embodiments of systems and methods for delivering analyte to a mass spectrometer for analysis by SAII/MS using a capillary tube and a multiple well format. In the embodiment illustrated in FIGS. 61(A) and (B), a capillary tube runs to the inlet channel. In some embodiments, the capillary tube has a pointed end. In various embodiments, the capillary tube can have a different shape or be affixed with a pipet tip. The capillary tube can be heated or cooled. In various embodiments, the multiple well format is a microtiter well plate containing any number of sample wells, including 2, 6, 8, 16, 30, 32, 64, 96, 384, 1536 or more wells. In other embodiments, the samples can be held in another type of well format that holds multiple samples. In some embodiments, the samples, or multiple well format, can be heated or, alternatively, cooled. In the embodiments in FIG. 61, the end of the capillary tube is dipped into the sample wells of a sample well plate, loading the sample into the inlet channel through the capillary tube due to the pressure differential across the capillary tube. In some embodiments, sample wells containing analyte (grey boxes) alternate between sample wells containing a pure solvent (white boxes), reducing cross-contamination. In various embodiments, the multiple well plate is affixed to a stage, whereby each well is sequentially moved in front of the end of the capillary tube that runs to the inlet of the mass spectrometer. The stage can be a x,y-stage, an x,y,z-stage, or other robotics. In the embodiment in FIG. 61(A), the multiple well plate is placed vertically and the capillary tube runs horizontally to the sample wells. In the embodiment in FIG. 61(B), the multiple well plate is placed horizontally and the capillary tube is bent to direct the capillary tube to the sample wells. In various embodiments, the well can be specifically aligned with the end of the capillary tube. In preferred embodiments, the stage is automated and can be controlled by a computer software program, by which particular variables can be determine, such as the number of samples, the distance between wells and the speed of movement of the stage. In some embodiments, the inlet channel of the mass spectrometer is heated. In alternative embodiments, the inlet channel is cooled.

Example 5

Addition of Ammonium Salts to High Throughput Analysis Using SAII/MS

Figure 62A:
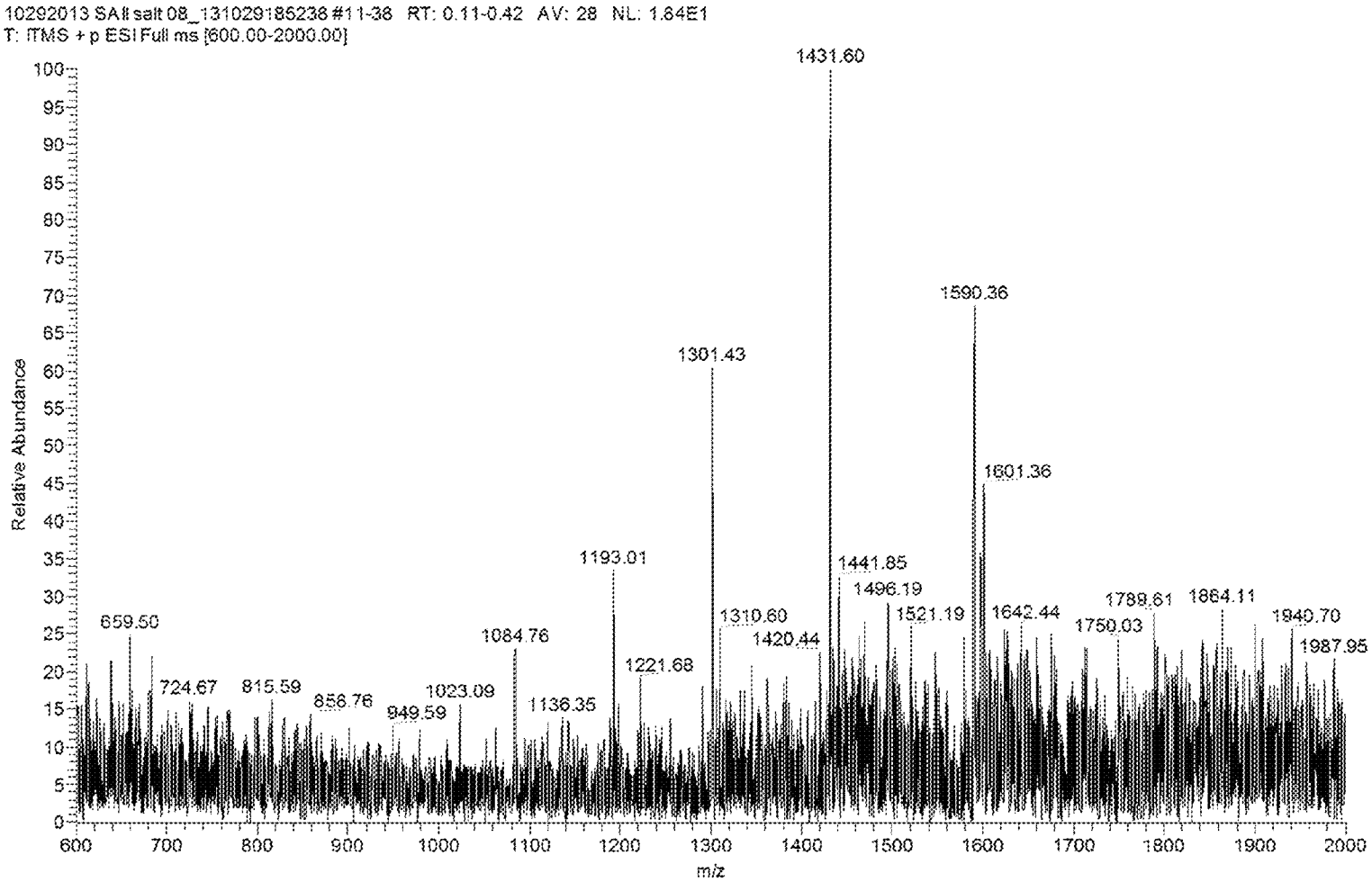
FIGS. 62A and 62B illustrate the SAII/MS mass spectra for (62A) 5 pmol/μL lysozyme solution without ammonium acetate compared to (62B) 5 pmol/μL lysozyme solution with ammonium acetate using the system and method in FIG. 61.
Figure 62B:
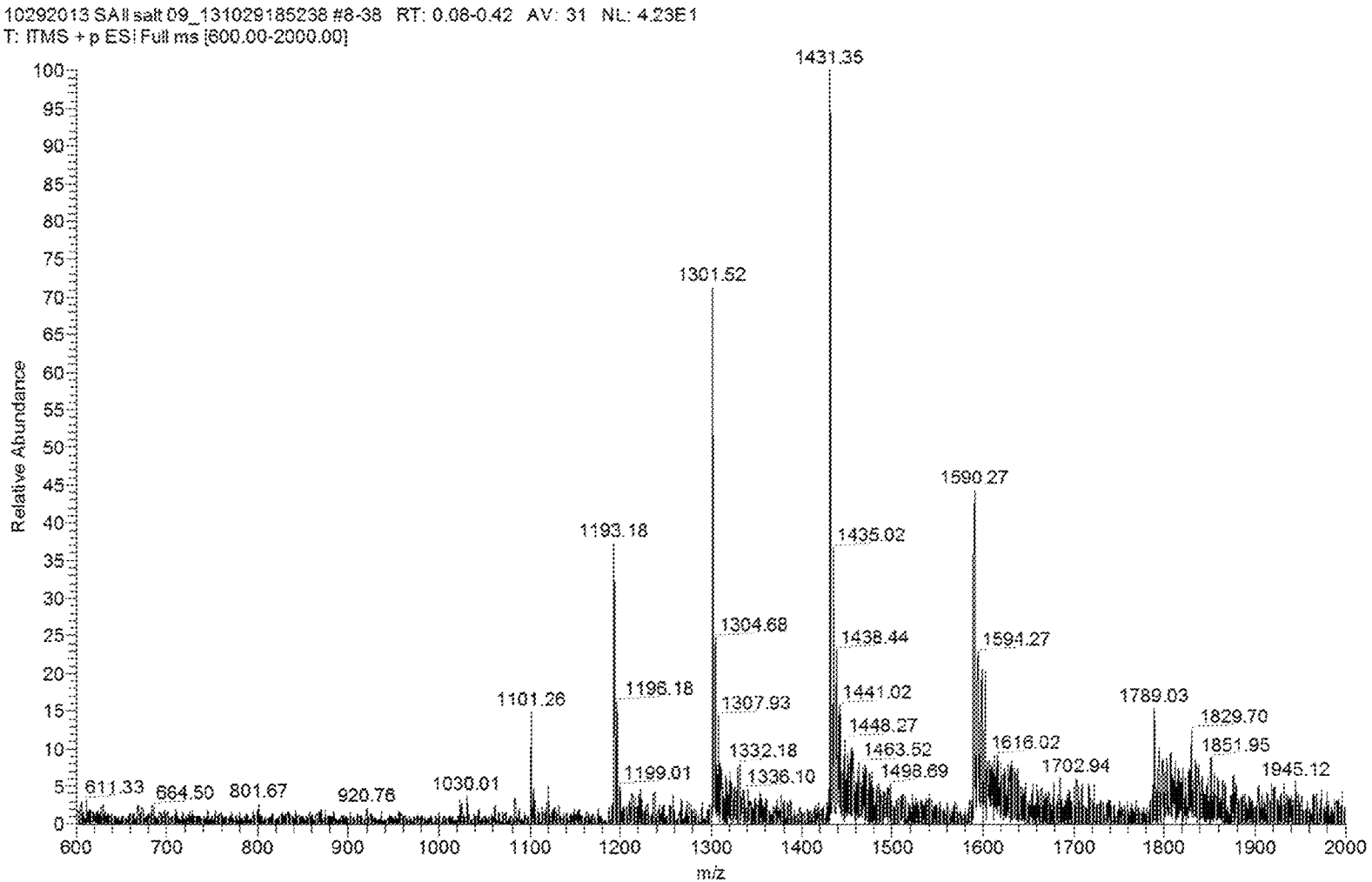

FIG. 62 shows mass spectra results for SAII/MS using a single pipet tip after the addition of ammonium salts to the analyte. Adding ammonium acetate to a lysozyme solution produced cleaner mass spectra, significantly improving the results. The mass spectra of (A) 5 pmol $\mu L^{-1}$ of lysozyme solution prepared in acetone:water with 1% formic acid was compared to the mass spectra of (B) in which 1 μL of 1 mM ammonium acetate solution was added to 19 μL of 5 pmol $\mu L^{-1}$ of lysozyme acetone:water with 1% formic acid for a final concentration of $5\times10^{-11}$ molar salt. Mass spectra were acquired by averaging three trials where 1 μL of solution was injected to the mass spectrometer inlet at 250° C. The mass of ammonium acetate is 77.

Example 6

SAII/MS Analysis of Cooled Samples

Figure 63A:
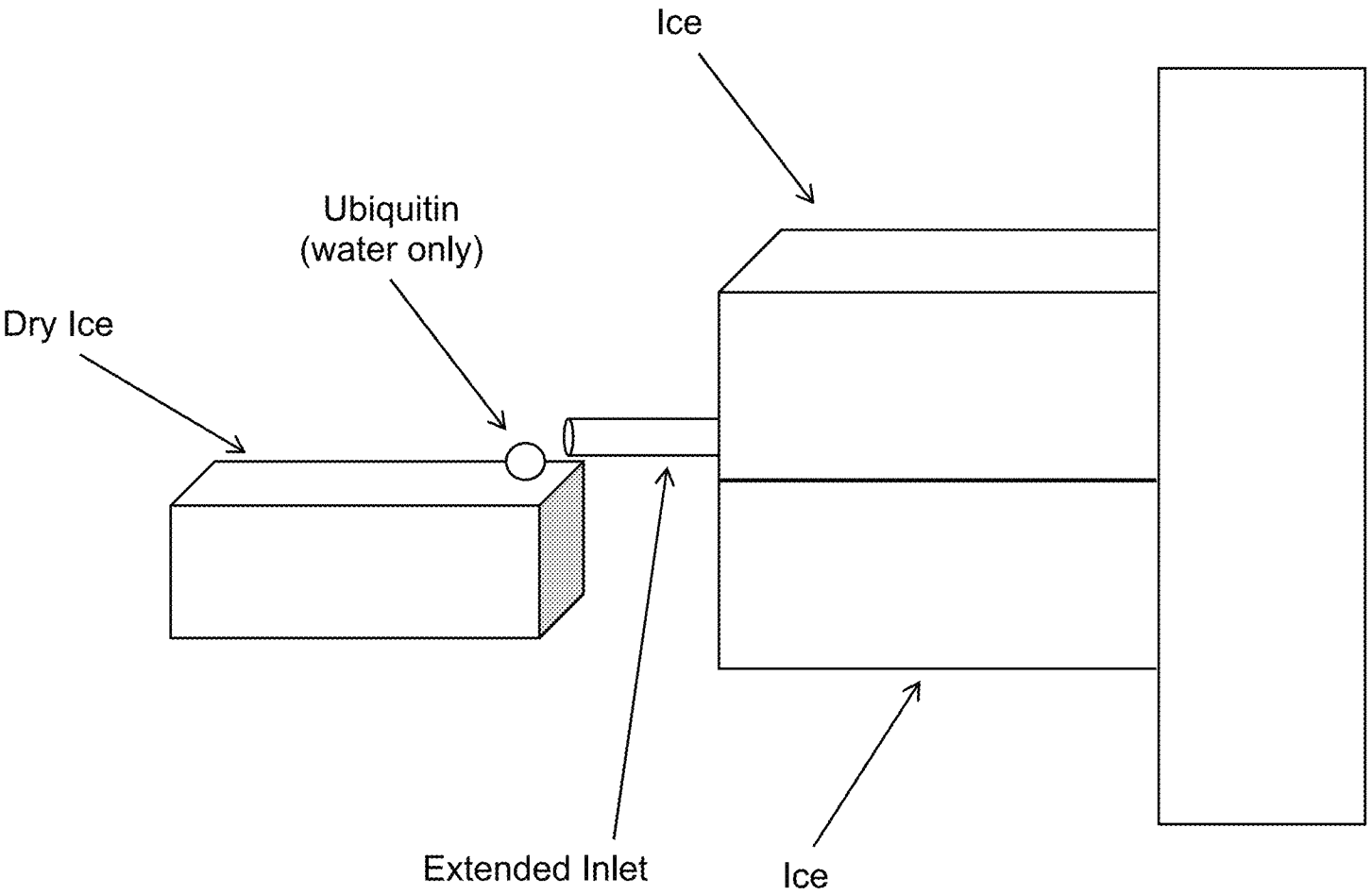
FIGS. 63A and 63B illustrate an example of a systems and methods for analysis by SAII/MS, by cooling the sample; and the resulting mass spectra.
Figure 63B:
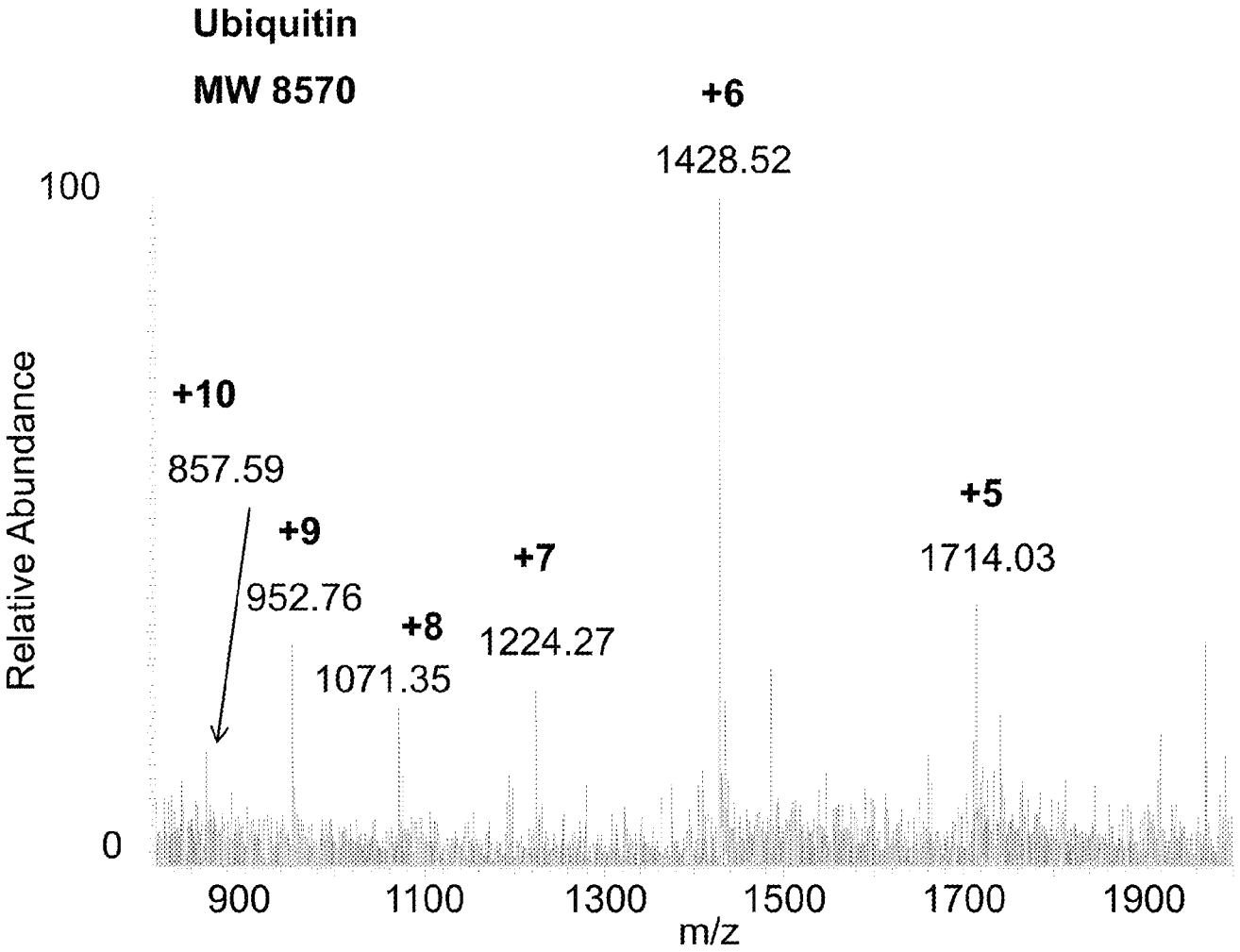

FIG. 63(A) shows an embodiment of systems and methods for delivering a cooled sample to a mass spectrometer for analysis by SAII/MS, where an extended metal capillary tube is used to deliver sample to the inlet of the mass spectrometer. The extended metal capillary is attached to the inlet tube of the mass spectrometer and cooled, for example by either dry ice or wet ice. FIG. 63(B) shows mass spectra results of ubiquitin for SAII/MS, employing the embodiment of the systems and methods in FIG. 63(A). Ubiquitin, at a concentration of 10 pmol in pure water, was spotted on a chunk of dry ice, causing it to shrink into a ball. The extended capillary was wrapped with wet ice in bags, cooling the temperature of the inlet of the extended capillary to 0° C. The original commercial inlet of the mass spectrometer (to which the extended capillary was attached) was heated to 150° C. The sample on the dry ice (in the form of a ball) was held 2 mm away from the inlet orifice of the extended capillary. Mass spectra was obtained while the dry ice was subliming.

Figure 64A:
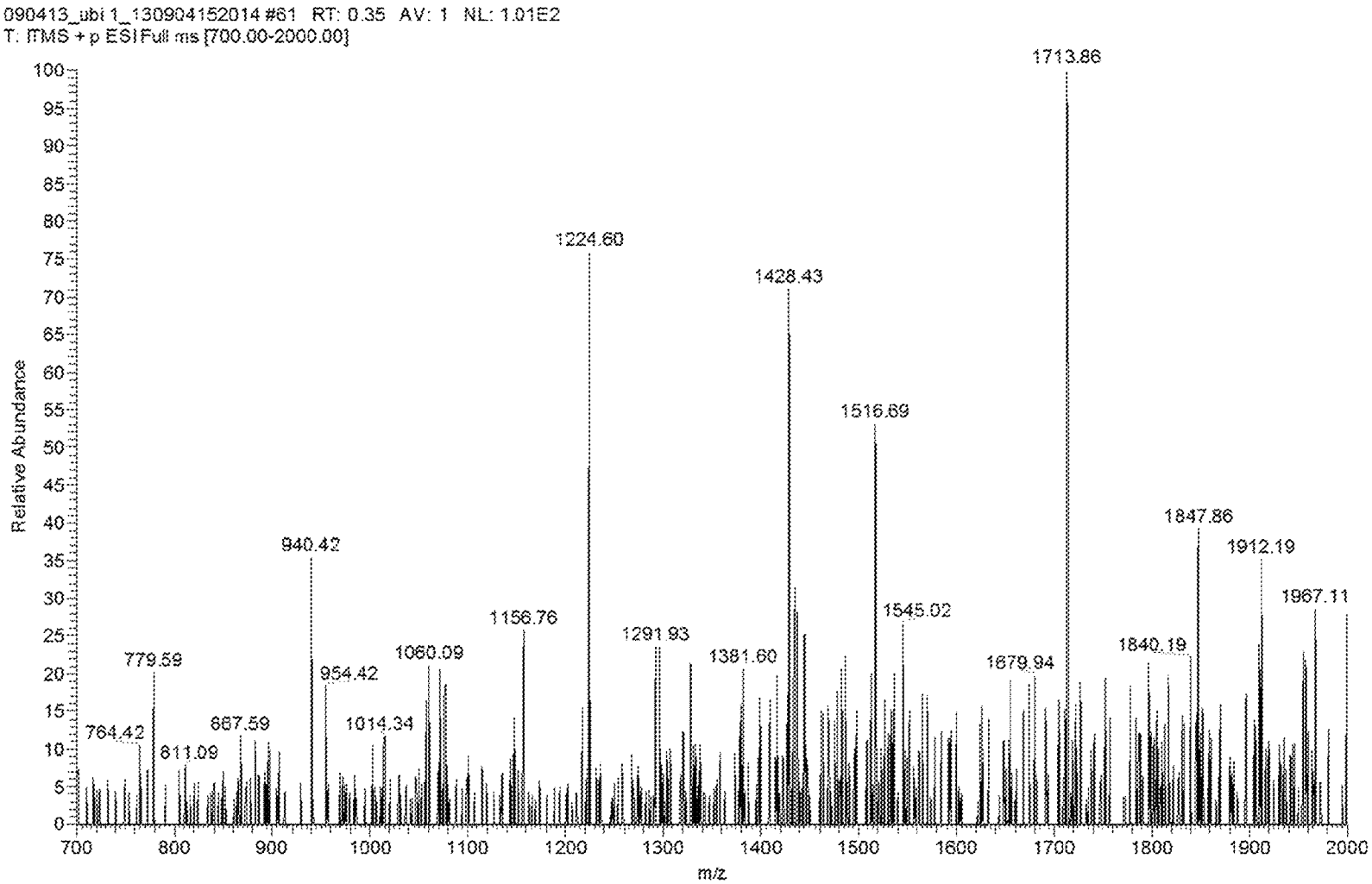
FIGS. 64A and 64B illustrates mass spectrum results for ubiquitin from a system and method for analysis by SAII/MS, by cooling the sample and the systems and methods shown in FIG. 63 (A).
Figure 64B:
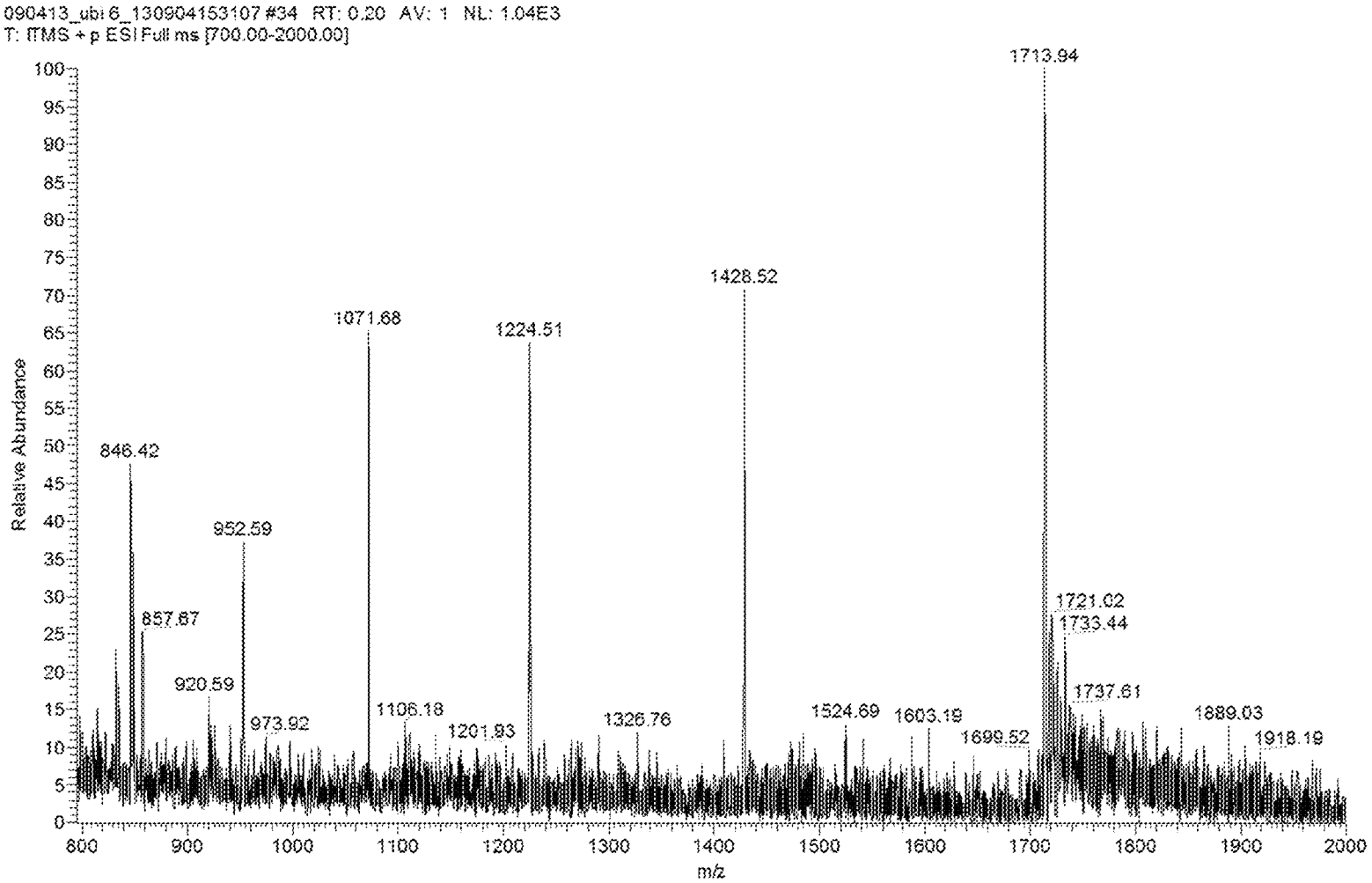

FIG. 64(A) shows mass spectra results for SAII/MS employing the embodiment of the systems and methods of FIG. 63(A), with variations as follows: The inlet to the extended metal capillary was cooled by rubbing dry ice on the inlet 1 cm near the inlet orifice. The original commercial inlet of the mass spectrometer was heated to 80° C. Ubiquitin was dissolved in 50:50 methanol:water with 1% formic acid and injected into the inlet. FIG. 64(B) shows mass spectra results for SAII/MS for ubiquitin under the same conditions as in FIG. 64(A), except that the inlet to the extended metal capillary tube was not rubbed with dry ice, but instead, left at room temperature.

As will be understood by one of ordinary skill in the art, each embodiment disclosed herein can comprise, consist essentially of or consist of its particular stated element, step, ingredient or component. As used herein, the transition term "comprise" or "comprises" means includes, but is not limited to, and allows for the inclusion of unspecified elements, steps, ingredients, or components, even in major amounts. The transitional phrase "consisting of" excludes any element, step, ingredient or component not specified. The transitional phrase "consisting essentially of" limits the scope of the embodiment to the specified elements, steps, ingredients or components and to those that do not materially affect the embodiment.

To the extent that a numerical value is not preceded by the term "about," all numbers expressing quantities of ingredients, properties such as molecular weight, reaction conditions, and so forth, used in the specification and claims are to be understood as being modified in all instances by the term "about." To the extent that a numerical value is preceded by the term "approximately," it should be interpreted to mean "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. When further clarity is required, the term "about" has the meaning reasonably ascribed to it by a person skilled in the art when used in conjunction with a stated numerical value or range, i.e. denoting somewhat more or somewhat less than the stated value or range, to within a range of ±20% of the stated value; ±19% of the stated value; ±18% of the stated value; ±17% of the stated value; ±16% of the stated value; ±15% of the stated value; ±14% of the stated value; ±13% of the stated value; ±12% of the stated value; ±11% of the stated value; ±10% of the stated value; ±9% of the stated value; ±8% of the stated value; ±7% of the stated value; ±6% of the stated value; ±5% of the stated value; ±4% of the stated value; ±3% of the stated value; ±2% of the stated value; or ±1% of the stated value.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Furthermore, to the extent that references have been made to patents and printed publications in this specification, each of the above-cited references and printed publications are individually incorporated herein by reference in their entirety.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice.

Definitions and explanations used in the present disclosure are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary, 3rd Edition or a dictionary known to those of ordinary skill in the art, such as the Oxford Dictionary of Biochemistry and Molecular Biology (Ed. Anthony Smith, Oxford University Press, Oxford, 2004).

What is claimed is:

1. A multiplex system for allowing high throughput analysis of samples using solvent assisted ionization inlet (SAII) comprising:

(i) an ionizing system for SAII wherein the ionizing system lacks a laser, an electrode and a voltage source;

(ii) a x,y-stage or x,y,z-stage; and (iii) a software program stored on a non-transitory computer readable medium that maps samples according to a selection criteria.

2. The multiplex system of claim 1, further comprising delivery tips that are serially aligned to the inlet of the ionizing system using the x,y-stage or x,y,z-stage.

3. The multiplex system of claim 1, further comprising a multiple well plate that is serially aligned with a tube using the x,y-stage or the x,y,z-stage, wherein the tube can deliver solution from the wells to the ionizing system.

4. The multiplex system of claim 2, wherein the delivery tips are held by a multiple channel pipet or multiple pipet tip holder.

5. The multiplex system of claim 4, wherein the multiple channel pipet or multiple pipet tip holder holds 1 to 1,536 delivery tips.

6. The multiplex system of claim 3, wherein the multiple well plate comprises well numbers ranging from 1 to 1,536.

7. The multiplex system of claim 3, wherein the multiple well plate is vertical and the tube is positioned horizontally from the inlet.

8. The multiplex system of claim 3, wherein the multiple well plate is horizontal and the tube is bent to position it from the inlet into the wells of the well plate.

9. The multiplex system of claim 1, wherein the software program is enabled to allow acquisition of data from 1000 samples in one hour.

10. The multiplex system of claim 1, wherein the selection criteria is the location of an analyte.

11. The multiplex system of claim 1, wherein the selection criteria is the quantity of an analyte.

12. The multiplex system of claim 1, wherein the software program is imaging software.

13. A method of achieving high throughput analysis of samples using solvent assisted ionization inlet comprising:

creating a pressure differential across the inlet channel of a mass spectrometer;

heating or cooling the inlet channel of the mass spectrometer;

serially aligning the samples with the inlet of a mass spectrometer; acquiring data regarding each sample;

mapping the data according to a selection criteria; and obtaining additional information about a sample mapped positively according to the selection criteria wherein, for sample ionization, the method does not utilize a laser, an electrode or a voltage source.

14. The method of claim 13, wherein the mapping is performed by imaging software stored on a non-transitory computer readable medium.

15. The method of claim 13, wherein the sample enters the mass spectrometer through the pressure differential across the inlet channel.

16. The method of claim 13, wherein pure solvent is loaded between samples.

17. The method of claim 13, wherein the method acquires data from 1000 samples in one hour.

18. The method of claim 13, further comprising cooling the sample and the inlet channel.

19. The method of claim 13, further comprising adding ammonium salts to the sample.

20. The method of claim 13, further comprising adding a low viscosity solvent to the sample.

21. The method of claim 13, wherein the serial alignment is achieved using a x,y-stage or a x,y,z-stage.

22. The method of claim 13, wherein the selection criteria maps the sample according to the location of an analyte.

23. The method of claim 13, wherein the selection criteria maps the sample according to the quantity of an analyte.

24. A multiplex system for allowing high throughput analysis of samples using solvent assisted ionization inlet (SAII) comprising:

(i) an ionizing system for SAII wherein the ionizing system does not require a laser, an electrode, or a voltage source;

(ii) a x,y-stage or x,y,z-stage; and (iii) a software program stored on a non-transitory computer readable medium that maps samples according to a selection criteria.

25. The multiplex system of claim 24, further comprising delivery tips that are serially aligned to the inlet of the ionizing system using the x,y-stage or x,y,z-stage.

26. The multiplex system of claim 24, further comprising a multiple well plate that is serially aligned with a tube using the x,y-stage or the x,y,z-stage, wherein the tube can deliver solution from the wells to the ionizing system.

27. The multiplex system of claim 25, wherein the delivery tips are held by a multiple channel pipet or multiple pipet tip holder.

28. The multiplex system of claim 27, wherein the multiple channel pipet or multiple pipet tip holder holds 1 to 1,536 delivery tips.

29. The multiplex system of claim 26, wherein the multiple well plate comprises well numbers ranging from 1 to 1,536.

30. The multiplex system of claim 26, wherein the multiple well plate is vertical and the tube is positioned horizontally from the inlet.

31. The multiplex system of claim 26, wherein the multiple well plate is horizontal and the tube is bent to position it from the inlet into the wells of the well plate.

32. The multiplex system of claim 24, wherein the software program is enabled to allow acquisition of data from 1000 samples in one hour.

33. The multiplex system of claim 24, wherein the selection criteria is the location of an analyte.

34. The multiplex system of claim 24, wherein the selection criteria is the quantity of an analyte.

35. The multiplex system of claim 24, wherein the software program is imaging software.

36. A method of achieving high throughput analysis of samples using solvent assisted ionization inlet comprising:

creating a pressure differential across the inlet channel of a mass spectrometer;

heating or cooling the inlet channel of the mass spectrometer;

serially aligning the samples with the inlet of a mass spectrometer;

acquiring data regarding each sample; mapping the data according to a selection criteria; and obtaining additional information about a sample mapped positively according to the selection criteria wherein, for sample ionization, the method does not require a laser, an electrode, or a voltage source.

37. The method of claim 36, wherein the mapping is performed by imaging software stored on a non-transitory computer readable medium.

38. The method of claim 36, wherein the sample enters the mass spectrometer through the pressure differential across the inlet channel.

39. The method of claim 36, wherein pure solvent is loaded between samples.

40. The method of claim 36, wherein the method acquires data from 1000 samples in one hour.

41. The method of claim 36, further comprising cooling the sample and the inlet channel.

42. The method of claim 36, further comprising adding ammonium salts to the sample.

43. The method of claim 36, further comprising adding a low viscosity solvent to the sample.

44. The method of claim 36, wherein the serial alignment is achieved using a x,y-stage or a x,y,z-stage.

45. The method of claim 36, wherein the selection criteria maps the sample according to the location of an analyte.

46. The method of claim 36, wherein the selection criteria maps the sample according to the quantity of an analyte.

* * * * *